US005757399A

United States Patent [19]

Murayama et al.

[11] Patent Number: 5,757,399

[45] Date of Patent: May 26, 1998

[54] INK JET RECORDING APPARATUS WITH MOVABLE RECOVERY ASSEMBLY

[75] Inventors: Yasushi Murayama, Tokyo; Tomohiro Aoki, Yokohama; Tohru Kobayashi, Tokyo; Masatoshi Ikkatai, Kawasaki; Takashi Uchida, Yokohama; Tatsuo Mitomi, Yokohama; Masaharu Nemura, Yokohama; Yasuyuki Takanaka, Yokohama, all of Japan

[73] Assignee: Canon Kabushiki Kaisha, Tokyo, Japan

[21] Appl. No.: 680,880

[22] Filed: Jul. 16, 1996

Related U.S. Application Data

[63] Continuation of Ser. No. 26,092, Mar. 4, 1993, abandoned, which is a continuation of Ser. No. 649,011, Jan. 31, 1991, abandoned.

[30] Foreign Application Priority Data

| | | | |
|---|---|---|---|
| Feb. 2, 1990 | [JP] | Japan | 2-22195 |
| Feb. 2, 1990 | [JP] | Japan | 2-22197 |
| Feb. 2, 1990 | [JP] | Japan | 2-22200 |
| Feb. 13, 1990 | [JP] | Japan | 2-29498 |

[51] Int. Cl.[6] ..... B41J 2/165

[52] U.S. Cl. ..... 347/32; 347/36; 347/42

[58] Field of Search ..... 347/32, 29, 36, 347/42

[56] References Cited

U.S. PATENT DOCUMENTS

| | | | |
|---|---|---|---|
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,558,333 | 12/1985 | Sugitani et al. . | |
| 4,680,696 | 7/1987 | Ebinuma et al. | 347/85 |
| 4,692,778 | 9/1987 | Yashimura et al. | 347/108 |

(List continued on next page.)

FOREIGN PATENT DOCUMENTS

| | | | |
|---|---|---|---|
| 0376309 | 7/1990 | European Pat. Off. | B41J 2/165 |
| 2585289 | 5/1987 | France | B41J 3/04 |
| 3446998 | 7/1985 | Germany | B41J 3/04 |
| 3633239 | 4/1987 | Germany | B41J 3/04 |
| 3736916 | 5/1988 | Germany | B41J 3/04 |
| 54-056847 | 5/1979 | Japan | B41M 5/26 |
| 56-027352 | 3/1981 | Japan | B41J 3/04 |
| 59-91064 | 5/1984 | Japan | B41J 3/04 |
| 59-123670 | 7/1984 | Japan | B41J 3/04 |
| 59-138461 | 8/1984 | Japan | B41J 3/04 |
| 60-071260 | 4/1985 | Japan | B41J 3/04 |
| 62-116152 | 5/1987 | Japan | B41J 3/04 |

*Primary Examiner*—Joseph W. Hartary

*Attorney, Agent, or Firm*—Fitzpatrick, Cella, Harper & Scinto

[57] ABSTRACT

The present invention provides an ink jet recording apparatus comprising a conveying means for a recording medium in a substantially horizontal direction, a head holding means for holding a plurality of ink jet heads in such a manner that the ink jet heads discharge ink vertically downward toward the recording medium conveyed by the conveying means in the substantially horizontal direction, a vertical shifting means for shifting the head holding means in a substantially vertical direction, a head recovery means for recovering and preventing the non-discharge of ink from the plurality of ink jet heads, in a condition opposed to the plurality of ink jet heads, and a horizontal shifting means for shifting the head recovery means in the substantially horizontal direction into a spatial area provided above the recording medium by lifting the head holding means in the substantially vertical direction by means of the vertical shifting means, so that the head recovery means is opposed relation to the plurality of ink jet heads.

The head recovery means is provided with a waste ink opening for exhausting waste ink discharged from the ink jet head to the head recovery means in a recovery operation. The apparatus also includes incline means for inclining the head recovery means. When the head recovery means is retracted from the ink jet head, the head recovery means is inclined so that the side thereof having the waste ink opening is lower than the opposite side.

20 Claims, 60 Drawing Sheets

U.S. PATENT DOCUMENTS 4,723,129 2/1988 Endo et al. .
4,737,801 4/1988 Ichihashi ..... 347/89
4,740,796 4/1988 Endo et al. .
4,748,459 5/1988 Ichihashi ..... 347/31
4,959,662 9/1990 Kobayashi .
5,006,867 4/1991 Koizumi ..... 347/17
5,040,000 8/1991 Yokoi ..... 347/30
5,055,861 10/1991 Murayama ..... 347/29

INK JET RECORDING APPARATUS WITH MOVABLE RECOVERY ASSEMBLY

This application is a continuation of application Ser. No. 08/026,092 filed Mar. 4, 1993 now abandoned, which is a continuation of application Ser. No. 07/649,011 filed Jan. 31, 1991 now abandoned.

BACKGROUND OF THE INVENTION

1. Field of the Invention

The present invention relates to an ink jet recording apparatus, and more particularly, it relates to an ink jet recording apparatus having the function of, for example, a facsimile, copying machine or printer, and an ink jet recording apparatus used as an output device for a composite machine having such functions or a work station.

2. Related Background Art

Non-impact recording methods are effective recording methods because the noise generated in the recording operation is so low as to be negligible. Among the non-impact recording methods, an ink jet recording method which permits a high speed recording and which can record an image on a plain paper without a specific fixing treatment is extremely effective.

A recording head used in an ink jet recording apparatus generally includes fine liquid discharge openings (orifices), liquid passages, energy acting portions disposed in the liquid passages, and energy generating means acting on the energy acting portions, for generating the energy utilized to discharge ink from the discharge openings.

The recording processes utilizing such energy generating means include a recording process using electrical/mechanical converters such as piezo-electric elements, a recording process using energy generating means wherein the electro-magnetic wave such as a laser beam is illuminated onto the liquid (ink) so that the electro-magnetic wave is absorbed by the liquid to heat the latter, thereby discharging the liquid as liquid droplets flying toward a recording medium, a recording process using energy generating means wherein the liquid is heated by electrical/thermal converters such as heat generating elements having heat generating resistors, thereby discharging the liquid, or the like.

Among these recording processes, recording heads used in an ink jet recording process wherein the liquid is discharged by the thermal energy permit the recording with high resolving power since the liquid discharge openings (orifices) for discharging the liquid as recording liquid droplets can be arranged with high density in the head.

Among them, a recording head using the electrical/thermal converters as the energy generating means can be easily small-sized as a whole, can fully utilize the advantages of the IC technique and/or micro-working technique that the remarkably been improved in the recent semiconductor field, can easily attain the multi-nozzle arrangement and high density arrangement since it can easily be lengthened and made two-dimensioned, and can provide an ink jet recording head which is inexpensive and is manufactured in the mass-production line, and a recording apparatus having such recording head.

As mentioned above, the ink jet recording head using the electrical/thermal converters as the energy generating means and manufactured through the semi-conductor manufacturing process generally has a plurality of liquid passages corresponding to the orifices, and a plurality of electrical/thermal converters adapted to apply the thermal energy to the liquid in the corresponding liquid passages to discharge the liquid as the recording liquid droplets from the corresponding orifices. Further, the liquid passages are connected to a common liquid chamber so that the liquid passages can be filled with the liquid from the common chamber.

FIG. 1 is a perspective view showing a schematic construction of such ink jet recording head. This Figure shows the ink jet recording head constituted by heat generating resistors of electrical/thermal converters 1103 formed on a substrate 1102 by the film forming method through the semi-conductor manufacturing process, electrodes 1104, liquid passage walls 1105, and a top plate 1106.

A recording liquid 1112 is supplied to a common liquid chamber 1108 of the recording head 1101 from a liquid reservoir (not shown) via a liquid supply tube 1107. The reference numeral 1109 denotes a connector for the connection with the liquid supply tube.

The recording liquid 1112 supplied to the common liquid chamber 1108 is sent to liquid passages 1110 by a capillary phenomenon and is stably held in the passages by forming a meniscus at a liquid discharge surface (orifice surface) positioned at the free ends of the liquid passages. By selectively energizing the heat generating resistor of the electrical/thermal converter 1103, the liquid on the electrical/thermal converter is quickly heated to form a bubble in the liquid, with the result that the liquid is discharged as a liquid droplet from a corresponding discharge opening 1111 in response to the growth and contraction of the bubble.

With the arrangement as mentioned above, it is possible to obtain the ink jet recording head having 128 or 256 discharge openings arranged with high density in the order of 16 nozzle/mm or having the multi orifice construction wherein the discharge openings are arranged along the whole recording width of the head.

An example of an ink jet recording apparatus having such ink jet recording head is disclosed in U.S. Pat. No. 4,692,778. According to this patent, the arrangement wherein a head unit can be moved in a horizontal direction and a cap unit can be moved in a vertical direction is disclosed. With this arrangement, by disposing a recording medium stocking area in confronting relation to a cap retarding position, it is possible to utilize effectively space.

However, since the cap is shifted in the vertical (gravitational) direction across a recording medium feeding path, if the recording medium is kept in the cap shifting path when the recording medium is jammed, the cap shifting mechanism will be damaged or the head itself cannot perform the recording operation.

In particular, since the recording head using the thermal energy is relatively sensitive to the adhesion of dust thereto and the shock leading to the deterioration of the strength of the head (because the construction thereof is limited for improving the thermal endurance), if the recording head unduly contacts the recording medium or is subjected to an excessive force, the recording operation would be partially impossible.

By the way, FIG. 2 is a schematic perspective view showing an example of an ink jet recording apparatus of a so-called serial scan type wherein the recording is effected by reciprocally shifting a recording head with respect to a recording medium. In FIG. 2, an ink jet recording head 1101 is formed integrally with a carriage 1214 reciprocally shifted on rails 1213*a*, 1213*b* by means of a motor 1216. In FIG. 2, the reference numeral 1217 denotes a shaft; 1218*a*, 1218*b* denote pulleys; and 1219 denotes a belt. Ink contained in ink tanks 1222Y, 1222M, 1222C and 1222B is supplied to the recording head 1101 by means of pumps 1223Y, 1223M, 1223C and 1223B through pipes 1221B, 1221M, 1221C and 1221B. The recording medium (recording paper) is conveyed along a platen roller 1212 and is temporarily stopped. The recording head 1101 records an image on the recording medium by discharging the ink and can be reciprocally shifted along the rails 1213*a*, 1213*b*. After the recording of a predetermined width is finished, the recording head 1101 returns to its home position along the rails 1213*a*, 1213*b*; meanwhile, the recording medium is fed by a predetermined amount by means of the platen roller 1212 and is then stopped again. By repeating such recording operations, the image is recorded on the recording medium.

When a plurality of recording heads are integrally mounted on such ink jet recording apparatus, in the past, a distance between the adjacent recording heads was relatively great, with the result that the registration had to be greater; however, in this case, not only the recording speed was reduced, but also it was feared that the error in the registration was great. Consequently, the inventors of this invention aim to reduce the distance between the adjacent recording heads as much as possible so as to be negligible.

However, there was a risk that small-sized dirt and/or ink mist was penetrated between the recording heads, with the result that an ink lump and/or the solid body was adhered to the recording head itself due to the existence of dirt and/or paper powder at an end of the recording head for some reasons. This problem resulted in not only the contamination of the ink jet recording apparatus and of the recording medium, but also the poor discharge of ink including the jamming of the discharge opening or openings. The inventors of this invention guess that such problem occurs mainly because the dirt is penetrated from the atmosphere between the recording heads and/or the dirt such as the ink mist and paper powder from the recording area are penetrated between the recording heads.

Further, when the recording is effected with directing the discharge openings of the recording heads downwardly, it is apt to generate an upward air flow between the recording heads, and, accordingly, it is considered that such tendency is increased due to the influence of thermal convection generated when the thermal energy is used with the recording heads. In addition, the inventors guess that a difference between the temperature adjusted reference due to the heat accumulated in the recording heads during the recording operation and the heat dispersion from the waiting recording heads, and the actual temperature of the recording heads is created between the plural recording heads and between the cap and a holding member for integrally holding the plural recording heads, which has a great influence upon the above problem.

In particular, when the recording head has the multi-orifice arrangement and is lengthened to have a width substantially the same as that of the recording medium, since a recording process quite different from that of the serial scan type must be performed, there arise various problems different from those in the conventional recording apparatus of serial scan type. Especially, with respect to the head recovery operation or head recovery system which have a great influence upon the image quality, and the reliability, endurance and/or service life of the apparatus, in the lengthened recording head of the multi-nozzle type, since there are a great number of discharge openings, it is important to maintain the stable ink discharge from all of the discharge openings, to prevent the non-discharge of ink, and, particularly, to prevent the drying of the discharge surface of the head, to prevent the ink from leaking or migrating from the discharge surface to other elements such as electric circuits and/or recording medium, and to prevent the mixing of ink of different colors during the multi-color recording.

FIG. 3 shows an example of an ink supply system of the above-mentioned ink jet recording head. In FIG. 3, the reference numeral 501 denotes a recording head of a so-called full-line type wherein the ink discharge openings are arranged in correspondence to the whole width of a recording area of the recording medium. The reference numeral 508 denotes a common liquid chamber formed in the recording head 501; and 510*a* denotes a plurality of ink discharge openings arranged on an ink discharge surface 511*a*. By selectively energizing heat generating elements disposed in corresponding liquid passages (not shown) communicating with the corresponding ink discharge openings, it is possible to discharge the ink from the discharge opening or openings 510*a*. The reference numeral 522 denotes an ink supply tank for supplying the ink to the recording head 501, and the ink is supplied from the ink supply tank 522 to the common liquid chamber 508 of the recording head 501 via a supply tube (first ink path) 525. The reference numeral 527 denotes a recovery motor used for the head recovery operation for recovering the discharge function or ability of the recording head 501, which recovery motor 527 is communicated with the recording head 501 via a circulating tube (second ink path) 526. The tubes 525, 526 have substantially the same lengths and same inner diameters.

In the recording head 501, ink supply system and head recovery system so constituted, during the recording operation, the ink is supplied, by its own weight, from the ink supply tank 522 to the common liquid chamber 508 via the ink supply tube 525, and is directed from the common liquid chamber 508 to the ink discharge openings 510*a* via the liquid passages (not shown). Further, during the head recovery operation effected to remove foreign matter such as bubbles remaining in the common liquid chamber 508 and/or in the ink supply system and to cool the recording head 501, the recovery pump 527 is activated to forcibly send the ink to the common liquid chamber 508 via the circulating tube 526 and to return the ink from the common liquid chamber 508 to the ink supply tank 522 via the ink supply tube 525, thus circulating the ink. Furthermore, during the initial ink filling operation into the liquid passages and the like, the ink is forcibly sent to the common liquid chamber 508 via the circulating tube 526 by means of the recovery pump 527, thereby discharging the ink together with the bubbles from the ink discharge openings 510*a*.

And, especially, when a recording head of full-line type is used, since a large amount of ink is consumed because of the high speed recording and the continuous long-run recording, it is required to stabilize the ink supply condition.

However, in this case, the amount of ink supplied to the recording head via the ink supply tube was not necessarily adequate for performing the high speed recording.

In addition, in the ink jet recording apparatus which can perform both the full-color printing and the mono-color printing, generally, the recording head for the black (BK) ink is most frequently used. Incidentally, in a special use, the red color or yellow color is sometimes used in the mono-color recording.

Therefore, the amount of ink of specific color (hereinafter, specifying as "black ink") consumed in the mono-color printing operation will be great, and cannot be compared with the consumption amount of each ink in the full-color printing.

For this reason, during the full-color printing (i.e., while the recording is effected with using a plurality of colors), the above-mentioned ink of specific color (black ink) is sometimes used up, with the result that there arises a problem that the full-color printing operation must be interrupted halfway or the recording medium being printed must be discarded. Particularly, the interruption of the printing operation sometimes results in poor feeding of the recording medium, or a reduction in the image density leading in the deterioration of the image quality.

Further, in the above case, even when the mono-color printing is effected, particularly even when an original of black characters is copied, the recording media (recording papers) same as those used in the four-color printing are frequently used.

Essentially, the recording paper used in the four-color printing is more expensive than a plain paper since it is coated by specific material to increase the ink absorbing ability and the color visualizing ability. Thus, even when the mono-color printing is effected (particularly, even when the recording is effected with the black ink), the paper which is rather expensive is used.

SUMMARY OF THE INVENTION

An object of the present invention is to eliminate the above-mentioned drawbacks and to provide an ink jet recording apparatus wherein, even when the poor feeding of a recording medium occurs, a recording head and/or recovery system are not deteriorated and mechanisms for shifting the recording head and recovery elements are not damaged.

Another object of the present invention is to provide an ink jet recording apparatus wherein, by shortening the operation time of the recovery system, even during the recording operation, the feeding of the recording medium can be interrupted to start the recovery operation.

A further object of the present invention is to provide an ink jet recording apparatus which can effectively discharge the ink in the recovery system and can improve the discharge exhaustion of ink from an ink absorber.

A still further object of the present invention is to provide an ink jet recording apparatus which can solve the problems that effect a bad influence upon the ability of the recovery system and of the recording head when it has a multi-orifice arrangement and is lengthened to cover a width of the recording medium, and which can obtain the high quality image for a long time and is highly reliable.

A further object of the present invention is to provide an ink jet recording apparatus wherein, even when a recording head of full-line type is used, the insufficient supply of ink to the recording head does not occur even during the recording operation, and which can perform the high speed recording and does not reduce the ink discharge response, ink discharge efficiency and ink discharge stability.

A still further object of the present invention is to provide an ink jet recording apparatus wherein, even a print mode of specific color is mainly effected, the above-mentioned drawbacks that arise in a multi-color print mode can be readily eliminated.

A further object of the present invention is to provide an ink jet recording apparatus which can cheaply effect the mono-color recording.

The other object of the present invention is to provide an ink jet recording apparatus comprising a conveying means for converging a recording medium in a substantially horizontal direction, a head holding means for holding a plurality of ink jet heads in such a manner that the ink jet heads discharge ink vertically downward toward the recording medium conveyed by the conveying means in the substantially horizontal direction, a vertical shifting means for shifting the head holding means in a substantially vertical direction, a head recovery means for recovering and preventing the non-discharge of ink from the plurality of ink jet heads and being disposed in opposition to the plurality of ink jet heads, and a horizontal shifting means for shifting the head recovery means in a substantially horizontal direction into a spatial area provided above the recording medium by lifting the head holding means substantially in the vertical direction by means of the vertical shifting means, so that the head recovery means is in opposed to the plurality of ink jet heads.

DETAILED DESCRIPTION OF THE PREFERRED EMBODIMENTS

The present invention will now be explained in connection with embodiments thereof with reference to the accompanying drawings.

Figure 1:
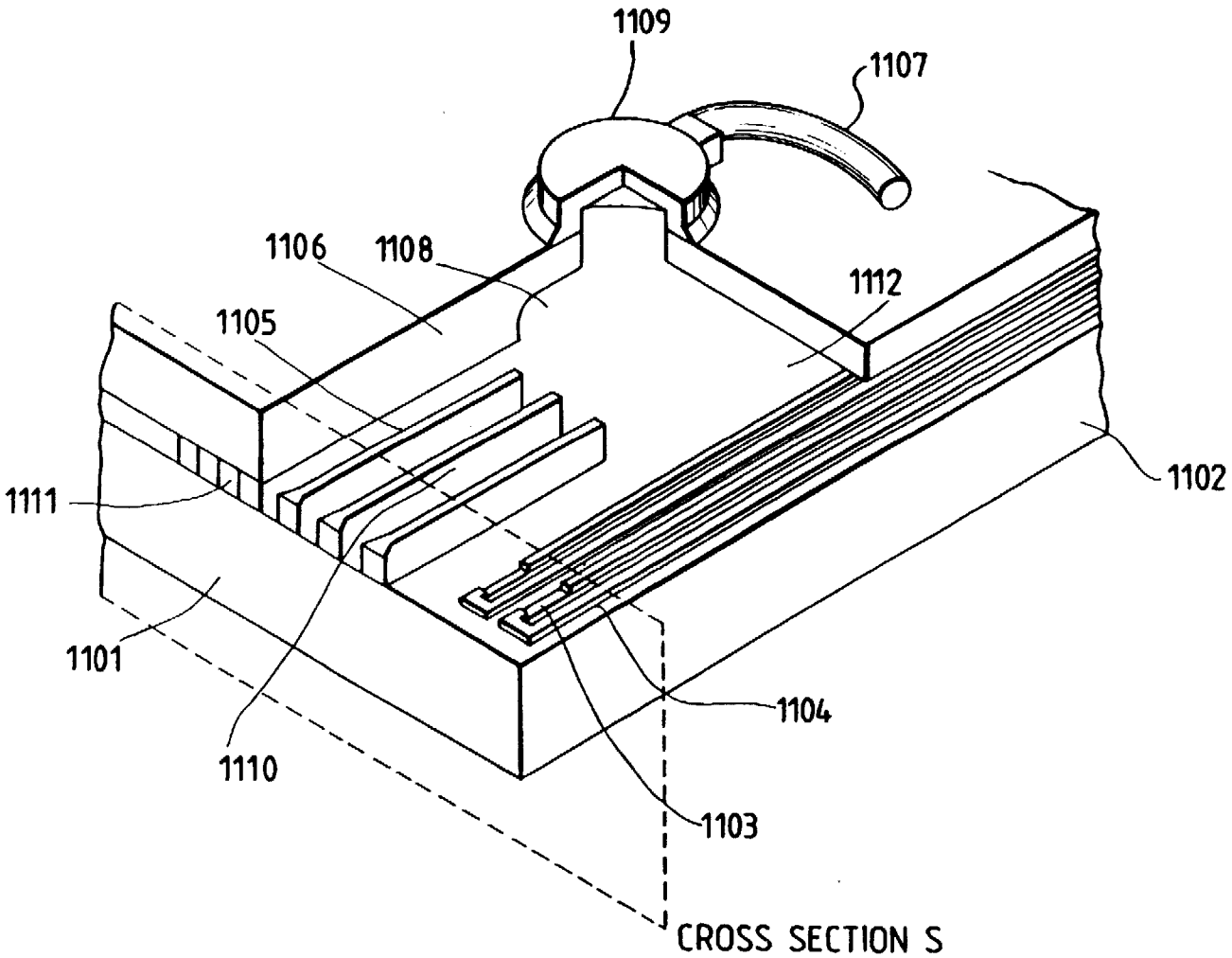
FIG. 1 PRIOR ART
FIG. 1 is a schematic perspective view of a conventional ink jet recording head.
Figure 2:
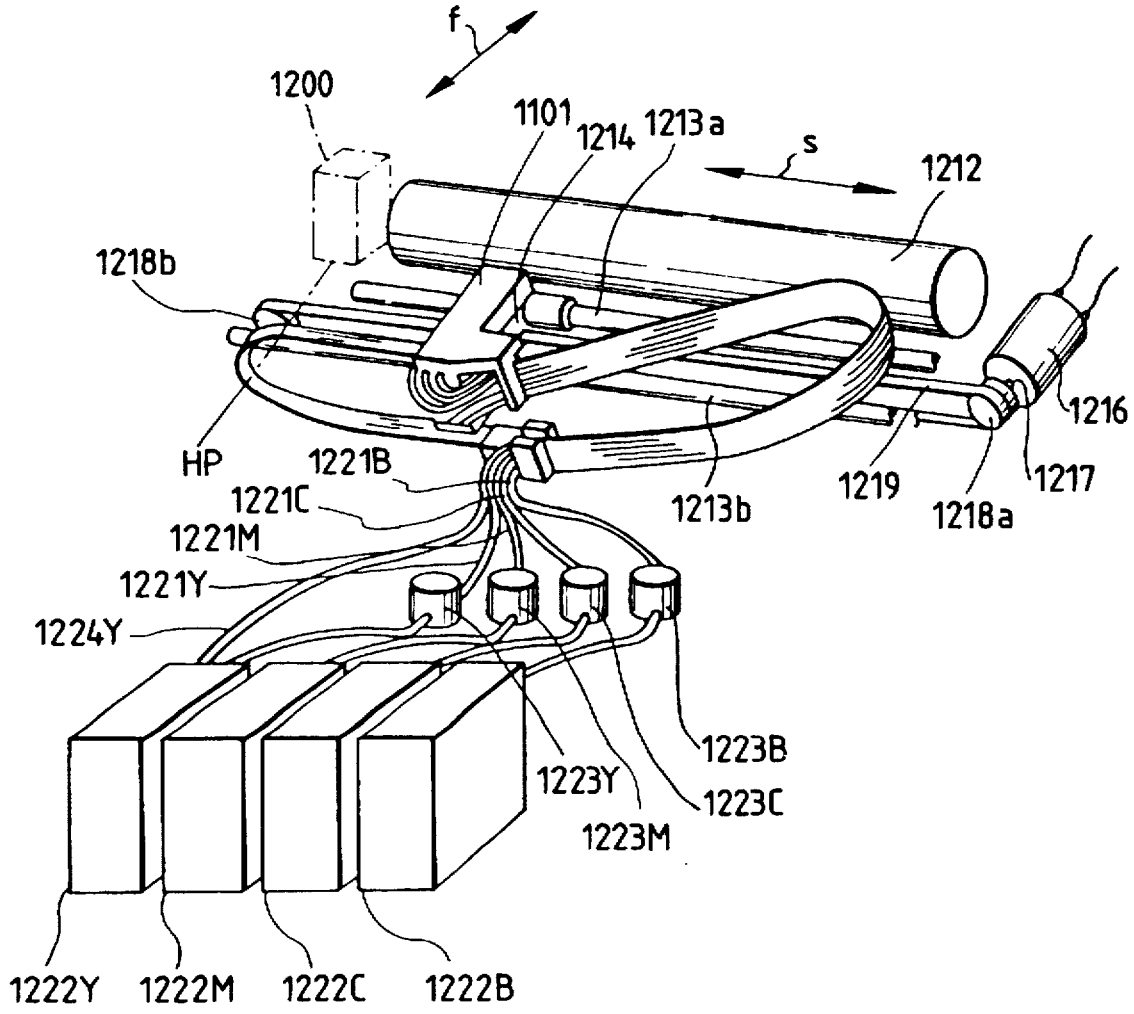
FIG. 2 PRIOR ART
FIG. 2 is a perspective view showing a main part of a conventional ink jet recording apparatus of serial scan type.
Figure 3:
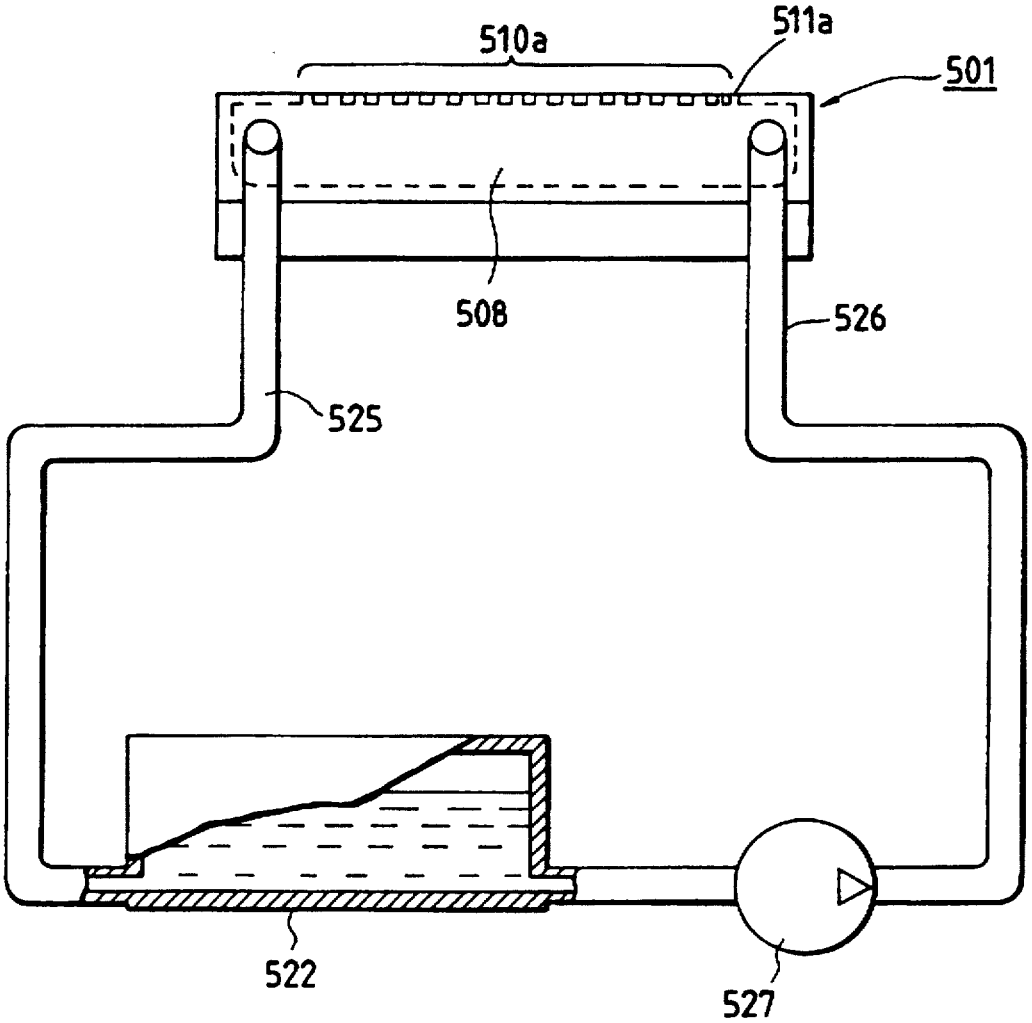
FIG. 3 PRIOR ART
FIG. 3 is a constructional view showing a conventional ink supply system.
Figure 4:
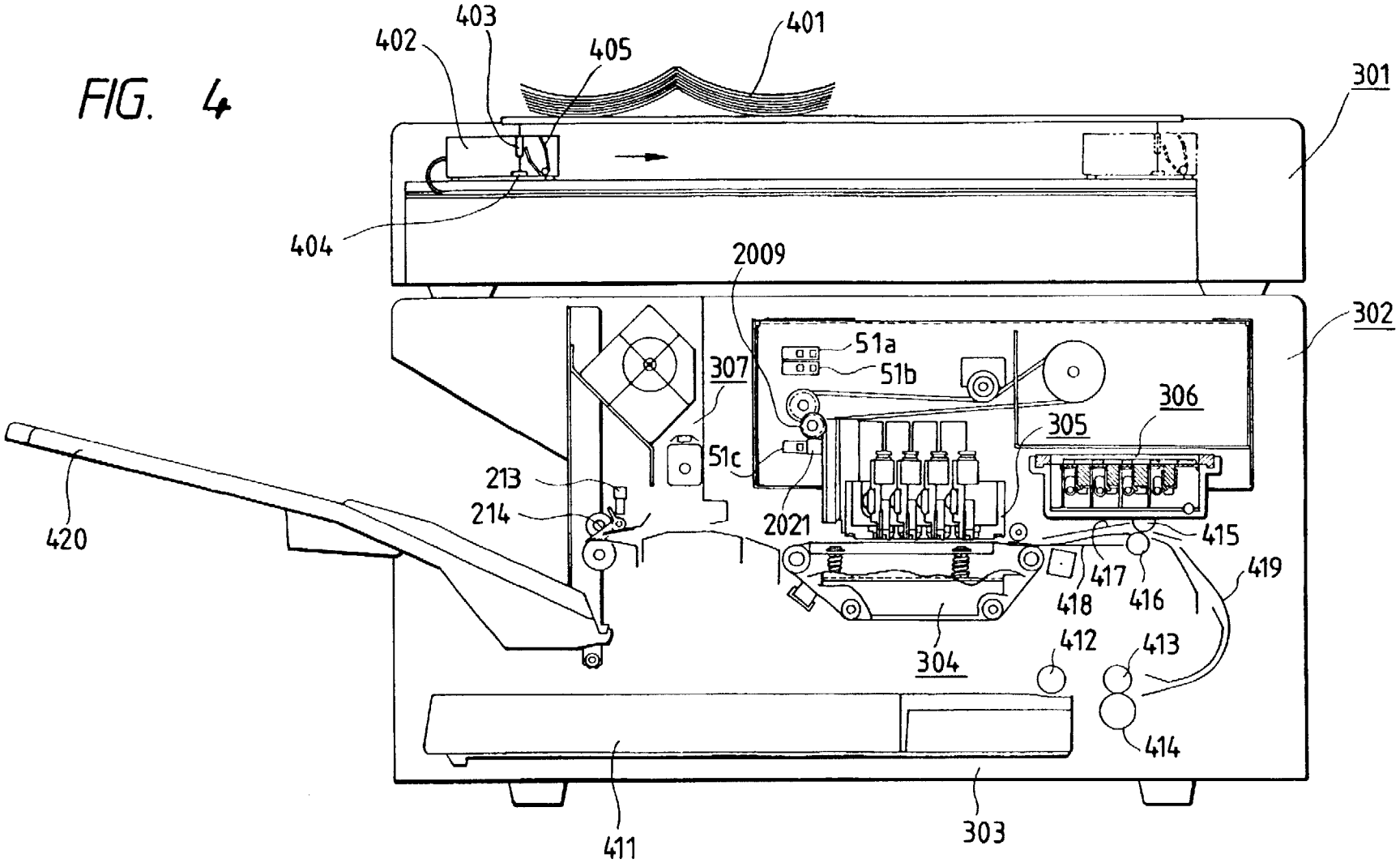
FIG. 4 is a schematic sectional view of an ink jet recording apparatus according to a preferred embodiment of the present invention.

FIG. 4 is a sectional view of an ink jet recording apparatus according to one embodiment of the present invention. First of all, the summary of the ink jet recording apparatus according to the illustrated embodiment will be described with reference to FIG. 4. In FIG. 4, the reference numeral 301 denotes a scanner portion for reading information on an original 401 and for converting the information into an electric signal. A signal based on the electric signal converted in the scanner portion 301 is sent to a recording head portion 305 of a printer portion 302 as a drive signal. In the scanner portion 301, the original 401 is scanned by an original scanning unit 402. The original scanning unit 402 includes a rod array lens 403, a color decomposing line sensor of same magnification type (color image sensor) 404 and an exposure means 405 therein.

When at least the original scanning unit 402 is shifted for scanning in a direction shown by the arrow A to read the image on the original 401, an exposure lamp of the exposure means 405 incorporated in the original scanning unit 402 is energized, and the reflection light reflected from the original is guided by the rod array lens 403 to be gathered onto the color decomposing line sensor of same magnification type (referred to as "reading sensor" hereinafter) 404 for reading the color information, where the color image information of the original is read every color, and the read data are converted into electrical digital signals.

The digital signals are outputted to the printer portion 302. Each recording head for each color receives a drive signal based on the corresponding digital signal and discharges the liquid from its discharge openings.

In FIG. 4, the reference numeral 411 denotes a recording medium cassette; 412 denotes a pick-up roller; 413, 414 denote recording medium conveying rollers; 415, 416 denote registry rollers; 417, 418, 419 denote conveying guides; 420 denotes an ejector tray; 213 denotes a sheet discharge sensor; 241 denotes ejector rollers; 51*a*, 51*b*, 51*c* denote sensors; 2009 denotes rack gears; and 2021 denotes a light-shield plate.

The recording paper (recording medium) contained in a sheet supply portion 303 is supplied one by one to a belt conveying portion 304 as needed. As the recording paper is passing through the belt conveying portion 304, the image is recorded on the recording paper by means of the recording head portion 305, and, thereafter, the recording paper is sent to the tray 420 through a fixing and ejecting portion 307. A recovery cap portion 306 acting as a recovery system serves to maintain a condition so that the recording head portion 305 can always perform the recording operation.

FIG. 4 shows a print permitting condition. In this case, the recovery cap portion (recovery system) 306 is kept at a position upstream of a recording paper feeding direction.

Next, each of the parts of the apparatus will be fully explained.

Figure 5:
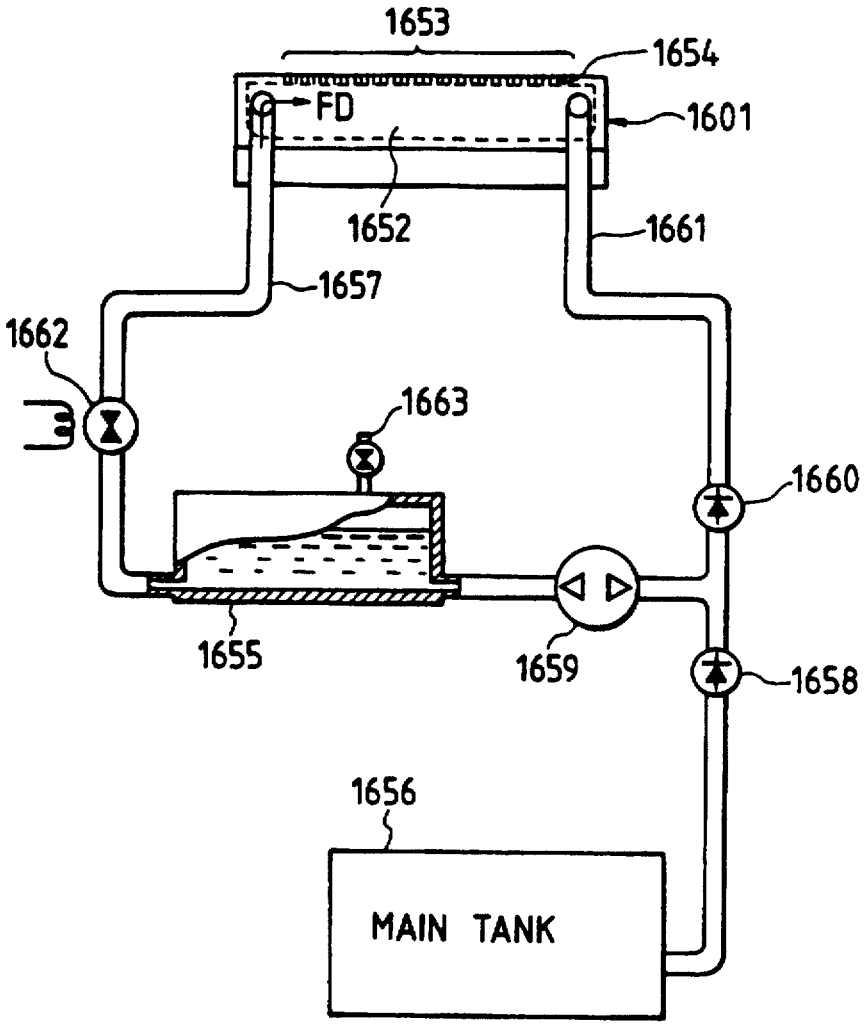
FIG. 5 PRIOR ART
FIG. 5 is a schematic constructional view for explaining an ink supply system of a recording head used with the apparatus of FIG. 4.

First of all, the ink supply to the lengthened recording head of the full-line type used in this embodiment will be described with reference to FIG. 5. FIG. 5 is a constructional view showing the relation between the lengthened recording head and the ink supply system; the reference numeral 1601 denotes the recording head; 1652 denotes a common liquid chamber formed in the recording head 1601; and 1653 denotes liquid discharge openings arranged on a recording liquid discharge surface 1654.

In the illustrated embodiment, the discharge openings 1653 are disposed in correspondence to the whole recordable width of the recording paper to be treated, and, by selectively energizing the heat generating elements disposed in liquid passages (not shown) communicating with the corresponding discharge openings 1653, the recording liquid is discharged from the associated discharge openings, so that the recording can be effected without the scanning movement of the recording head itself.

The reference numeral 1655 denotes a recording liquid supply tank for supplying the liquid to the recording head 1601; and 1656 denotes a main tank for replenishing the recording liquid to the supply tank 1655. Normally, the recording liquid is supplied from the supply tank 1655 to the common liquid chamber 1652 of the recording head 1601 via a supply tube 1657, and, when the replenishment of the liquid is required, the recording liquid is replenished to the supply tank 1655 from the main tank 1656 via a one-way replenishing rectifier valve 1658 by the action of a recovery pump 1659.

The reference numeral 1660 denotes a one-way recovery rectifier valve used in the recovery operation effected for recovering the discharge ability of the recording head 1601; 1661 denotes a circulating tube in which the recovery rectifier valve 1660 is disposed; 1662 denotes a solenoid valve disposed in the supply tube 1657; and 1663 denotes an air vent valve for the supply tank.

In the recording head 1601, the recording liquid supply system and the recovery system constituted as mentioned above, during the recording operation, the solenoid valve 1662 is held in an open condition, whereby the recording liquid is supplied, by its own weight, to the common liquid chamber 1652 from the supply tank 1655 and then is directed from the common liquid chamber 1652 to the discharge openings 1653 via the liquid passages (not shown).

On the other hand, during the recovery operation effected to remove the bubbles remaining in the common liquid chamber 1652 and in the supply system and to cool the recording head 1601, the recovery pump 1659 is activated to forcibly send the recording liquid to the common liquid chamber 1652 via the circulating tube 1661, thus returning the recording liquid from the common liquid chamber 1652 to the supply tank 1655 via the supply tube 1657, whereby the recording liquid is circulated. Further, during the initial liquid filling operation to the liquid passages and the like, the recording liquid is forcible sent to the common liquid chamber 1652 via the circulating tube 1661 by means of the recovery pump 1659 while closing the solenoid valve 1662, thus discharging the recording liquid together with the bubbles from the discharge openings.

Normally, such a recording head is left containing the recording liquid therein when it is not used. By providing a capping means having a cap engageable with the discharge surface of the recording head and by capping the recording head with the cap while the recording operation is stopped, the recording head is sealingly protected from the environmental atmosphere, and at the same time, by filling an air space between the head and the cap with the vapor of ink, the saturated vapor pressure of ink is created in such space, preventing further vaporization of the liquid in the liquid passages, the increase in the viscosity of ink and the drying of ink in the liquid passages.

However, under low humidity condition and/or when the recording operation is stopped for a long time, even if the vaporization of ink in the liquid passages is to be prevented by capping the recording head, the increase in the viscosity of ink sometimes occurs; as a result, it is feared that the non-discharge of ink or unstable discharge of ink from the discharge openings cannot be prevented when the recording operation is started again. In this specification, a problem of whether the ink can be discharged when the recording operation is re-started will be referred to as the "one-shot problem".

Regarding this one-shot problem, as mentioned above, an ink circulating and pressurizing means for discharging the ink from all of the discharge openings of the recording head by forcible circulating and pressurizing the ink under the activation of the recovery pump 1659 is also utilized. Incidentally, if the non-discharge (of ink) condition is slight or not serious, the ink discharge operation same as the normal ink discharge operation for recording the image on the recording paper may be effected by energizing all of the energy generating means of the head. However, this ink discharge operation does not relate to the image formation, it is referred to as "idle discharge" hereinafter in this specification.

As mentioned above, when the ink is solidified in the discharge openings or in the liquid passages due to the drying of ink leading to the increase in the viscosity of ink because of the long non-recording condition, it is possible to recover the recording head to the print permitting condition by forcibly circulating and pressurizing the ink; whereas, when the solidification of ink is slight because of the short non-recording condition, it is also possible to recover the recording head to the print permitting condition by performing the idle discharge operation.

Next, the recording medium which is preferably used with the recording apparatus according to the illustrated embodiment will be explained.

In the ink jet recording process, since the recording liquid called as "ink" is discharged as liquid droplets flying toward the recording medium such as a paper to form the image on the recording medium, it is required that the ink not excessively spread on the recording paper to prevent the formation of a faded image. Further, the recording medium preferably has the features so that the ink adhered to the recording medium can quickly be absorbed by the latter, and particularly the ink flow and ink spread are minimized even when the inks of different colors are adhered at the same position for a short time, and the spread of the printed dot can be suppressed so as not to lose the sharpness of the image.

In some cases, these features cannot be fully obtained when using a copying paper such as plain paper used with an electrophotographic copying machine or recording media used as other standard recording papers. That is to say, when such recording paper is used, in the mono-color printing or two-color superimposed printing, the obtained image quality may be satisfactory to some extent; however, if the amount of ink adhered to the recording paper is increased as in the case where the full-color image is recorded by superimposing three or more ink colors, satisfactory image quality cannot always be obtained.

In the ink jet recording apparatus according to the illustrated embodiment, as the recording paper meeting the requirements of the above-mentioned features, it is preferable to use a recording paper obtained by coating a base paper with the coating material (for example, pulverized silicic acid) satisfying the above-mentioned features, as disclosed in the Japanese Patent Appln. Laid-Open No. 56-148583. In this case, the ink is adhered to the coating layer of the recording paper.

Accordingly, in the illustrated embodiment, in order to obtain an image with higher quality, the coated recording paper is used when the recording is effected with three or more ink colors and the non-coated recording paper (recording paper having no coating layer) is used when the recording is effected with one or two ink colors. However, it should be noted that the coated recording paper can be used when the recording is effected with one or two ink colors.

Figure 6A:
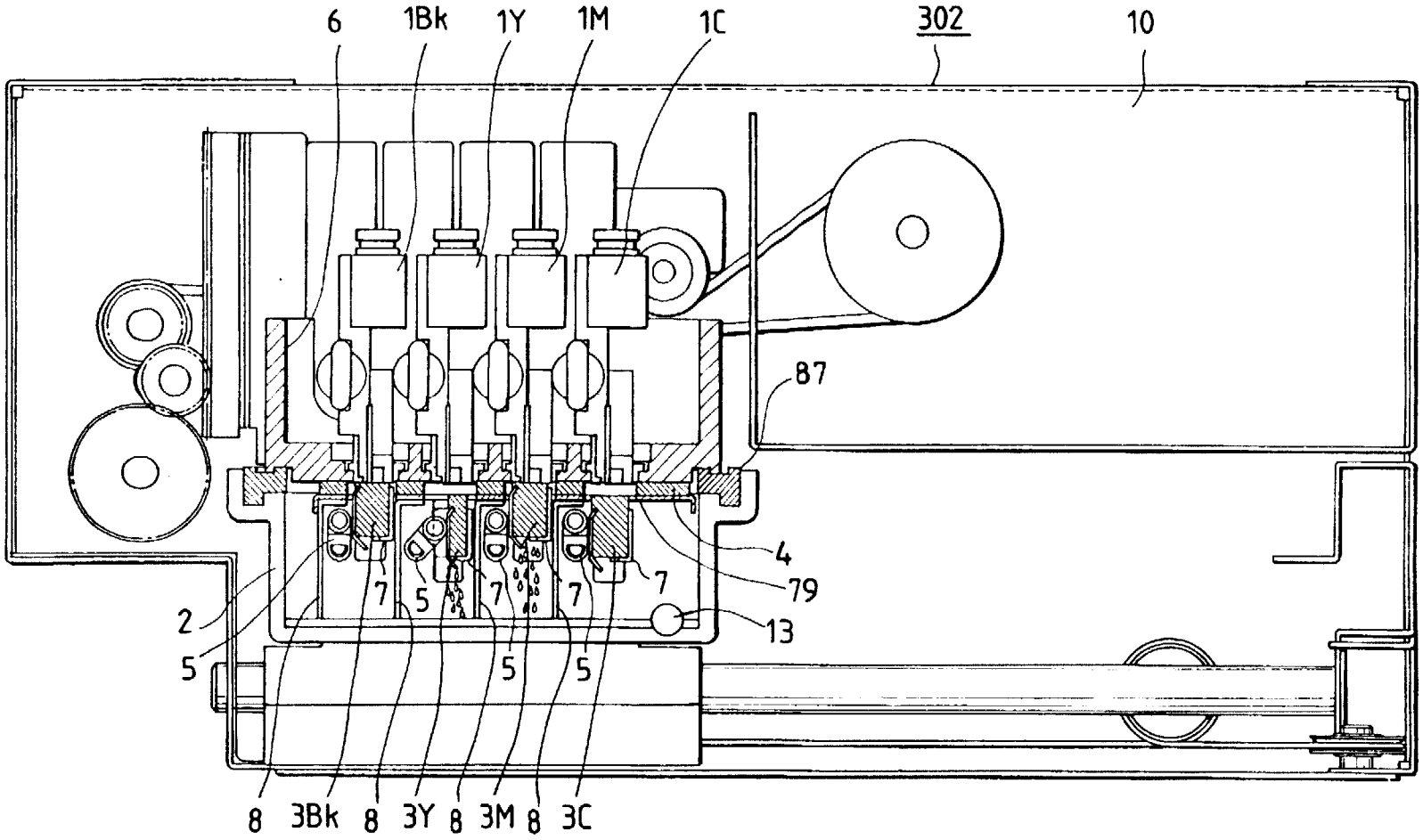
FIGS. 6A and 6B are sectional view of a head recovery system shown in FIG. 4.
Figure 6B:
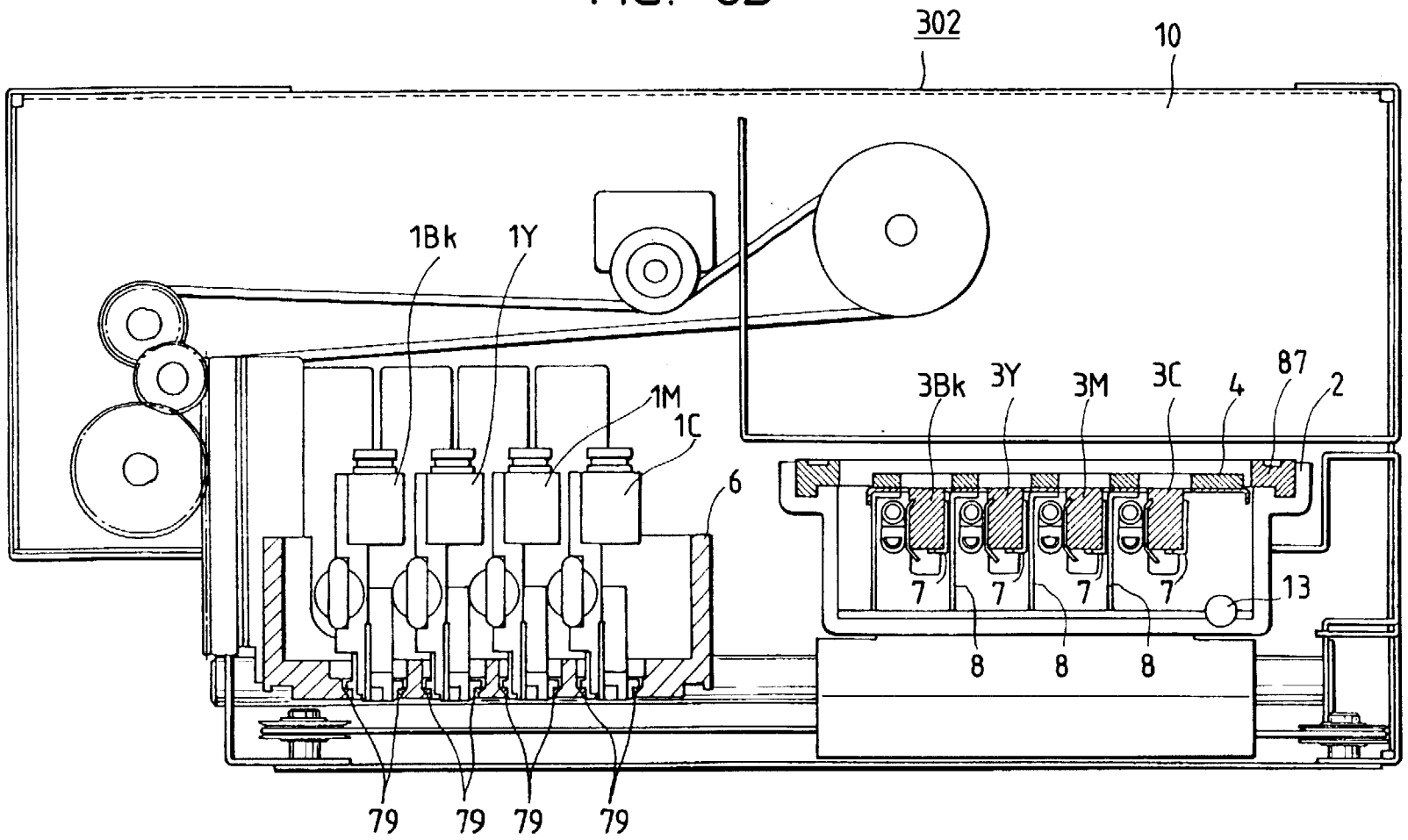

FIGS. 6A and 6B schematically show, in section, a main part of the printer portion of the recording apparatus according to the present invention.

Now, the condition of the recording heads in the recovery operation will be described with reference to FIG. 6A. The reference numerals 1C, 1M, 1Y and 1BK denote ink jet recording heads to which cyan color ink, magenta color ink, yellow color ink and black color ink are supplied, respectively. The recording heads are fixedly attached to a head block 6 with high accuracy, so that the desired parallelism of each head and the desired distance between the heads (head-to-head distance) can be ensured with the satisfactory accuracy.

In the vicinity of the discharge openings of the recording heads 1C, 1M, 1Y, 1BK, ink absorbers 3C, 3M, 3Y, 3BK for absorbing the ink are disposed in correspondence with the associated discharge openings of the heads. The ink absorbers 3C, 3M, 3Y and 3BK are supported by corresponding guides 7 so that they can be moved toward and away from the discharge surfaces of the corresponding recording heads 1C, 1M, 1Y and 1BK.

In FIG. 6A, the ink absorbers 3C and 3Y are shown to be disengaged from the discharge surfaces of the corresponding recording heads 1C and 1Y; whereas, the ink absorbers 3M and 3BK are shown to be engaged with the discharge surfaces of the corresponding recording heads 1M and 1BK.

Partition plates 8 are arranged between the adjacent ink absorbers. Between each partition plate 8 and the head block 6, there is disposed an ink seal 4 which serves to prevent the mixing of the inks of different colors. A packing 87 is disposed between the peripheries of the head block 6 and of a recovery container 2 which contact each other and serves to prevent the interior of the recovery container from drying in the capping condition, thereby preventing the drying of the discharge surfaces of the heads and the solidification of ink.

O-ring seals 79 which are arranged around the recording heads between the latter and the head block 6 serve to prevent the ink adhered to the head surfaces from entering into a head driving circuit.

In the vicinity of the ink absorbers 3C, 3M, 3Y, 3BK, there are disposed corresponding ink squeezing members 5 which can be driven by corresponding levers (not shown) to squeeze the ink absorbed in the ink absorbers 3C, 3M, 3Y and 3BK. FIG. 6A shows a condition that the ink is squeezed from the ink absorber relating to the recording head 1Y regarding the yellow color by the corresponding squeezing member 5. Incidentally, the reference numeral 10 denotes a side plate of the unit.

When the recovery system is shifted by a shifting mechanism (not shown) from the recovery operation condition shown in FIG. 6A to a record or print permitting condition, the recovery container 2 can be moved to a retracted position which will be described later. This retracted position is defined at an upstream side of the recording paper feeding direction (i.e., at the right side in FIG. 6A). A waste ink opening 13 is formed in the bottom of the recovery container 2. The ink discharged from the recording heads 1C, 1M, 1Y, 1BK and absorbed by the ink absorbers 3C, 3M, 3Y, 3BK and then squeezed from the ink absorbers is exhausted from the recovery container 2 through the waste ink opening 13 and is then directed to a waste ink tank (not shown) via a waste ink passage (described later).

FIG. 6B is a schematic sectional view showing a condition that the recording heads are under the recording operation (during the recording). After the recovery container 2 has been shifted from the position of FIG. 6A to the retracted position, i.e., toward the upstream side of the recording paper feeding direction, the recording heads are shifted to a recording position as shown in FIG. 6B. In this condition, the ink is discharged from the corresponding recording head in response to the image (recording) signal, thereby forming the image on the recording paper (recording medium) being conveyed while being spaced apart from the discharge surfaces of the recording heads by a predetermined distance.

Figure 7A:
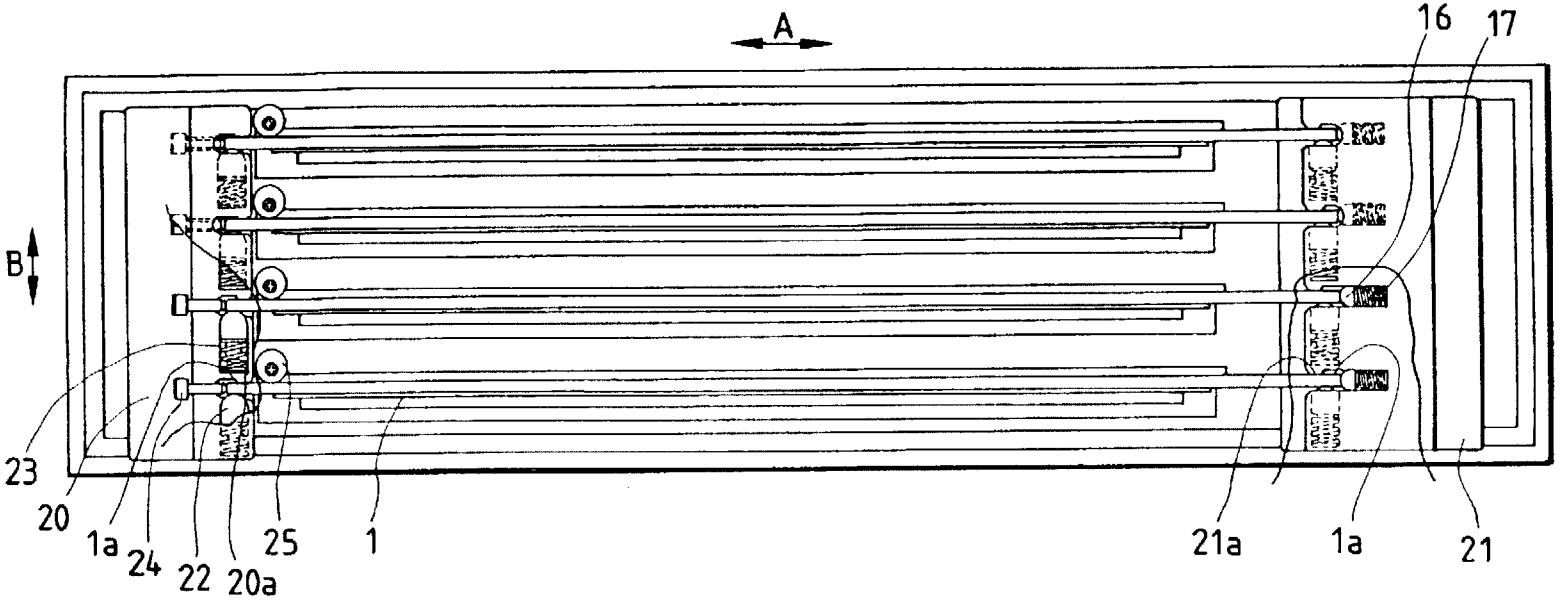
FIGS. 7A and 7B are a schematic plan view and an elevational sectional view for explaining a mechanism for positioning and fixing the recording head.
Figure 7B:
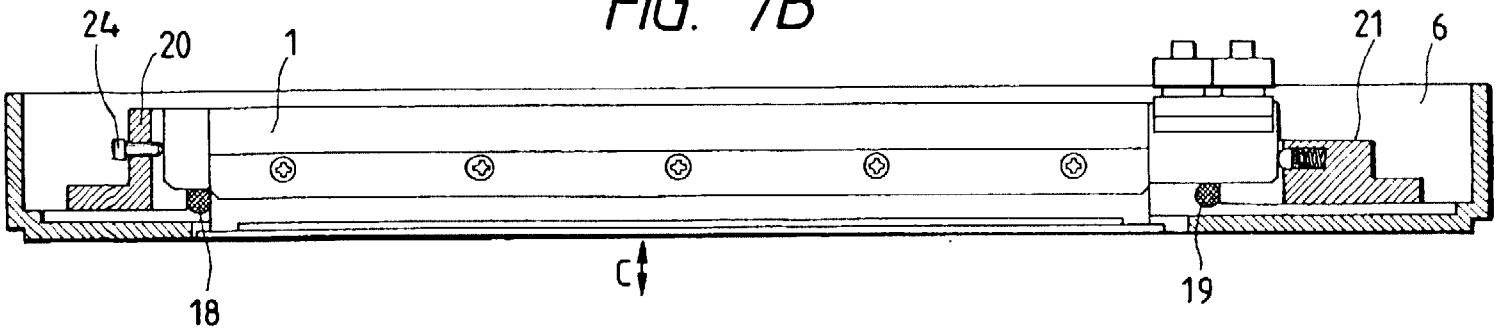

FIGS. 7A and 7B are schematic views for explaining a mechanism for positioning and fixing the recording heads, where FIG. 7A is a schematic plan view and FIG. 7B is a schematic elevational sectional view.

In FIG. 7A, the reference numerals 20, 21 denote head fixing members. By inserting abutment portions 1*a* formed on both ends of each head 1 into corresponding abutment recesses formed in the fixing members 20, 21, respectively, the position of each head in directions shown by the arrows A and B is determined; whereas, the position of each head in an up-and-down direction (direction shown by the arrow C in FIG. 7B) is determined by positioning shafts 18 and 19.

Each head inserted into the head fixing members 20, 21 is positioned and fixed in place by urging the head end portions against abutment portions 20*a* and 21*a* of the fixing members 20, 21 by means of urging pins 22 biased by corresponding springs 23. Adjustment screws 24 are used to adjust the positions of the corresponding heads in the direction A in FIG. 7A, i.e., a direction perpendicular to the recording paper feeding direction (referred to as ("left margin" hereinafter).

The reference numeral 25 denotes eccentric rollers for adjusting the corresponding heads in an inclined direction. In FIG. 7A, by displacing the abutment portion 1*a* of the head by an eccentric amount obtained by rotating the eccentric roller 25, the position of the head can be adjusted in the direction B. Since the eccentric roller is provided for each head, each head can be adjusted independently from the others. In FIG. 7A, the reference numeral 16 denotes abutment positioning members each having a round abutment end which can abut against the head end 1*a*; and 17 denotes bias springs for urging the corresponding positioning members 16 against the head ends 1*a*.

With the adjustment mechanism as mentioned above, it is possible to easily adjust the attachment position of each head. Therefore, it is possible to easily correct the discrepancy of the images recorded with the respective colors, thus permitting image recording with higher quality.

Figure 8A:
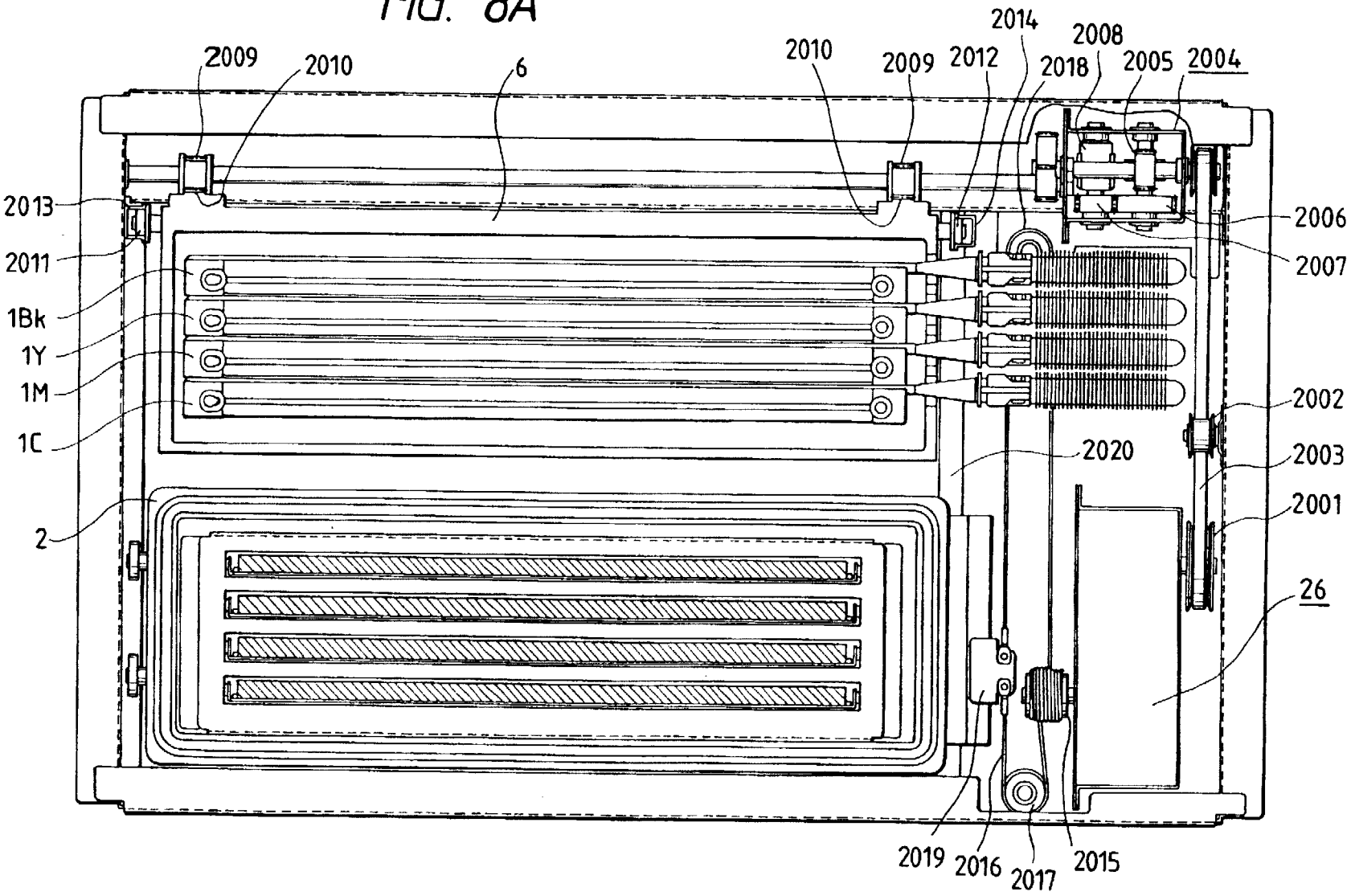
FIGS. 8A and 8B are plan views showing a driving mechanism for the recording head.
Figure 8B:
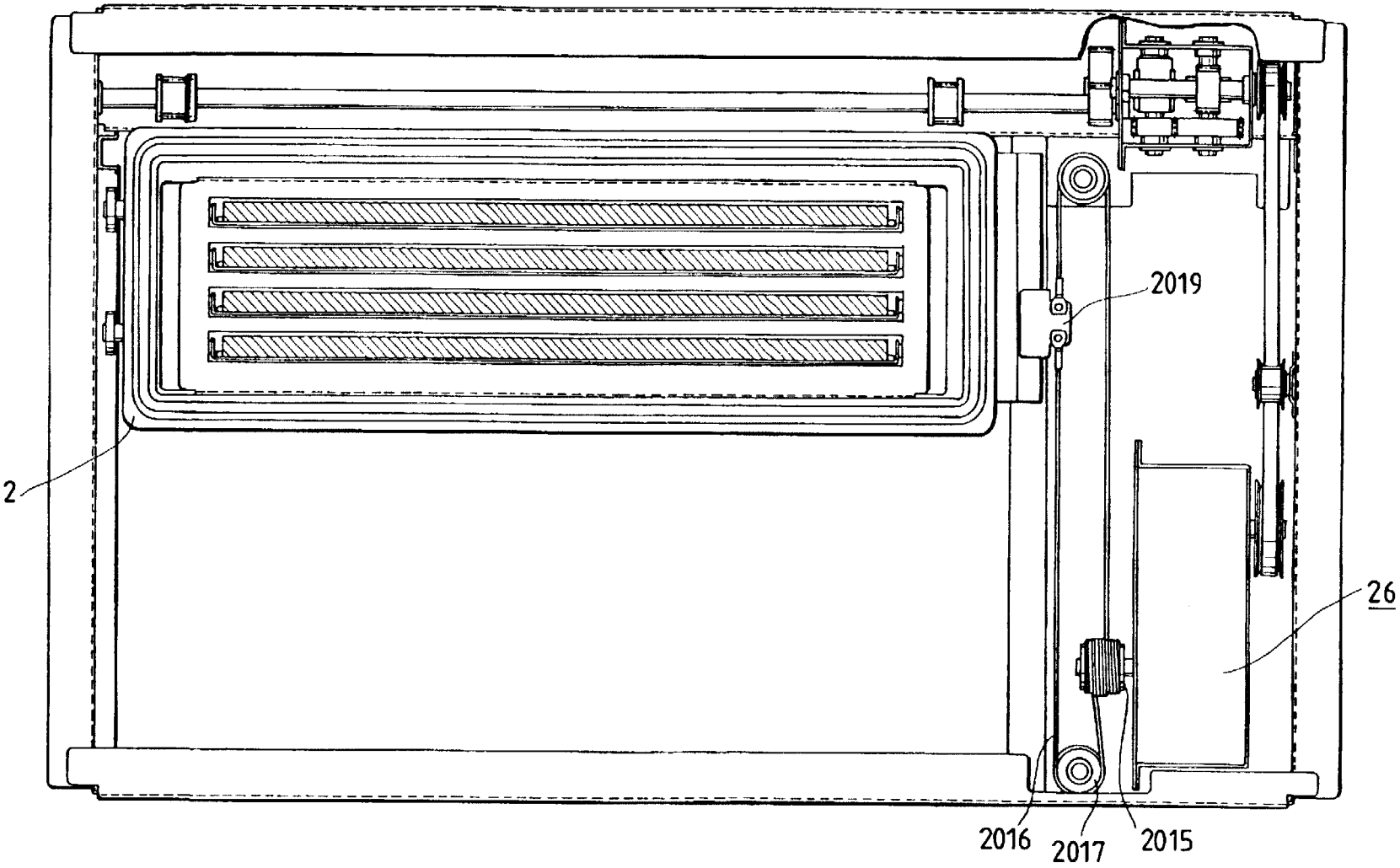
Figure 8E:
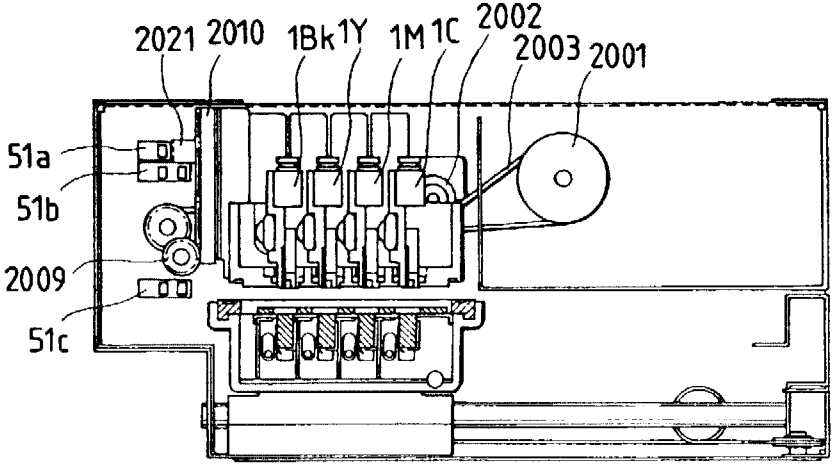
FIGS. 8C, 8D and 8E are sectional views showing the driving mechanism for the recording head.
Figure 8C:
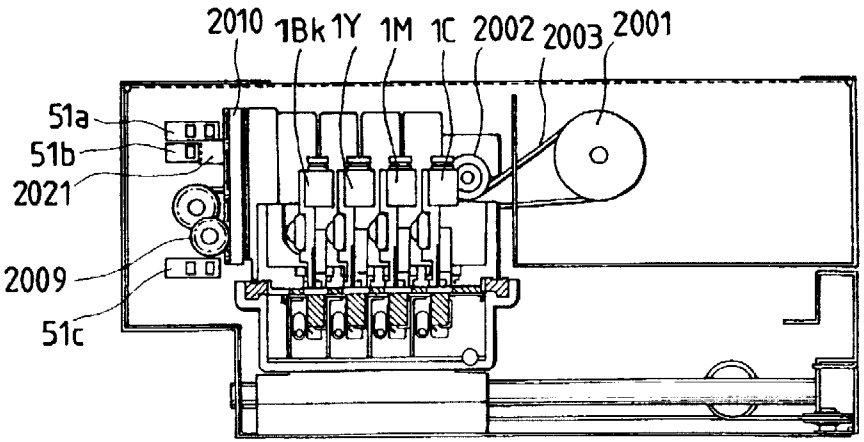
Figure 8D:
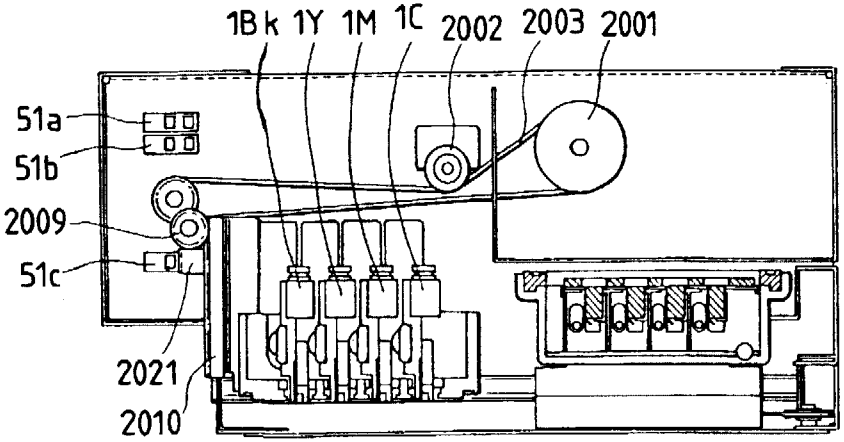

Next, a mechanism for shifting the head portion will be explained with reference to FIGS. 8A to 8E. FIGS. 8A and 8B are plan views of the printer portion looked at from the top of FIGS. 6A and 6B, respectively, and FIGS. 8C to 8E are elevational sectional view of the printer portion.

A driving force obtained from a driving portion 26 for driving a unit of the recovery system is transmitted to a head block driving unit 2004 through belt pulleys 2001, 2002 and a timing belt 2003. The head block driving unit 2004 includes a pair of helical gears 2005 each having a helix angle of 45° for changing the driving direction by 90 degrees, spur gears 2006, 2007 and a worm reduction gear 2008, so that the driving force transmitted to the unit 2004 is eventually transmitted to rack gears 2009 through spur gears. Further, the driving force is transmitted from the rack gears 2009 to racks 2010 formed on the head block 6, thus shifting the head block 6 in a vertical direction.

The head block 6 is provided at its front and rear portions with cams 2011 and 2012, respectively, which are shifted along inner surfaces of head block shifting rails 2013 and 2014, thus shifting the head block in the up-and-down direction, and, accordingly shifting the recording heads in the vertical direction.

In this way, the head block 6 can be shifted only by the driving force from the driving source on the basis of the feature of the worm reduction gear 2008, with the result that the head frame itself is prevented from falling down naturally due to the weight of the plural heads mounted on the head block 6 and the head block 6 can be fixed at a position where it is stopped when the motor is deenergized.

FIGS. 8C to 8E show, in section, a main portion of the head shifting mechanism. The heads can be stopped at the following three positions: that is, (i) head recovery position (capping position), (ii) printing or recording position and (iii) retracted position. FIG. 8C shows (i) the head recovery position (capping position), FIG. 8D shows (ii) the recording position, and FIG. 8E shows (iii) the retarded position. These positions can be correctly detected by the fact that the light-shield plate 2021 formed on the head block 6 shields or blocks detecting portions of the sensors 51*a*, 51*b* and 51*c* arranged in correspondence to the above three positions, respectively.

Next, the drive mechanism for driving the head recovery system will be explained. As shown in FIGS. 7A and 7B, the driving force from the recovery system unit driving portion 26 is also transmitted to a driving wire pulley 2015.

A driving wire 2016 wound around the driving wire pulley 2015 passes around tension pulleys 2017, 2018 and extends up to a wire attachment member 2019 attached to the recovery container 2, to which both ends of the wire are firmly fixed.

A rear portion of the recovery container 2 can be moved on a slide shaft 2020 through slide bearings (not shown), whereas, a front portion of the recovery container is provided with roller 2030 rolling on a rail 2031. Thus, the driving force from the driving portion 26 is converted into the reciprocal movement of the recovery container, thereby shifting the recovery container 2 between the recovery position or capping position and the retracted position.

The recovery container 2 can be stopped at the recovery position shown in FIG. 8B and the retracted position shown in FIG. 8A. These positions can be correctly detected by the fact that a light-shield plate (not shown) attached to the recovery container 2 blocks detecting portions of sensors (photo-interrupters and the like) arranged in correspondence to these positions, respectively.

As mentioned above, in the illustrated embodiment, the retracted position of the recovery container 2 is defined at the upstream side of the recording paper feeding direction. Normally, if jamming of the recording paper occurs during the recording operation, the recording operation is interrupted. In particular, when the recording paper is jammed between the recording heads and the conveying belt, in order to protect the discharge surfaces of the recording heads during the jamming treatment, the recording apparatus is stopped after the capping operation has been performed.

In such a case, the jammed paper is normally situated directly below the discharge surfaces of the recording heads or thereabout. In this case, it is feared that the recovery container 2 shifting for the capping operation traps or pinches the jammed paper or the discharge surfaces of the heads are damaged by the jammed paper. Thus, regarding the jamming of the recording paper between the recording heads and the conveying belt, for example, after the jamming is detected, the conveying belt is still driven for a while until the jammed paper is conveyed at a downstream side of the heads. Thereafter, the capping operation is effected.

In this case, in view of the construction of the recovery system, it is desirable that the retracted position of the recovery container 2 is parallel with the recording paper feeding direction. Thereby, it is possible to prevent trapping of the jammed paper during the shifting of the recovery container to the capping position and the damage of the discharge surfaces of the heads. When the retracted position of the recovery container is defined at the upstream side of the recording paper feeding direction as in the illustrated embodiment, even if the jammed paper remains directly below the recording heads, since the shifting direction (ejecting direction) for the jammed paper is the same as the recording paper feeding direction, during the capping operation under the jamming condition, it is possible to avoid having the jammed paper stuck under the recording heads, the discharge surfaces of the heads damaged, or other troubles, with the result that it is advantageous in the jamming treatment.

Further, as seen from the schematic sectional view of the apparatus shown in FIG. 4, in view of the construction of the apparatus, it is desirable that a fixing or fusing space and an ejecting space (after the recording) are essentially situated behind the recording heads. Also for this reason, in view of the installation, the retracted position of the recovery container during the recording operation is preferably situated at a side opposite to the fixing and ejecting side, i.e., at the upstream side of the recording paper feeding direction, thereby making the whole recording apparatus compact.

Figure 9:
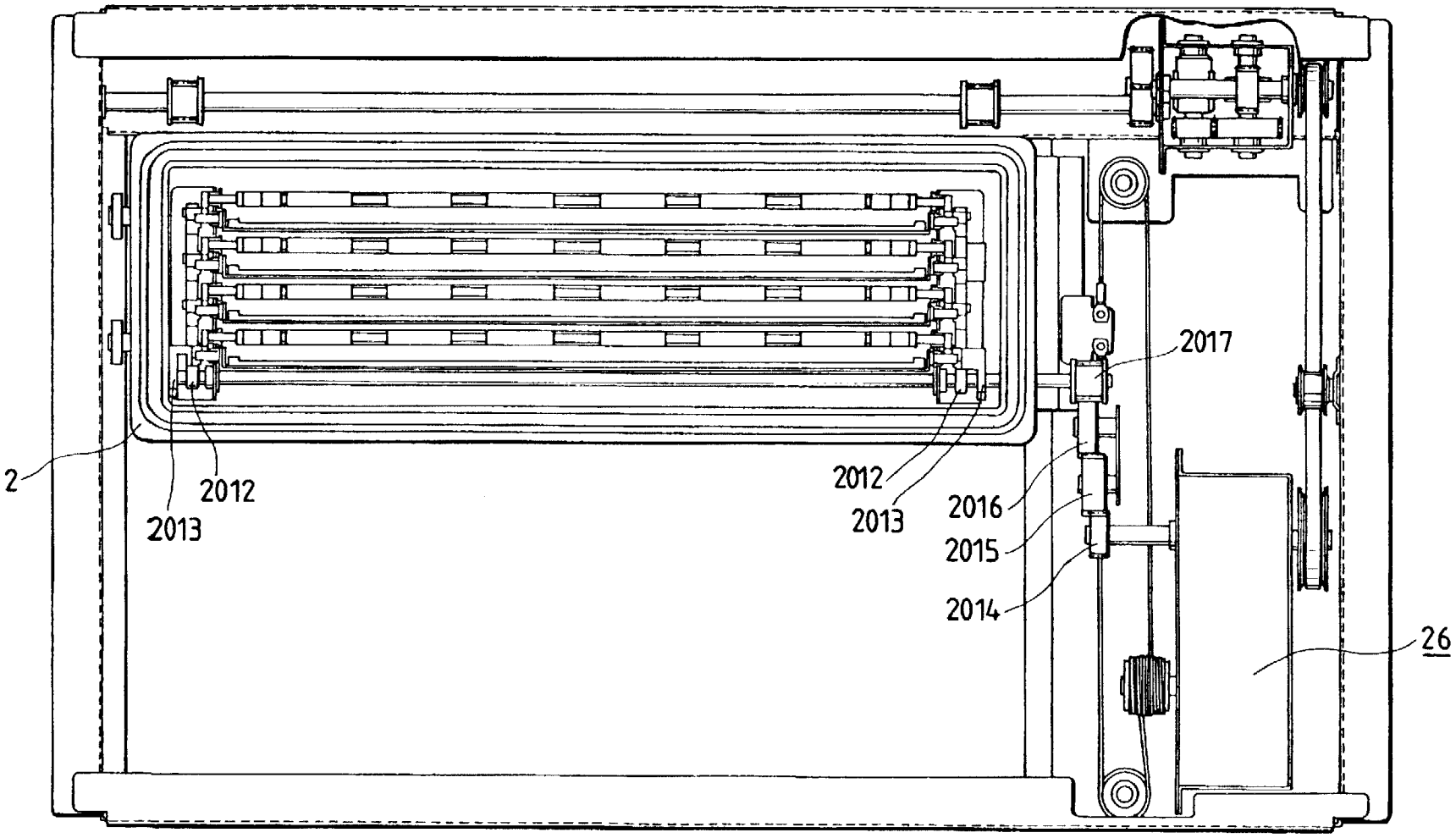
FIGS. 9, 10A and 10B are schematic views for explaining a cap driving mechanism for the head recovery system.
Figure 10A:
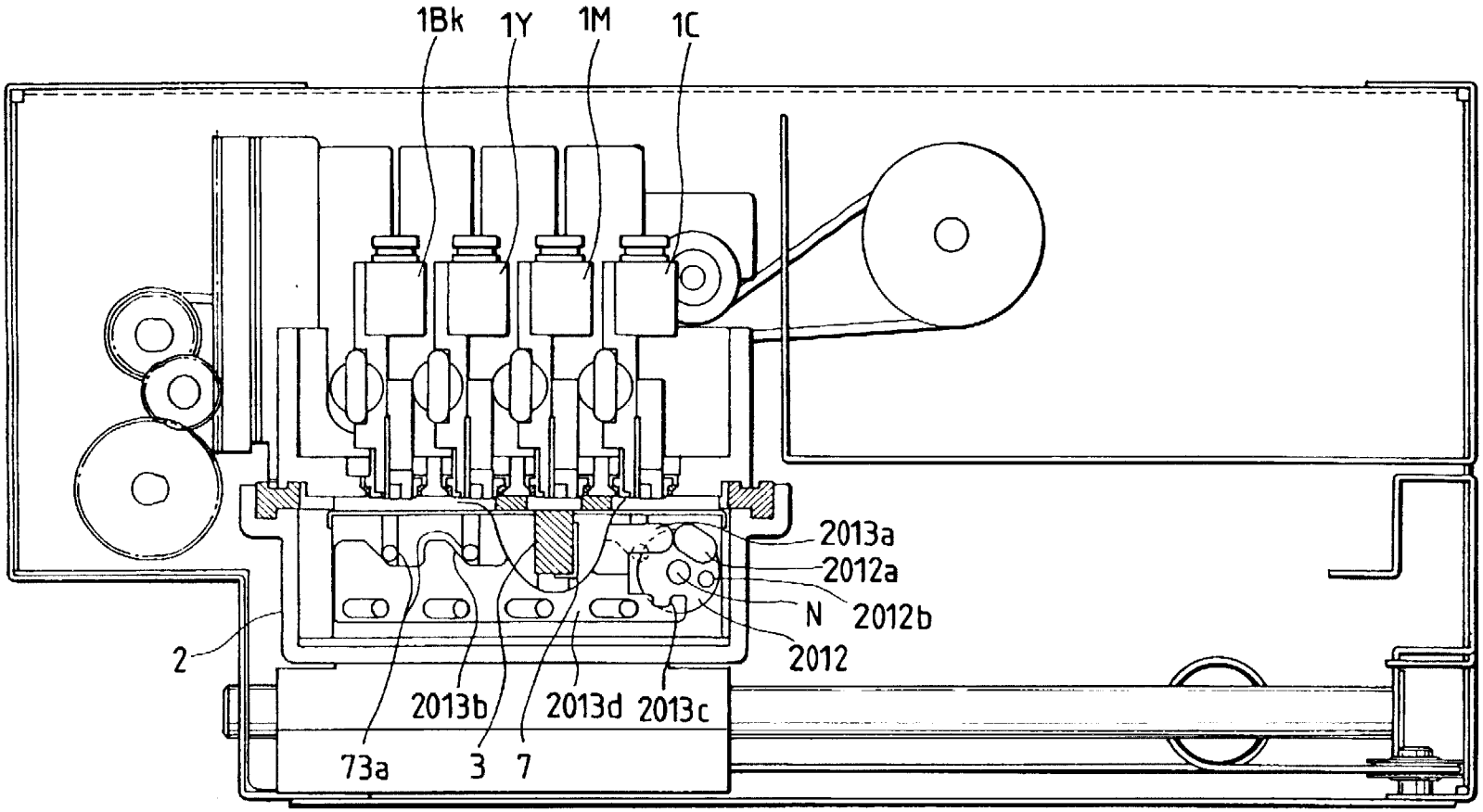
Figure 10B:
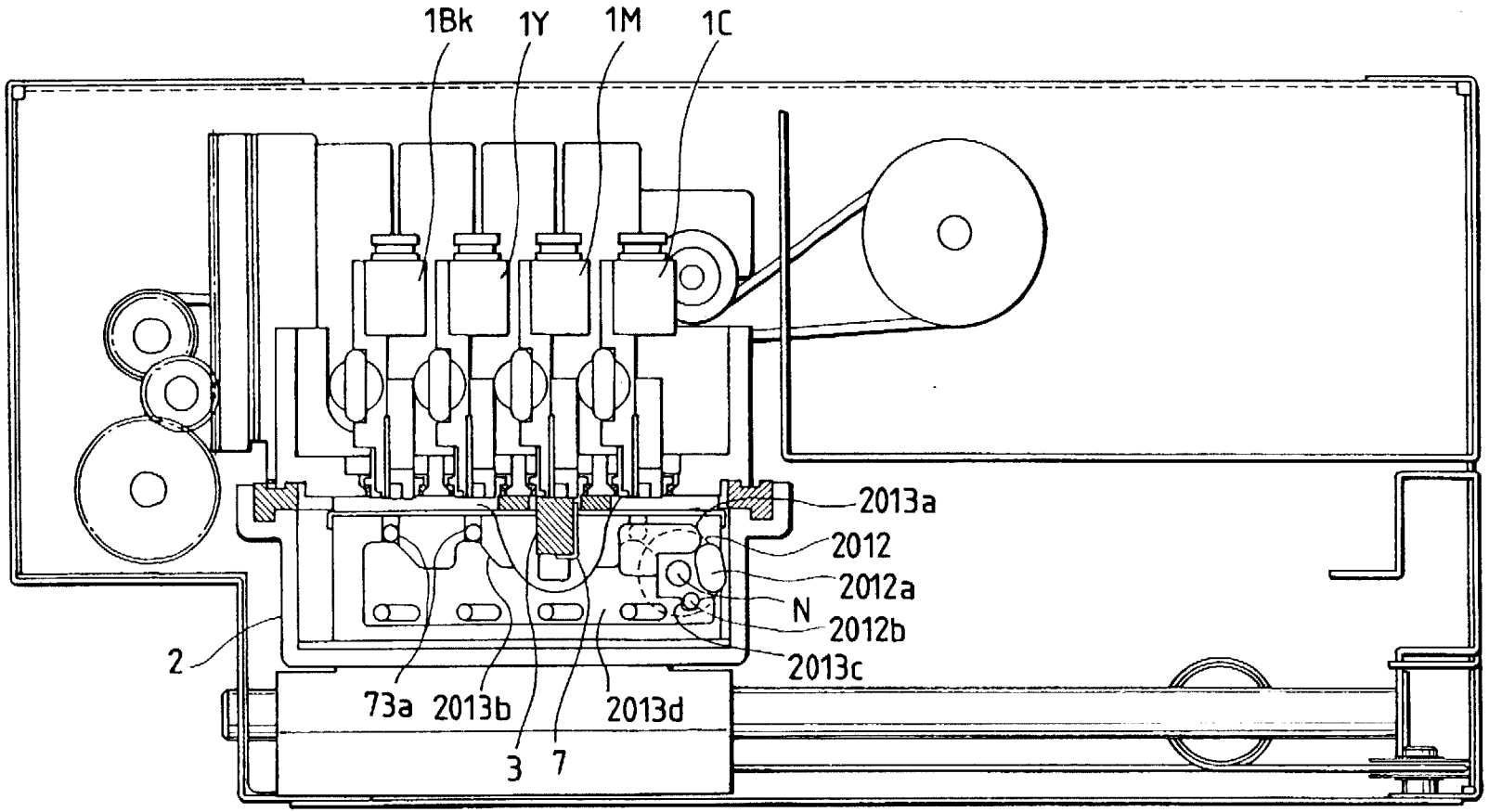

Next, the recovery operation mechanism for performing the capping of the heads by means of the cap, idle discharge, ink pressurizing circulation and the like will be explained. FIG. 9 is a schematic plan view; and FIGS. 10A and 10B are schematic elevational views for explaining the cap driving portion of the recovery system according to the present invention, where FIG. 110A shows a condition that the ink absorbers are disengaged from the discharge surfaces of the heads and FIG. 10B shows a condition that the ink absorbers are engaged by the discharge surfaces of the heads.

The driving force from the recovery system unit driving portion 26 is transmitted to the cam 2012 through the gear train 2014'–2017'. The cam 2012 rotate around an axis N. The cam is provided with projections 2012*a*, 2012*b* through which the rotational motion of the cam is converted into a reciprocal motion of a slide cam 2013*d* connected thereto.

These cams 2012, 2013 are arranged symmetrically at the front and rear portions of the recovery container 2. The slide cam 2013*d* is provided with a protruding portion 2013*a* which is engaged by the projection 2012*a* of the cam 2012, a cap sliding portion 2013*b* and a recess 2013*c*. The reciprocal movement of the slide cam 2013*d* given by the cam 2012 is converted into up-and-down motion of the absorber guides 7 through the sliding portion 2013*b*.

Each ink absorber guided by the corresponding absorber guide 7 is held by absorber stoppers so that it can be moved in the up-and-down direction along guide portions 73*a* formed on the front and rear ends thereof. With this arrangement, the driving force from the driving portion can be transmitted as the driving force for engaging and disengaging the ink absorbers 3 with respect to the discharge surfaces of the heads 1. Further, such engagement and disengagement can be ascertained by detecting the position of the ink absorbers by means of a sensor (not shown) arranged on the recovery container 2.

Figure 11A:
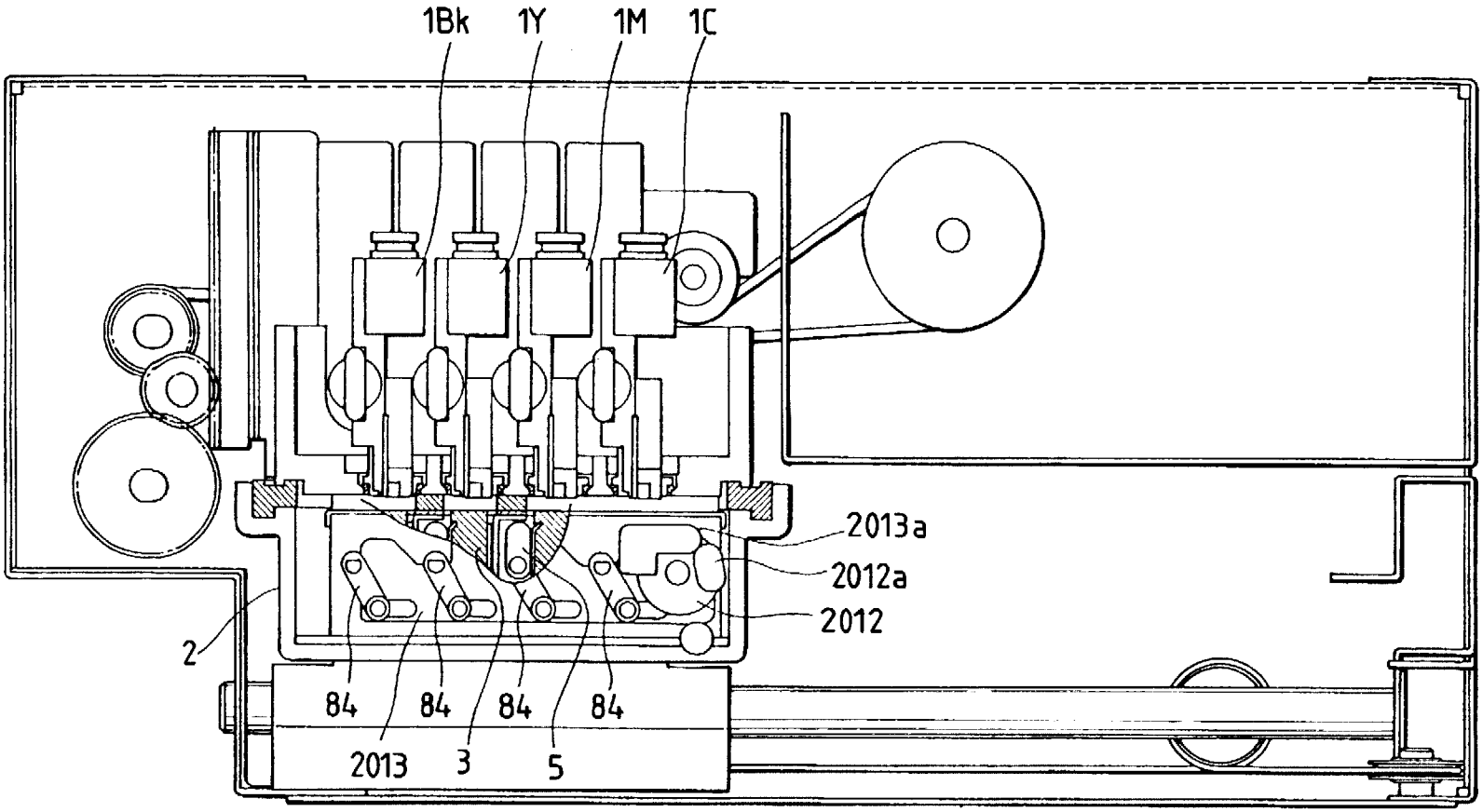
Figs. 11A and 11B are partial sectional views showing an ink absorber squeezing drive mechanism of the head recovery system.
Figure 11B:
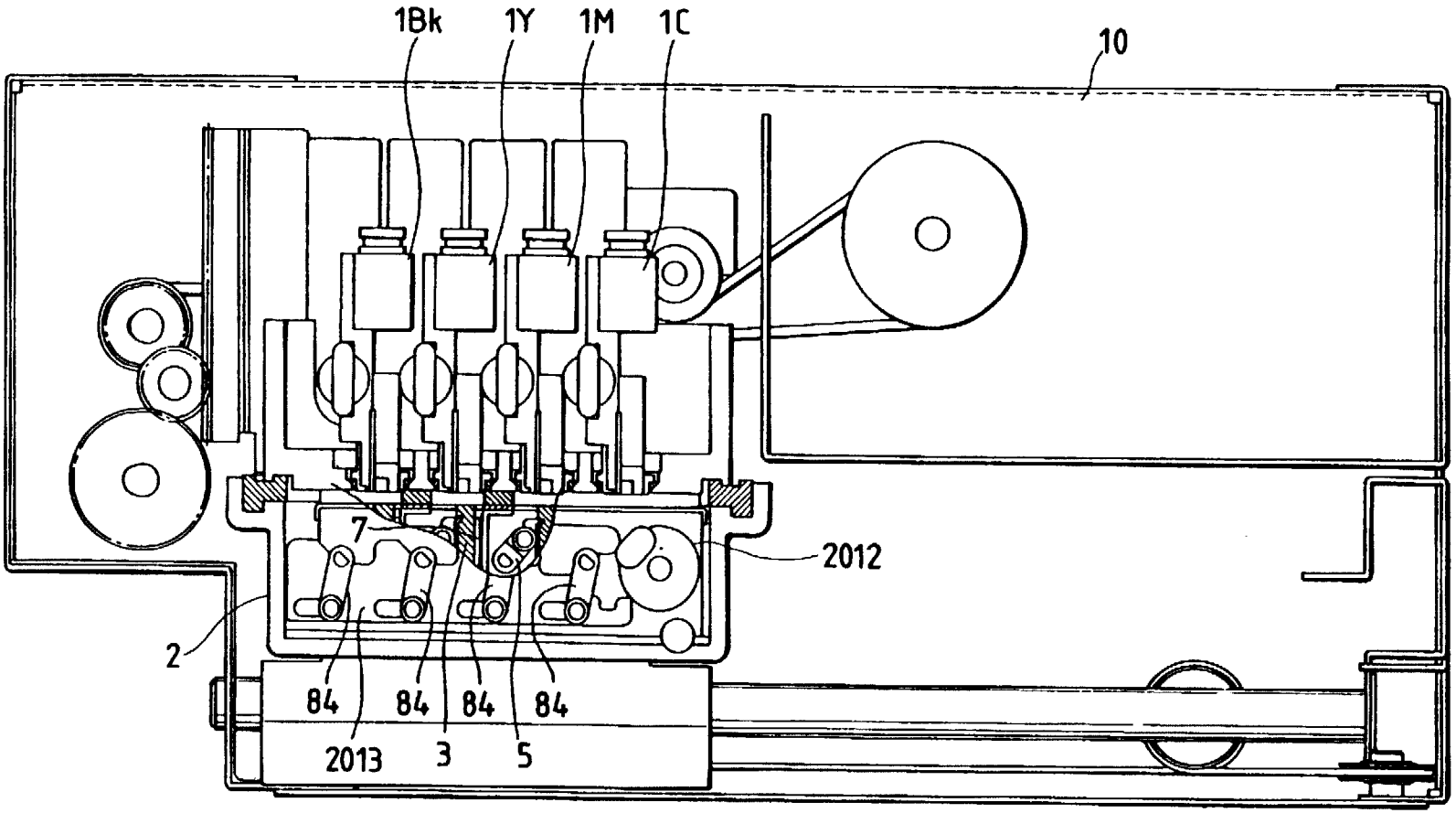

Next, the squeezing mechanism for the ink absorbers in the recovery cap portion will be described. FIGS. 11A and 11B are schematic explanatory views for explaining the ink absorber squeezing mechanism of the recovery system, where Fig. 11A shows a condition that the squeezing mechanism is in a non-operative position (waiting position) and Fig. 11B shows a condition that the squeezing mechanism is in an operative position.

In the illustrated embodiment, the driving of the cap relates to the squeezing of the ink absorbers so that they are effected by the same driving system. That is to say, as mentioned above, the driving force from the driving portion is transmitted to the cam 2012 and then is converted into the reciprocal motion of the slide cam 2013*d*. The reciprocal movement of the slide cam 2013*d* is further transmitted to the ink absorber squeezing members 5 through levers 84, so that the ink absorbers 3 are urged against the absorber guides 7 to be deformed, with the result that the ink absorbed in the ink absorbers is squeezed out of the latter and is gathered on the bottom of the recovery container (Fig. 11B). The squeezing members 5 for the respective ink colors are simultaneously driven.

In the recording apparatus according to the illustrated embodiment, the above-mentioned cap lifting and lowering mechanism, i.e., the absorber lifting and lowering mechanism and the absorber squeezing mechanism are driven by the same driving system in synchronism with each other as the continuous recovery operation. More particularly, first of all, when the driving is started from a condition that the ink absorbers are disengaged from the discharge surfaces of the heads as shown in FIG. 10A, the rotation of the cam 2012 causes the cam projection 2012*b* to enter into the recess 2013*c* of the slide cam, thus shifting the slide cam 2013*d*, with the result that the ink absorbers 3 are urged against the corresponding discharge surfaces of the heads reaching the absorber engagement condition as shown in Fig. 10B. In this case, the ink absorbers are still in the waiting condition, i.e., the absorbers are not yet squeezed. As the cam 2012 continues to rotate, the cam projection 2012*a* pushes the protruding portion 2013*a* of the slide cam to slide or shift the slide cam to the left (Fig. 10B), thus disengaging the ink absorbers from the head discharge surfaces again along the sliding portion 2013*b*.

This condition is the waiting condition shown in Fig. 11A. As the cam 2012 continues to rotate, the slide cam 2013*d* is further shifted to the left. In response to the shifting of the slide cam 2013*d*, the ink absorbers are gradually compressed or deformed by the corresponding squeezing members, thus squeezing the ink from the ink absorbers. This condition is the operative condition, i.e., the squeezing condition shown in Fig. 11B. As the cam 2012 continues to rotate, the slide cam 2013*d* is returned to the right by the restoring force of the ink absorbers to re-establish the condition shown in FIG. 11A, thus completing the continuous recovery operation.

In the recording apparatus according to the illustrated embodiment, normally, such continuous operation during one revolution of the cam 2012 is regarded as one operation. By such continuous operation, the cleaning of the head discharge surfaces and the restoring of the absorbing ability of the ink absorbers are effected.

The above-mentioned recovery system according to the illustrated embodiment is constituted as a unit by incorporating the head portion for effecting the discharging of ink, head holding portion for positioning and fixing the heads, head driving portion for shifting the head portion between the recording position and the recovery position, recovery mechanism for providing the stable ink discharge of the heads and recovery system driving portion for driving the recovery mechanism into the unit side plate 10 as acting as a casing, as shown in FIG. 6A. Further, such an integrated unit (recovery unit) is positioned with respect to a frame of the apparatus by fitting recesses (notches) formed in the side plates 10 onto positioning shafts formed on the frame of the apparatus. Incidentally, these notches and positioning shafts correspond to notches 3010*a*, 3010*b* and positioning shafts 3014*a*, 3014*b* shown in FIG. 19 which will be described later.

In this way, since the recovery unit is constituted as the unit in the printer portion, the above-mentioned operation can be effected as a unit level. Further, in the actual recording operation, as shown in FIG. 6A, the head block 6 is positioned with respect to the platen so as to maintain a gap between the conveying belt 101 and the head discharge surfaces, as will be described later.

Thus, by supporting all of the mechanisms (heads, cap, recovery elements and the like) regarding the recovery and recording operation by means of the single casing and by designing these mechanisms to be positioned and detachably mounted on the recording apparatus, it is possible to perform all of the operations from the recording apparatus side by supplying the electric power, image signal and ink.

Next, the recovery operation by means of the recovery system will be explained.

Conveniently, the recovery operation will be described in terms of the following three operations: (a) capping operation, (b) idle discharge operation and (c) ink exhausting operation.

Figure 12:
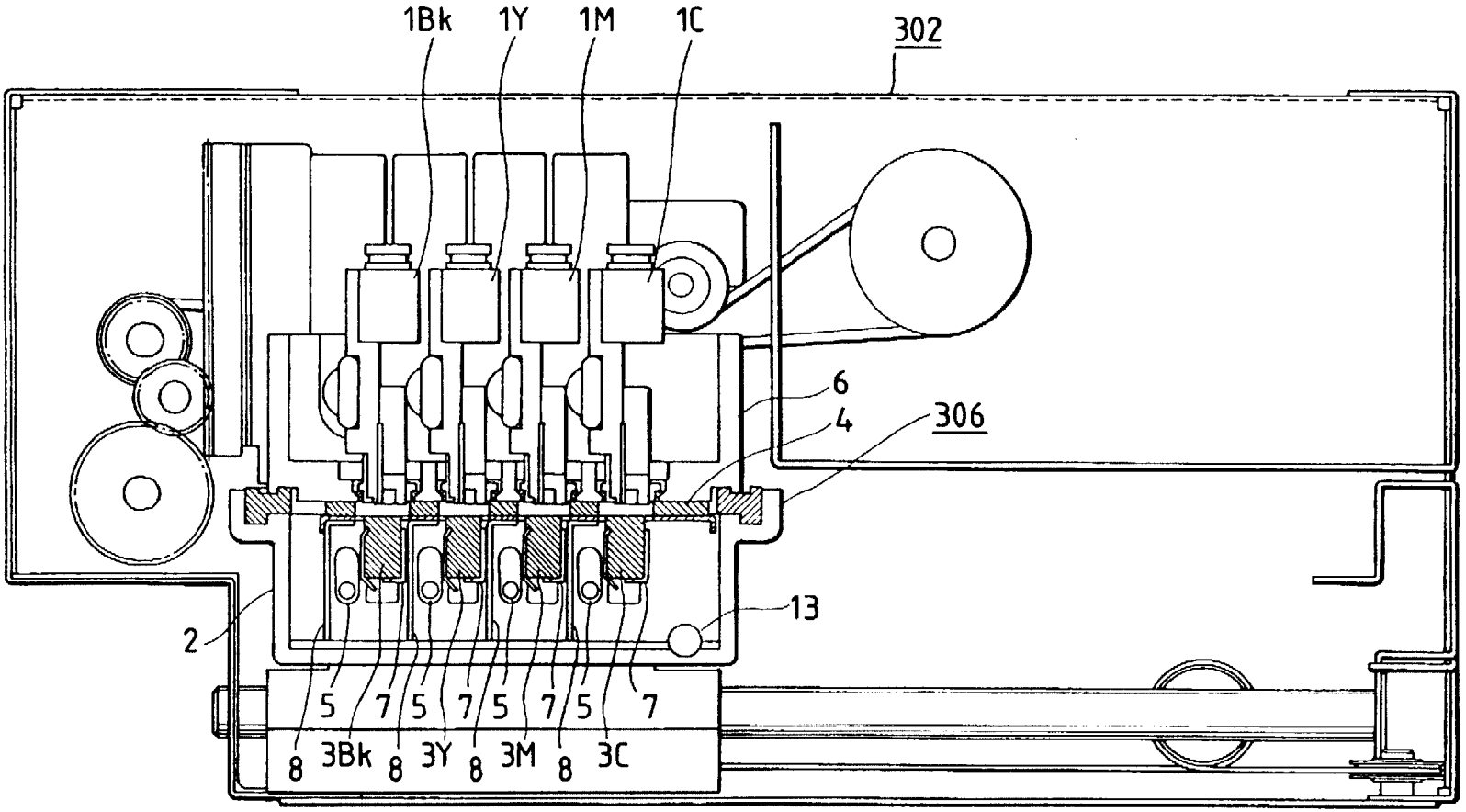
FIG. 12 is a sectional view showing a recording head capping condition.

First of all, the capping operation (c) will be explained. FIG. 12 is a schematic view showing a condition that the recording heads are capped. In FIG. 12, the recording heads 1C, 1M, 1Y and 1BK arranged side by side in the head block 6 are engaged by the recovery cap portion 306 acting as the discharge recovery means.

As mentioned above, the ink seals 4, partition plates 8 and ink absorbers 3C, 3M, 3Y, 3BK are disposed in the recovery container 2, and the ink absorbers are normally spaced apart from the head discharge surfaces by a predetermined distance. Thereby, the discharge openings (and thereabout) of the recording heads 1C, 1M, 1Y, 1BK are encircled by the ink seals 4, partition plates 8 and ink absorbers 3C, 3M, 3Y, 3BK to maintain the discharge openings under an appropriate wet condition, thus preventing the drying of the head discharge openings. In this way, in the non-operative condition and stand-by condition of the recording heads, by capping the recording heads, the non-discharge of ink is prevented, the discharge openings are protected, and the adhesion of dirt and the like on the discharge openings is also prevented.

Figure 13:
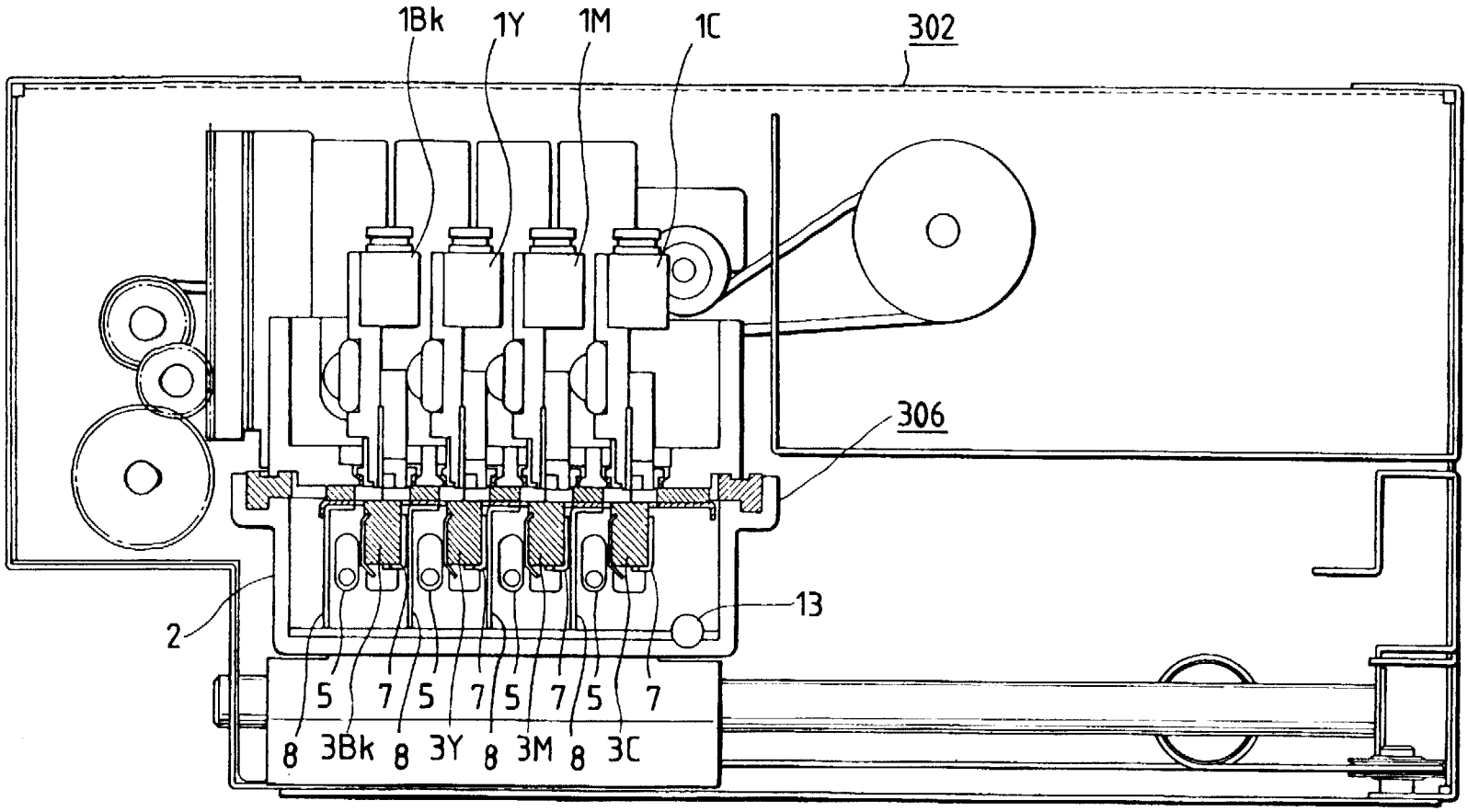
FIG. 13 is a sectional view showing an idle discharge condition of the recording head.

Then, the idle discharge operation (b) will be explained. FIG. 13 is a schematic view showing the idle discharge condition. Similar to the above-mentioned capping operation, the ink absorbers 3C, 3M, 3Y and 3BK are spaced apart from the discharge surfaces of the recording heads. In this case, a desired number of ink discharging pulses are applied to all of the discharge energy generating means of all of the recording heads 1C, 1M, 1Y and 1BK. In this way, regarding all of the discharge openings, it is possible to prevent the non-discharge of ink due to the solidification of ink, and the poor discharge of ink and the distortion of image due to the change in the viscosity of ink. Normally, the idle discharge operation is effected at the initiation of the recording operation or at predetermined time periods.

Next, the ink exhausting operation (c) will be explained. FIGS. 14A to 14D are schematic views showing the operation of the recovery cap portion 306 performing the ink pressurization and circulation operation in the ink supply system for the ink exhaustion. The operation in the recovery cap portion 306 includes the following four cycles: (i) a normal capping cycle, (ii) an ink pressurization circulation cycle, (iii) an absorber squeezing and cleaning cycle, and (iv) an absorber abutting cycle. FIGS. 14A to 14D show these cycles (i) to (iv), respectively.

First of all, the capping cycle (i) corresponds to the above-mentioned capping operation (a) wherein the normal stand-by condition or non-operative condition is established. In this condition, when the ink pressurization circulation mode is selected, for example, by an operator or command from a host computer, the recovery cap portion is changed from this condition to the condition shown in FIG. 14B. In this new condition, the ink absorbers 3C, 3M, 3Y and 3BK being previously spaced apart from the head discharge surfaces are now abutted against the corresponding recording head 1C, 1M, 1Y and 1BK, respectively.

Accordingly, in this condition, the ink absorbers are engaged by the corresponding discharge surfaces of the heads. In such engagement condition, by activating ink supply pumps (not shown), the pressure in the ink supplied to the recording heads 1C, 1M, 1Y and 1BK is increased. Consequently, the inks are circulated in the respective ink supply systems through the respective heads to remove the bubbles from the heads, and the pressurized inks are also exhausted from the respective discharge openings.

Thus, the dirt and the like adhered to the discharge surfaces is also removed together with the waste ink, thereby cleaning the discharge openings and thereabout. The waste ink discharged from the discharge openings is absorbed by the ink absorbers 3 (3C, 3M, 3Y, 3BK) abutted against the discharge surfaces without leaking to other portions, as mentioned above. When the ink amount absorbed in each ink absorber exceeds the maximum absorbing capacity of the ink absorber, the excess ink flow down from the ink absorber by its own weight onto the bottom of the recovery container 2, and is then directed to the waste ink tank (not shown) through the waste ink opening 13. Preferably, the ink pressurization circulation time, i.e., the ink supply pump activation time is normally on the order of 0.5 second to several seconds, in consideration of the effective removal of the solidified ink and the bubbles.

Next, the absorber squeezing and cleaning cycle (iii) shown in FIG. 14C will be explained. When the ink pressurization circulation cycle shown in FIG. 14B is finished, the ink absorbers 3 abutted against the head discharge surfaces are again separated from the corresponding recording heads. In such a disengaged condition, the ink saturating the ink absorbers is squeezed from the ink absorbers by means of the squeezing members 5.

The squeezed ink is, by its own weight transferred to the absorber guides 7 and hence to the partition plates 8, and then flows down from the partition plates onto the bottom of the recovery container 2, and is then directed to the waste ink tank (not shown) through the waste ink opening 13.

That is to say, at the same time when the ink absorbers 3 are separated from the corresponding head discharge surfaces, the excess ink in the ink absorbers is squeezed out together with the residual foreign matters which have been adhered to the head discharge surfaces.

Figure 15A:
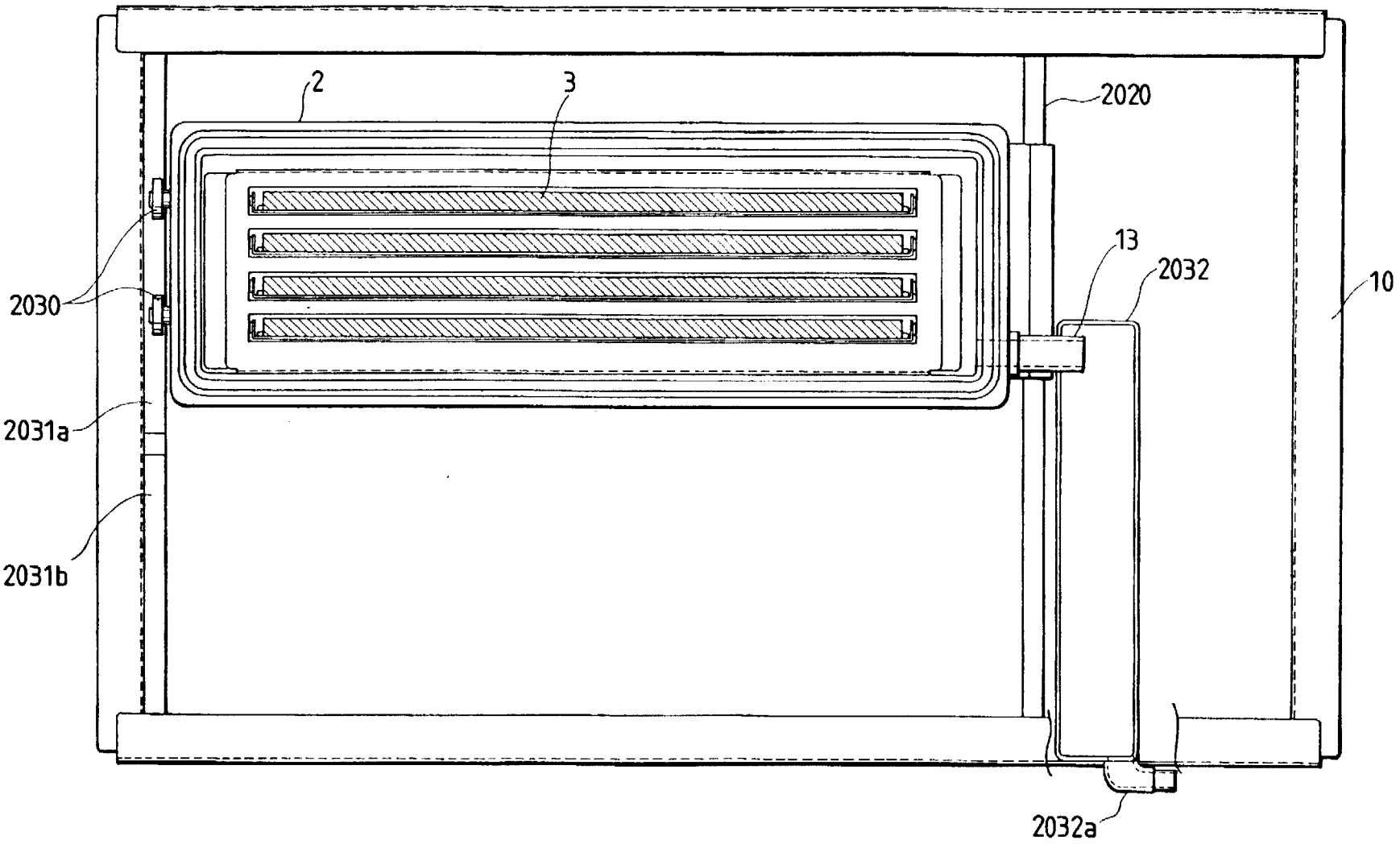
FIGS. 15A, 15B and 16 are explanatory views showing a waste ink path.
Figure 15B:
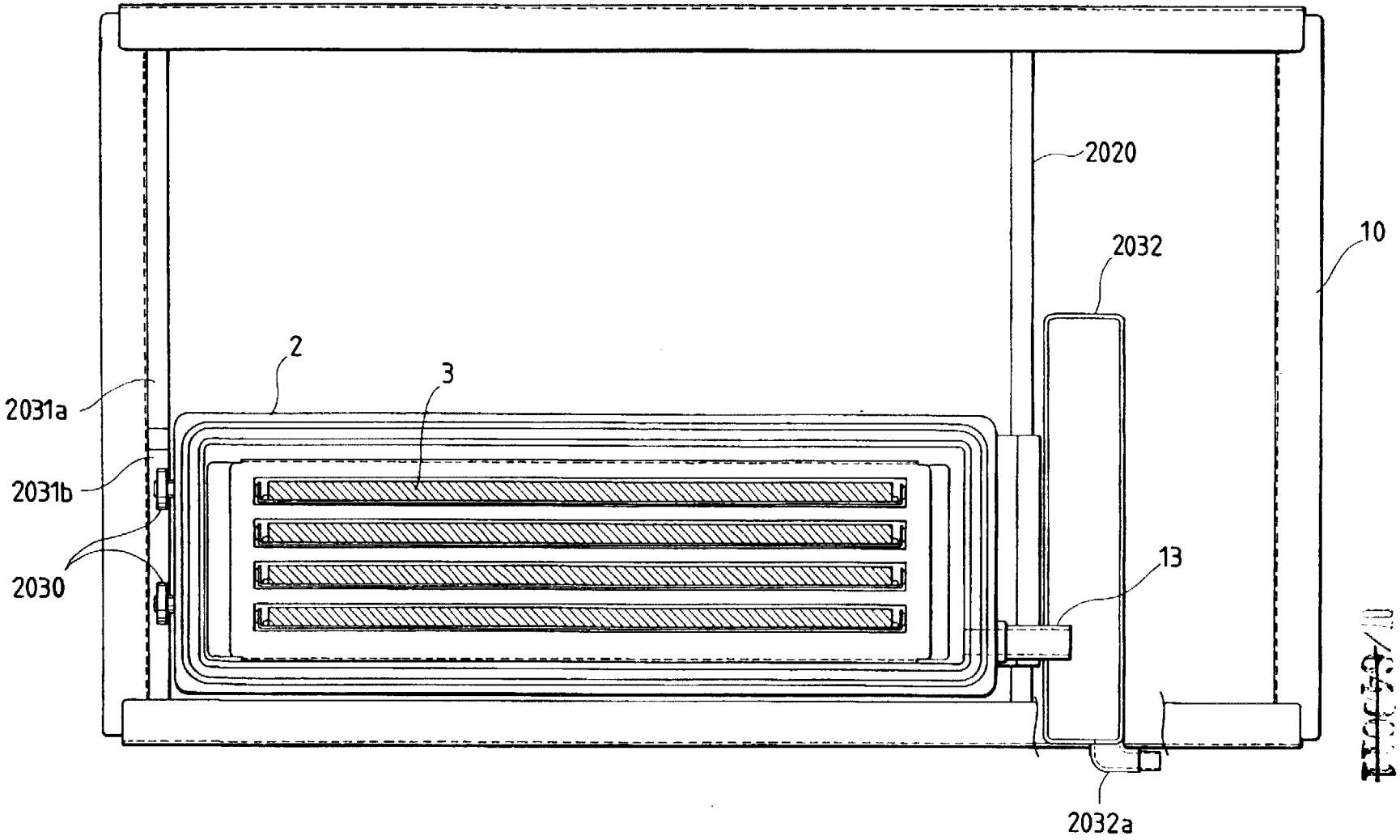

Next, the waste ink path will be explained. FIGS. 15A and 15B are plan views for explaining the waste ink path. The waste ink collected on the bottom of the recovery container 2 is discharged from the recovery container through the waste ink opening 13 formed in the bottom of the container 2. The waste ink exhausted from the waste ink opening 13 flows onto a waste ink catch 2032.

The waste ink catch 2032 is fixedly mounted on the casing of the recovery unit or the casing (side plate 10) of the recording apparatus. On the other hand, since the recovery container 2 can be shifted from the capping position (FIG. 15A) to the retracted position (during the recording) shown in FIG. 15B, the waste ink catch 2032 is arranged so that it can always direct the waste ink from the waste ink opening 13 within the range of the motion of the recovery container 2. The waste ink introduced into the waste ink catch 2032 is sent to the waste ink tank (not shown) from an ink outlet 2032*a* via a waste ink hose (not shown).

Figure 16:
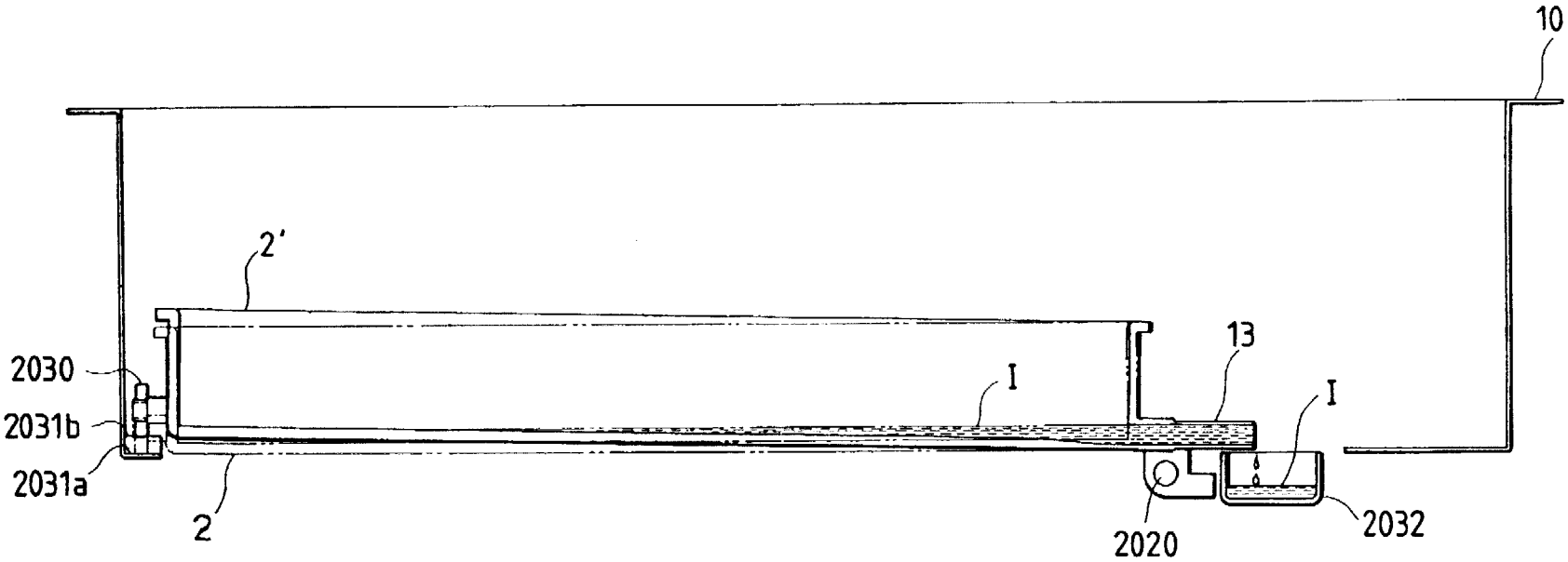

In the illustrated embodiment, in order to increase the ability for exhausting the waste ink, as shown in FIG. 16, when the recovery container 2 is situated in the retracted position (i.e., during the recording operation), the recovery container 2 is inclined. The recovery container 2 can be shifted by sliding it on a slide shaft 2020 at its rear portion and by rolling slide rollers 2030 on a rail 2031 at its front portion. As shown in FIGS. 15A and 15B, the rail 2031 has a rail portion 2031*a* relating to the capping position and a rail portion 2031*b* relating to the retracted position, which rail portions have the different heights. That is to say, when the recovery container 2 is situated in the retracted position, the slide rollers 2030 of the container 2 ride on the rail portion 2031*b*, with the result that the front portion (left portion in FIG. 16) of the container 2 is further lifted in comparison with the capping condition (shown by the two-dot and chain line in FIG. 16), whereby the whole recovery container is inclined toward the waste ink opening 13, thus positively exhausting the waste ink from the waste ink opening.

Figure 14C:
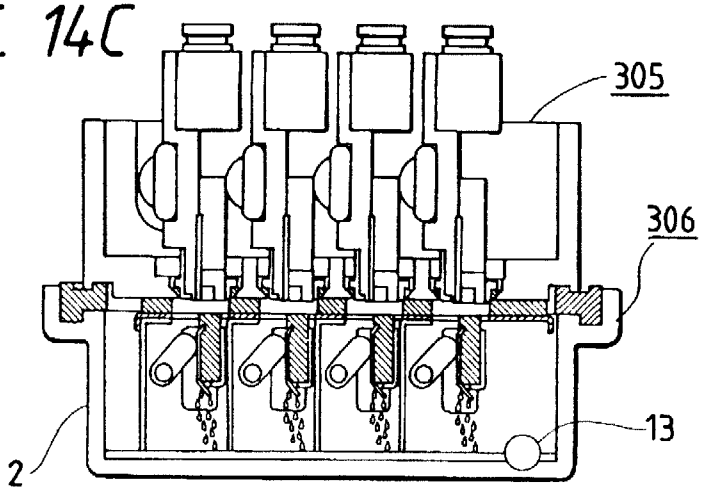
FIGS. 14A to 14D are sectional views showing a sequence of an ink pressurize circulation operation.
Figure 14A:
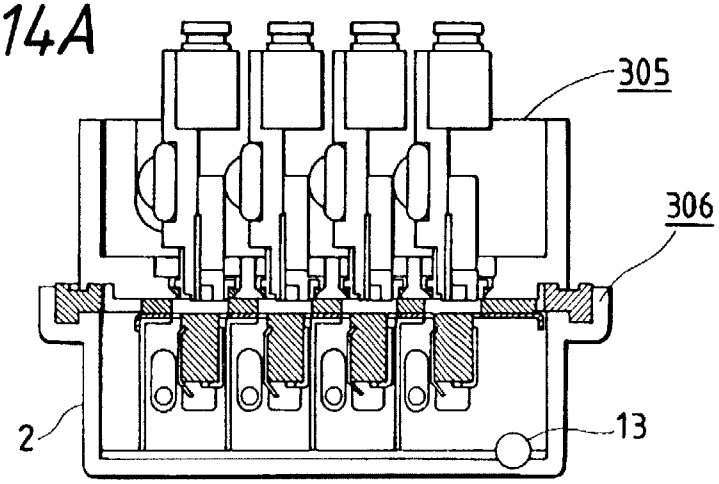
Figure 14D:
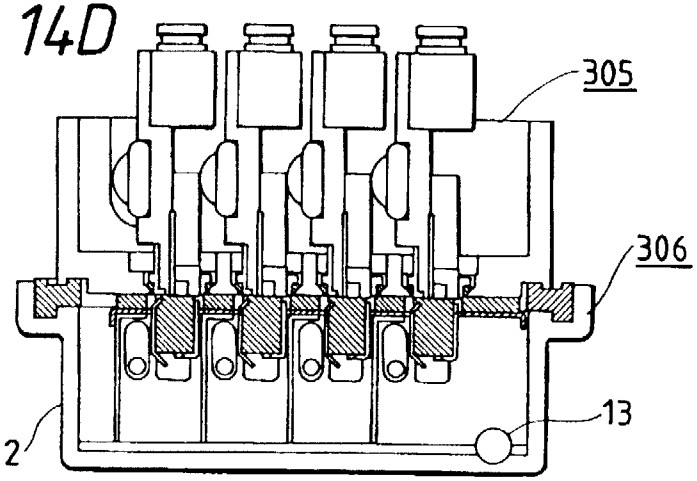
Figure 14B:
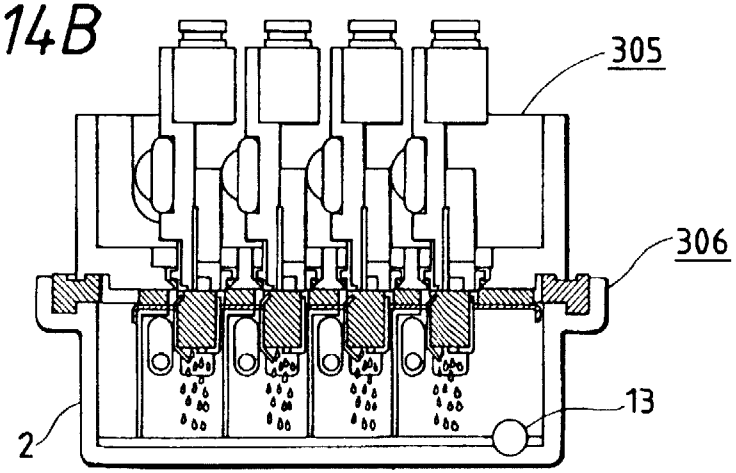

The above-mentioned operation is the absorber squeezing and cleaning operation shown in FIG. 14C. By squeezing or deforming the ink absorbers 3, the ink absorbing ability of the ink absorbers is restored, thus preparing for the next ink absorption. Each ink absorber 3 is preferably made of polyvinyl formal (PVF) which is a highly water-absorbing material, and is desirable to be made of material which can endure repeated usage. In the illustrated embodiment, the ink absorber is made of "Bell Eater" (registered trade mark) manufactured by KANEBOH Company in Japan.

The ink absorbed, from which the absorber ink is squeezed are then abutted against the corresponding discharge surfaces of the heads again. This condition is shown as the absorber abutting condition shown in FIG. 14D. In the condition shown in FIG. 14B, since the ink absorbers are substantially saturated with ink, the residual ink cannot be completely absorbed in the ink absorbers. However, in this condition (FIG. 14D), since the ink absorbing ability is restored by squeezing the absorbers, the residual ink is completely absorbed by the cleaned ink absorbers abutted against the head discharge surfaces, thus completely cleaning the heads.

After a series of these operations (FIGS. 14A to 14D) have been completed, the recovery system is returned to the capping condition, i.e., the stand-by condition again, thus maintaining the cleaned heads. Normally, the ink pressurization circulation operation is effected at the activation of the power source or after the long time waiting condition.

As mentioned above, by performing the recovery operation including the capping operation (a), idle discharge operation (b) and ink pressurization circulation operation (c), it is possible to prevent (recover) the distortion of the recorded image due to the poor ink discharge during the recording operation.

Next, the recording operation will be explained. FIGS. 17A to 17F show a sequence transferring from the stand-by condition of the recovery system to the record permitting condition. First of all, the capping condition shown in FIG. 17A corresponding to the capping condition (a) as mentioned above, which is the normal stand-by condition or non-operative condition. In this condition, when the recording mode (copy ON) is selected, the above-mentioned idle discharge operation is effected.

Figure 17A:
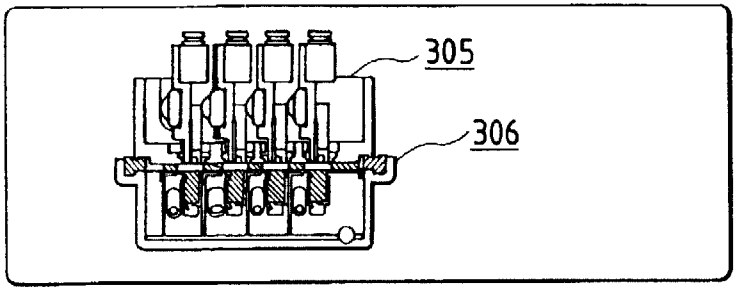
FIGS. 17A to 17F are sectional views showing a sequence of operation of the head recovery system of FIG. 12 from a stand-by condition to a print permitting condition.
Figure 17B:
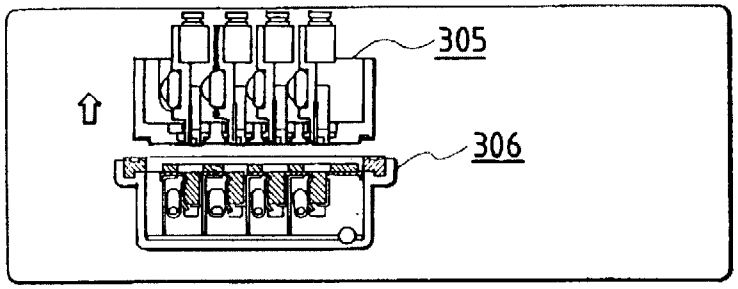
Figure 17C:
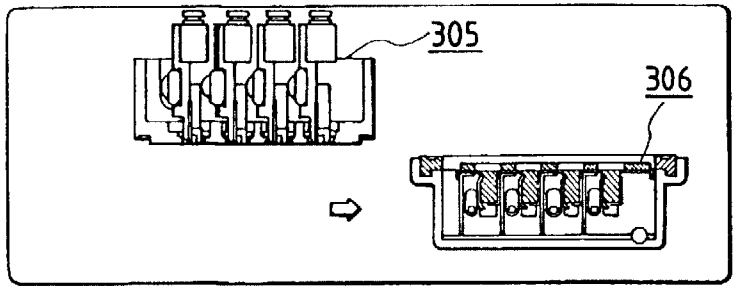

Subsequently, the recording apparatus is changed to a head up condition as shown in FIG. 17B, i.e., a condition that the recording head portion 305 is retracted upwardly. In this condition, the recovery container 2 of the recovery cap portion 306 is retracted to the right (FIG. 17B). This condition corresponds to a unit open condition shown in FIG. 17C. Through this condition, then, a head down as shown in FIG. 17D is effected.

Figure 17D:
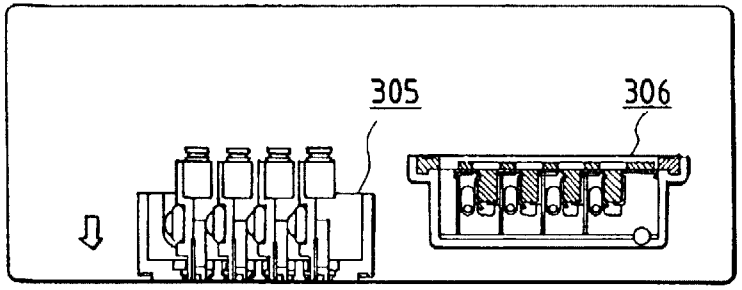

Consequently, as shown in FIG. 17D, the recording heads are under the record permitting condition (position) and the recovery container 2 is shifted to the retracted position. In this condition, the recording paper is shifted from the right (FIG. 4) while being spaced apart from the head discharge surfaces by the predetermined distance; whereas, the image signals are inputted to the recording heads 1C, 1M, 1Y and 1BK to discharge the ink, thereby forming the image on the recording paper.

Figure 17E:
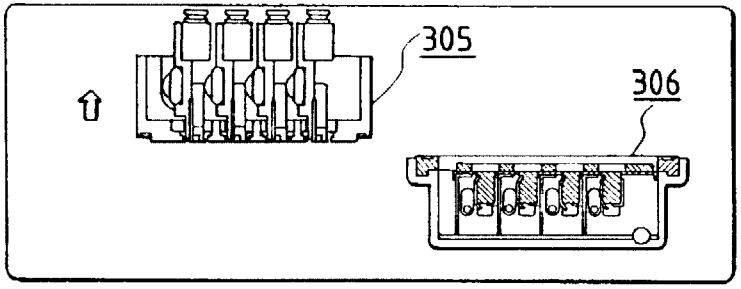
Figure 17F:
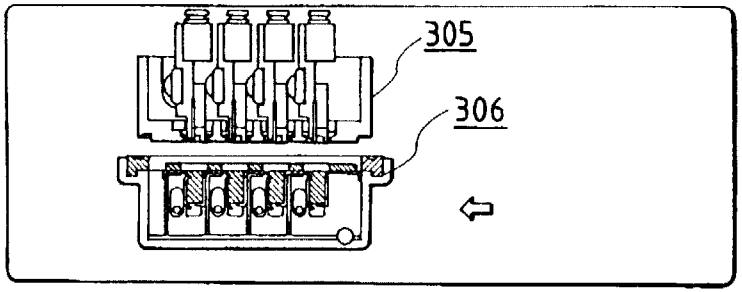

When the recording of the image on the recording paper is finished (i.e., the discharge of the ink from the recording heads is finished), as shown in FIG. 17E, the head up operation of the recording heads is effected, and then, as shown in FIG. 17F, the recovery container 2 is shifted toward the heads, thus restoring the capping condition shown in FIG. 17A for preparing the next recording operation (stand-by condition). By repeating the above-mentioned series of operations shown in FIGS. 17A to 17F, the normal copying operation is effected. Further, the above-mentioned ink circulation operation (c) is effected at a predetermined timing of the capping operation (i.e., the stand-by condition), for example, at the activation of the power source or after predetermined time periods, thus preventing the reduction of the ink flow and obtaining the good image.

Figure 18:
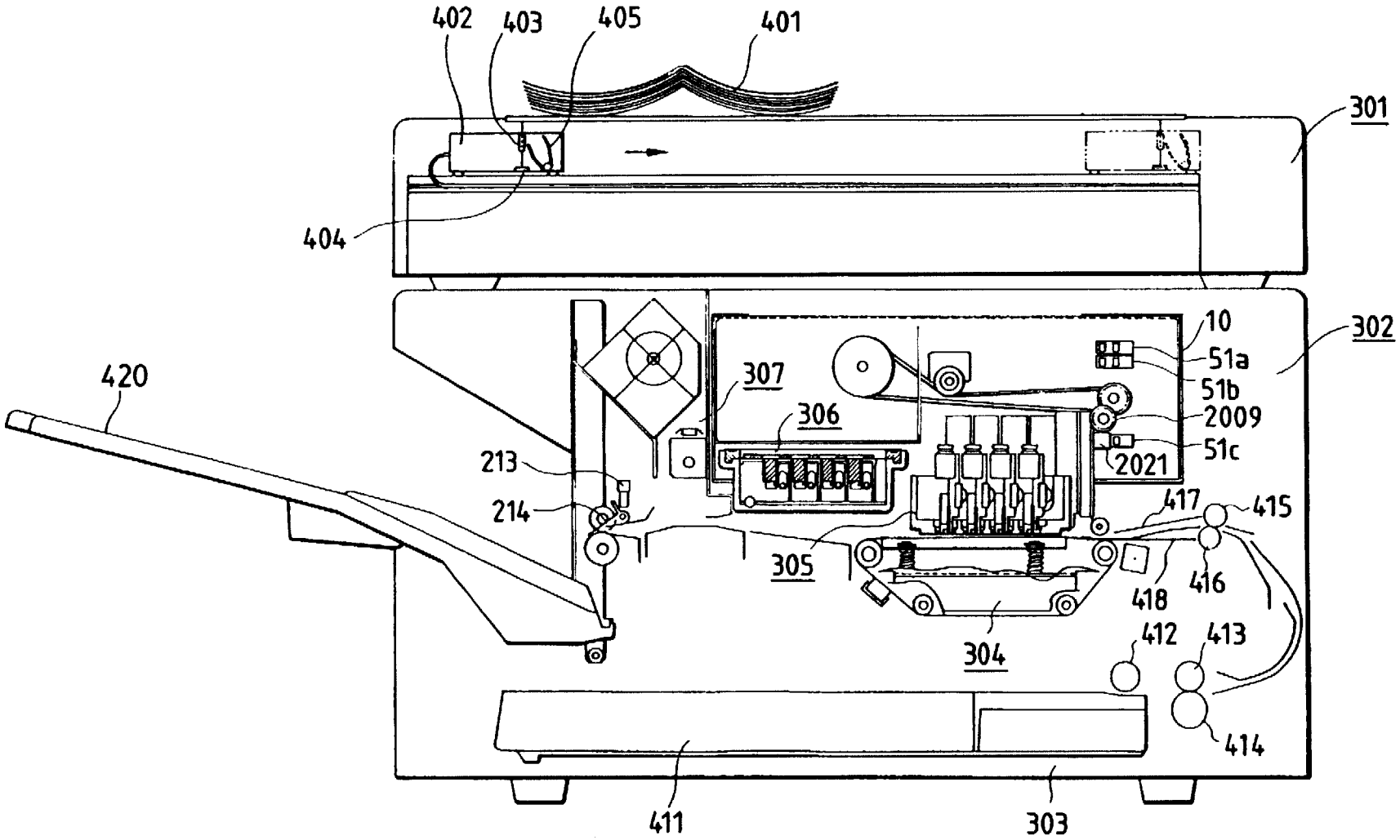
FIG. 18 is a schematic sectional view of an ink jet recording apparatus according to another embodiment of the present invention.

FIG. 18 shows another embodiment of present invention. In FIG. 4, the elements similar to those shown in FIG. 4 are designated by the same reference numerals. In this embodiment, the retracted position of the recovery container 2 is defined at a downstream side of the recording paper feeding direction.

In FIG. 18, the scanner portion 301 reads the original information and converts such information into the electrical signal. A signal based on the electrical signal converted in the scanner portion is sent to the recording head portion 305 of the printer portion 302 as the drive signal.

The recording paper as the recording medium contained in the sheet supply portion 303 is supplied one by one to the belt conveying portion 304 as needed. As the recording paper is passing through the belt conveying portion 304, the image is recorded on the recording paper by means of the recording head portion 305, and, thereafter, the recording paper is sent to the ejector tray 420 through the fixing and ejecting portion 307. The recovery cap portion 306 serves to maintain a condition that the recording head portion 304 can always perform the recording operation.

In this way, since both the recording head portion and the recovery system are shifted straightly in the relative parallel movements in such a manner that their shifting paths do not cross the recording medium feeding path, it is possible to effect the recovery operation at a high speed; further, since the shifting of the recovery system can be even effected during the recording operation, it is possible to minimize any reduction in recording speed and to stably record the image with high quality. Particularly, when the recovery system includes an ink squeezing mechanism, it is important that the absorbing ability of the ink absorbers be increased.

As mentioned above, particularly in the ink jet recording apparatus having the lengthened head of multi-orifice type, since the recording head portion is shifted in the direction perpendicular to the platen surface opposed to the recording head portion and the recovery system is shifted in a direction parallel to the platen surface, it is possible to make the construction of the recording apparatus itself simple and compact. Further, the time required before copying is possible can be shortened. Further, by performing the quick recovery operation, the stable image can be maintained for a long time.

Next, a further embodiment of the present invention will be explained with reference to the accompanying drawings. Incidentally, it should be noted that, in the following drawings, when the last three figures of the reference numerals designating the elements are identical to the reference numerals designating the parts in the previous embodiments, such elements have the same functions as those of such parts.

Figure 19:
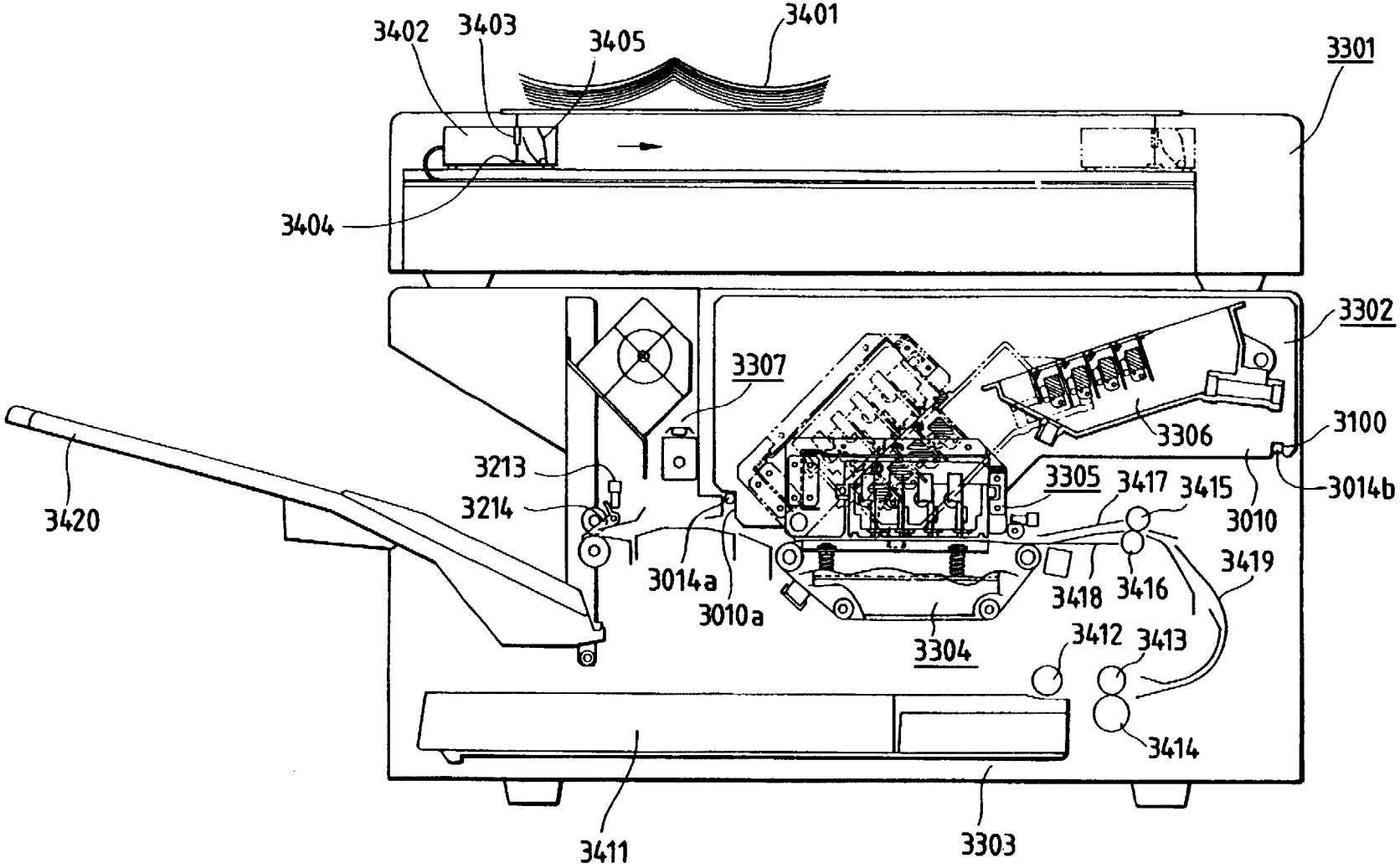
FIG. 19 PRIOR ART
FIG. 19 is a schematic sectional view of an ink jet recording apparatus according to a further embodiment of the present invention.

FIG. 19 is a sectional view of an ink jet recording apparatus according to the further embodiment of the present invention. First of all, the summary of the ink jet recording apparatus according to the illustrated embodiment will be described with reference to FIG. 19. In FIG. 19, the reference numeral 3301 denotes a scanner portion for reading information on an original and for converting the information into an electric signal. A signal based on the electric signal converted in the scanner portion is sent to a recording head portion 3305 of a printer portion 3302 as a drive signal. The recording paper (recording medium) contained in a sheet supply portion 3303 is supplied one by one to a belt conveying portion 3304 as needed. As the recording paper is passing through the belt conveying portion 3304, the image is recorded on the recording paper by means of the recording head portion 3305, and, thereafter, the recording paper is sent to an ejector tray 3420 through a fixing and ejecting portion 3307. A recovery cap portion 3306 serves to maintain a condition that the recording head portion 3305 can always perform the recording operation.

In FIG. 19, the recording head portion 3305 and the recovery cap portion 3306 are shown to be under the recording condition, and, the conditions of such portions during the recovery operation are shown by the two-dot and chain lines 3305' and 3306', respectively. In FIG. 19, the reference numeral 3010 denotes a supporting side plate for the head unit; 3010*a*, 3010*b* denotes notches formed in the side plate; and 3014*a*, 3014*b* denote positioning shafts engaged by the notches 3010*a*, 3010*b*, respectively, for permitting the vertical movement of the side plate 3010. The reference numeral 3401 denotes an original; and 3402 denotes an optical system including a cylindrical lens array 3403, a reading sensor 3404 and an illumination lamp 3405. The reference numeral 3411 denotes a recording paper cassette; 3412, 3413, 3414, 3415 denote recording paper conveying rollers; 3417, 3418, 3419 denote conveying guides; 3213 denotes a sheet discharge sensor; and 3214 denotes ejector rollers.

The ink supply to the lengthened recording head of the full-line type used in this embodiment is the same as that described with reference to the previous embodiments.

Figure 20A:
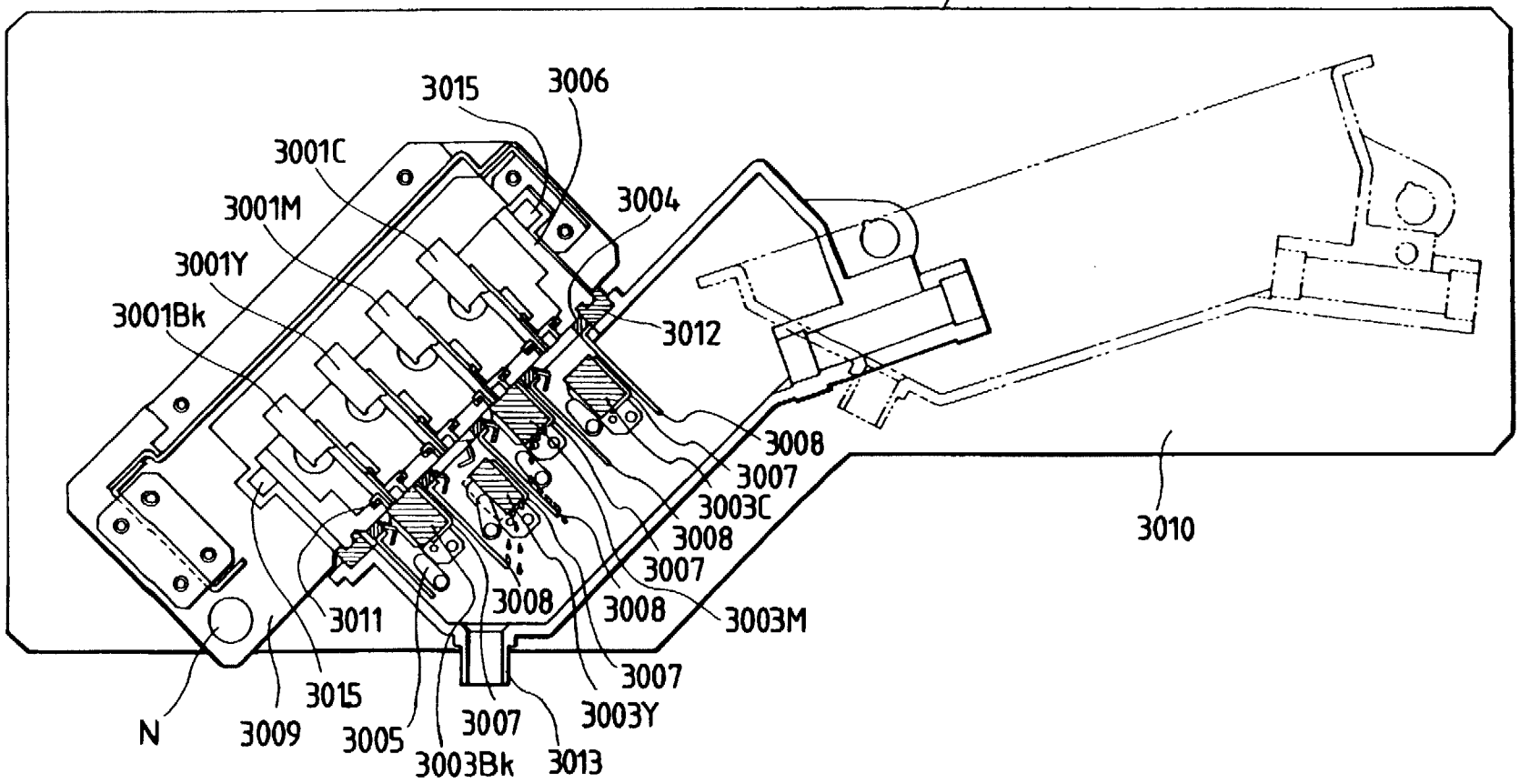
FIG. 20A PRIOR ART
FIGS. 20A and 20B are sectional views showing a main portion of a head recovery system shown in FIG. 19.
Figure 20B:
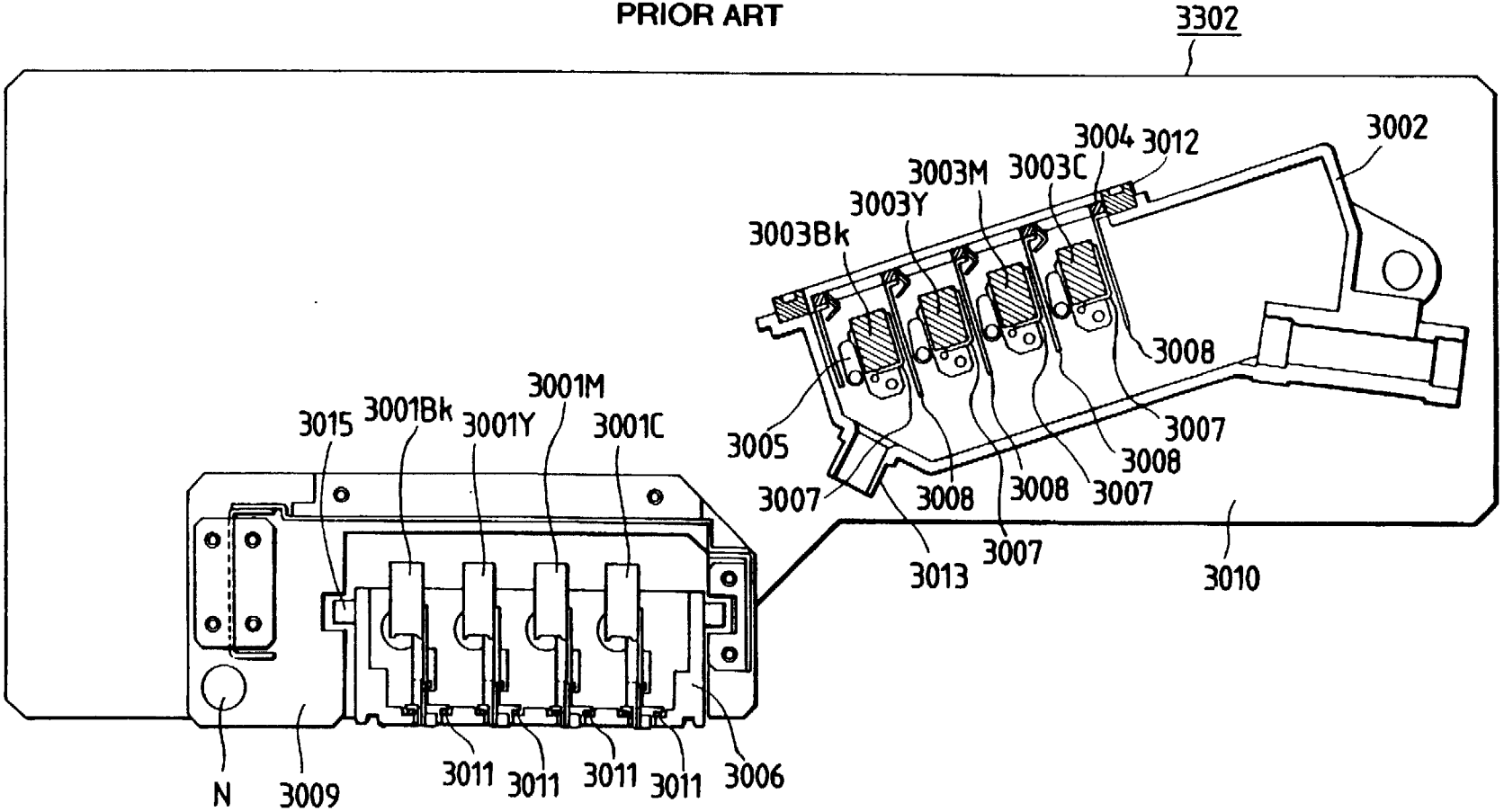
FIG. 20B PRIOR ART

FIGS. 20A and 20B schematically show, in section, a main part of the printer portion of the ink jet recording apparatus according to this embodiment.

Now, the condition of the recording heads in the recovery operation will be described with reference to FIG. 20A. The reference numerals 3001C, 3001M, 3001Y and 3001BK denote ink jet recording heads to which cyan color ink, magenta color ink, yellow color ink and black color ink are supplied, respectively. The recording heads are fixedly attached to a head block 3006 with high accuracy, so that the desired parallelism of each head and the desired distance between the heads can be established with the satisfactory precision. In the vicinity of the discharge openings of the recording heads 3001C, 3001M, 3001Y, 3001BK, ink absorbers 3003C, 3003M, 3003Y, 3003BK for absorbing the ink are disposed in correspondence with the associated discharge openings of the heads. The ink absorbers 3003C, 3003M, 3003Y and 3003BK are supported by corresponding guides 3007 so that they can be moved toward and away from the discharge surfaces of the corresponding recording heads 3001C, 3001M, 3001Y and 3001BK. In FIG. 20A, the ink absorbers 3003C and 3003Y are shown to be disengaged from the discharge surfaces of the corresponding recording heads 3001C and 3001Y; whereas, the ink absorbers 3003M and 3003BK are shown to be engaged by the discharge surfaces of the corresponding recording heads 3001M and 3001BK. Partition plates 3008 are arranged between the adjacent ink absorbers. In the vicinity of the ink absorbers, there are disposed corresponding ink squeezing members 3005 which can be driven by corresponding levers (not shown) to squeeze the ink absorbed in the ink absorbers 3003C, 3003M, 3003Y and 3003BK. FIG. 20A shows a condition that the ink is squeezed from the ink absorber 3003Y relating to the recording head 3001Y regarding the yellow color by the corresponding squeezing member 3005. Incidentally, the reference numeral 3007 denotes absorber guides.

The head block 3006 to which the recording heads 3001C, 3001M, 3001Y, 3001BK are fixed is removably inserted into a block stay 3009 through a rail 3015. Further, the block stay 3009 can be rotated around an axis N together with the head block 3006 and the recording heads. The recovery container 3002 can be shifted by a shifting mechanism (not shown) from the recovery operation condition shown in FIG. 20A to the retracted position shown by the two-dot and chain line. A waste ink opening 3013 is formed in the bottom of the recovery container 3002. The ink discharged from the recording heads 3001C, 3001M, 3001Y, 3001BK and absorbed by the ink absorbers 3003C, 3003M, 3003Y, 3003BK, and then squeezed from the ink absorbers is exhausted from the recovery container 3002 through the waste ink opening 3013 and is then directed to a waste ink tank (not shown) via a waste ink hose (not shown).

FIG. 20B is a schematic sectional view showing a condition that the recording heads are under the recording operation (during the recording). After the recovery container 3002 has been shifted from the position of FIG. 20A to the retracted position (shown by the two-dot and chain line in FIG. 20A), the recording heads are rotated to a horizontal position as shown in FIG. 20B. In this condition, the ink is discharged from the corresponding recording head in response to the image (recording) signal, thereby forming the image on the recording paper (recording medium) being conveyed while being spaced apart from the discharge surfaces of the recording hands by predetermined distance. Incidentally, the reference numerals 3004, 3011, 3012 denote ink seal members which will be fully described later.

Figure 21A:
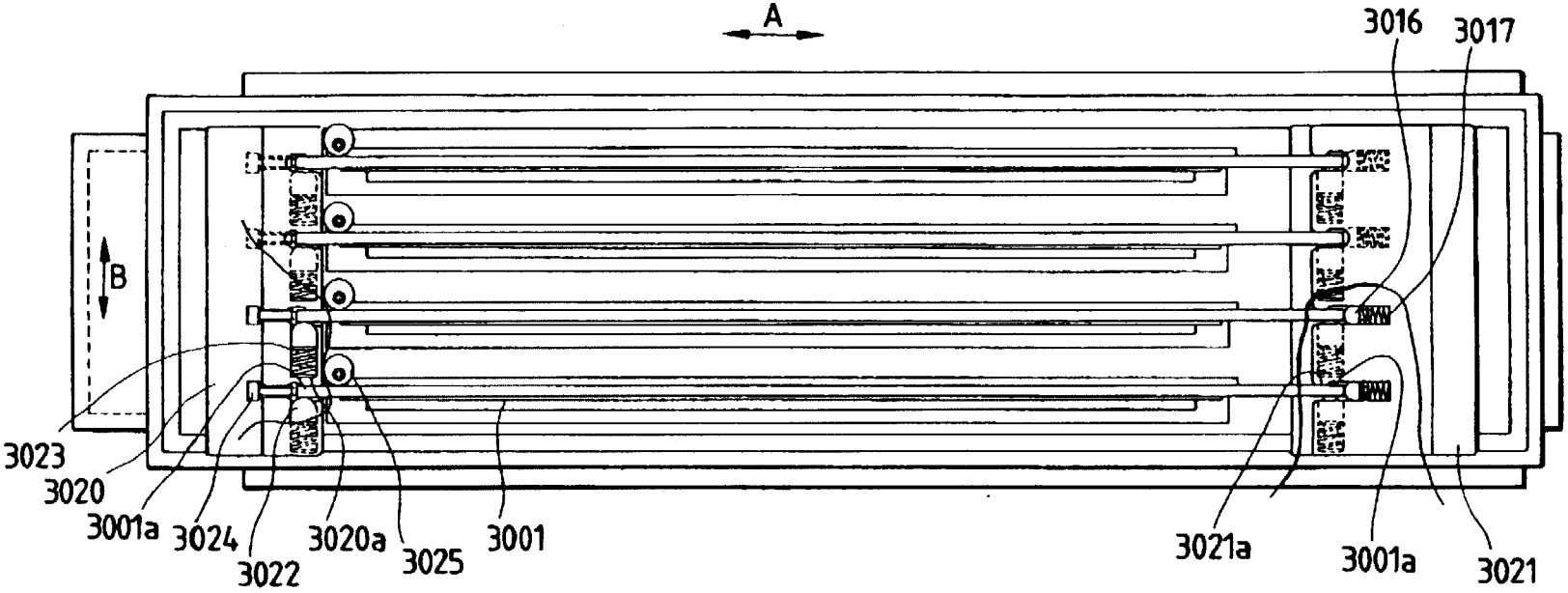
FIG. 21A PRIOR ART
FIGS. 21A and 21B are a schematic plan view and an elevational sectional view for explaining a mechanism for positioning and fixing the recording head.
Figure 21B:
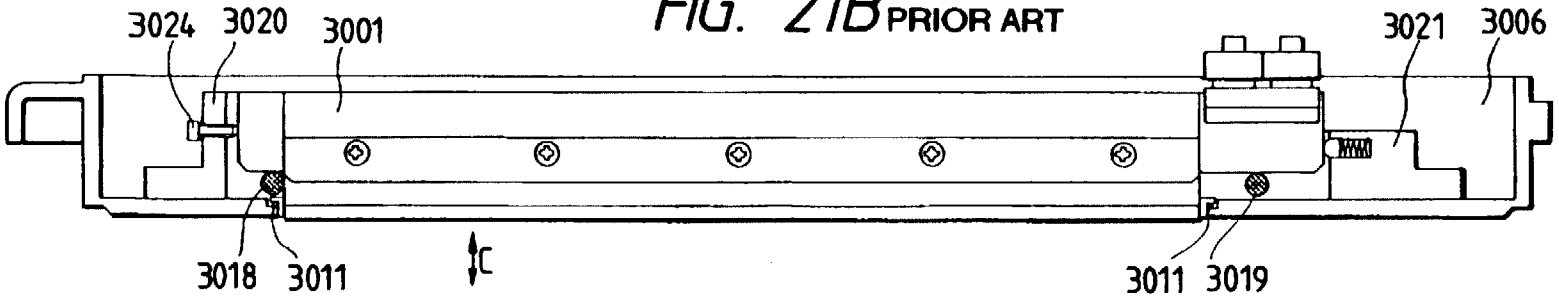
FIG. 21B PRIOR ART

FIGS. 21A and 21B are schematic explanatory views for explaining a mechanism for positioning and fixing the recording heads, where FIG. 21A is a schematic plan view and FIG. 21B is a schematic elevational sectional view.

In FIG. 21A, the reference numerals 3020, 3021 denote head fixing members. By inserting abutment portions 3001*a* formed on both ends of each head 3001 into corresponding abutment recesses formed in the fixing members 3020, 3021, respectively, the position of each head in directions shown by the arrows A and B in FIG. 21A is determined; whereas, the position of each head in an up-and-down direction (direction shown by the arrow C in FIG. 21B) is determined by positioning shafts 3018 and 3019. The recording heads 3001 are biased toward the capping position by means of corresponding urging pins 3016 and bias springs 3017. Each head inserted into the head fixing members 3020, 3021 is positioned and fixed in place by urging the head end portions against abutment portions 3020*a* and 3021*a* of the fixing members 3020, 3021 by means of urging pins 3022 biased by corresponding springs 3023. Adjustment screws 3024 are used to adjust the positions of the corresponding heads in the direction A in FIG. 21A, i.e., a direction perpendicular to the recording paper feeding direction (referred to as "left margin" hereinafter). The reference numeral 3025 denotes eccentric rollers for adjusting the corresponding heads in an inclined direction. In FIG. 21A, by displacing the abutment portion 3001*a* of the head by an eccentric amount obtained by rotating the eccentric roller 3025, the position of the head can be adjusted in the direction B, whereby each head can be adjusted independently from the others. Therefore, it is possible to easily correct any discrepancy in the images recorded with the respective colors, thus permitting improving the image recording quality.

Figure 22:
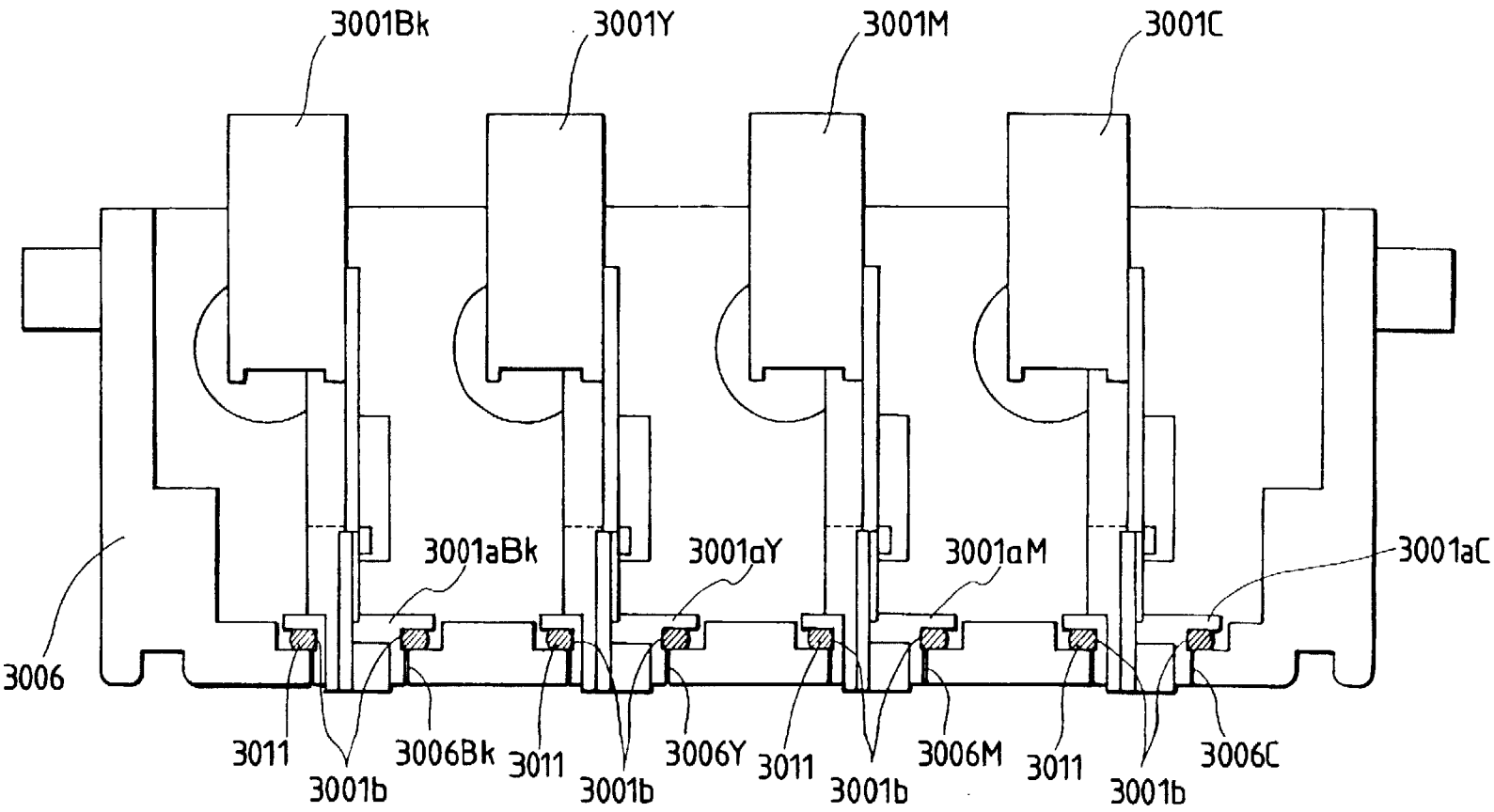
FIG. 22 is a schematic view for explaining a first seal member.

FIG. 22 is a schematic explanatory view for explaining first seal members disposed between the recording heads and the head block. In the vicinity of the discharge surfaces of the recording heads 3001C–3001BK, members (called as "front face blades") 3001*a*C–3001*a*BK for protecting the discharge surfaces and strengthening the heads are arranged. The front face blades 3001*a*C–3001*a*BK are fixedly attached to the corresponding heads 3001C–3001BK adhesive. The recording heads 3001C, 3001M, 3001Y and 3001BK for the respective ink colors are supported by the head block 3006 in such a manner that the front face blades of the heads are engaged by slots 3006C–3006BK formed in the head block, respectively. Further, each front face blade 3001*a*C–3001*a*BK is provided at its periphery with a groove 3001*b* into which a corresponding seal ring (first seal member) 3011 is fitted. In the illustrated embodiment, each seal ring 3011 comprises an O-ring which is fitted into a groove of the corresponding recording head and is also fitted into the groove of the corresponding slot of the head block 3006, so that, as shown in FIG. 22, when the recording heads are positioned in place, an optimum urging force is applied to the seal ring. In this way, the contact between the heads and the seal rings and the contact between the seal rings and the head block prevent the ink discharged from the discharge surfaces from entering into the upper portions of the heads (that is to say, ink seals are provided between the heads and the head block).

As mentioned above, since each recording head is provided at its upper portion with the accurate electric circuit for driving the head, if the dust, dirt, ink and the like penetrate into and adhere to such electric circuit, the recording heads are undesirably affected, resulting in the malfunction or poor operation of the heads. Particularly, since the recording ink used with the ink jet recording apparatus according to the present invention is a low viscosity liquid and is electrically conductive, if the ink penetrates into the electric circuit, the heads will suffer failure. Accordingly, the prevention of ink penetration is particularly important. In the illustrated embodiment, this is accomplished by providing the above-mentioned O-ring shaped seal members between the heads and the head block, thus improving the ink sealing ability.

FIGS. 23A to 23D show, in section, other examples of how the recording heads are inserted into the head block.

Figure 23A:
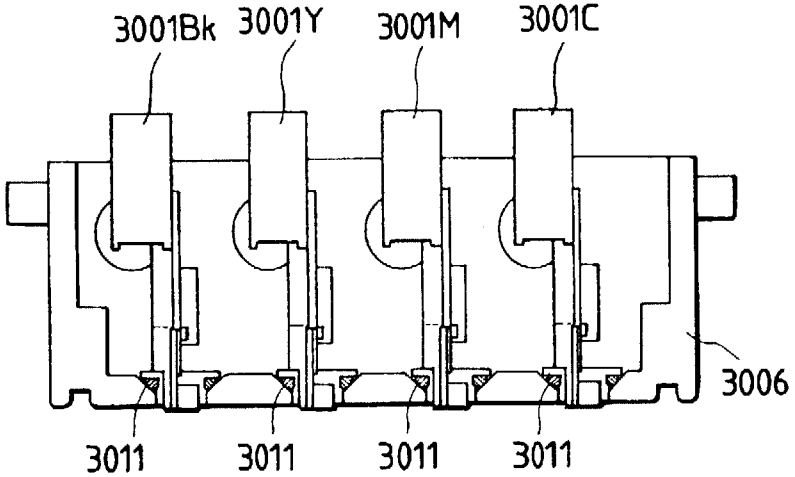
FIGS. 23A to 23D are schematic views showing other embodiments of the first seal member.

FIG. 23A shows an example that each groove formed in the head block 3006 has a V-shaped section, i.e., has a frustro-conical shape. Also in this example, similar to the previous example, when the heads are positioned and fixed in place, the optimum urging force is applied to the seal rings, thereby providing the ink seals between the heads and the head block, whereby the contact between the heads and the seal rings and the contact between the seal rings and the frustro-conical grooves of the head block prevent the ink discharged from the discharge surfaces from entering into the upper portions of the heads.

Figure 23B:
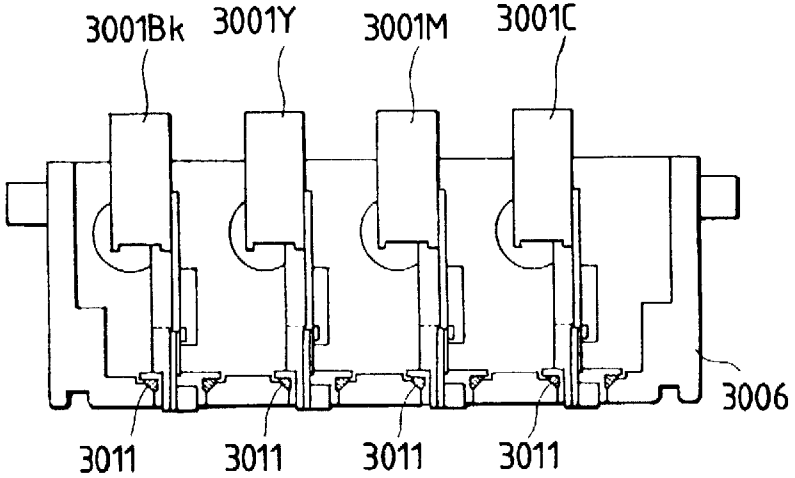
Figure 23C:
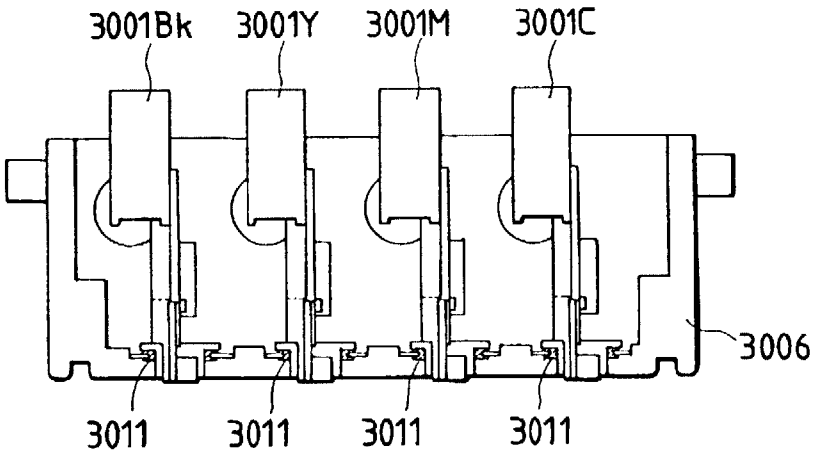
Figure 23D:
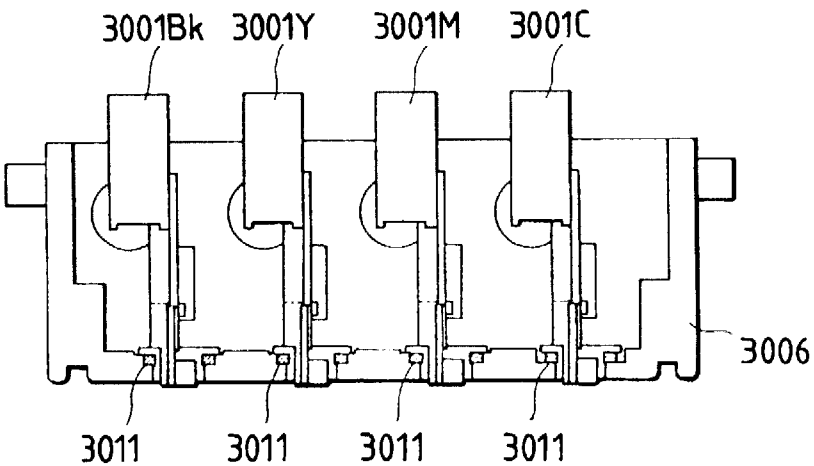

Similarly, FIGS. 23B to 23D show other examples for improving the effectiveness of the ink seals. More particularly, FIG. 23B shows an example wherein each groove formed in the head block is chamfered, FIG. 23C shows an example in which projections are formed on a wall of each groove, and FIG. 23D shows an example where a stepped portion is formed on the wall of each groove These examples also provide the ink seals wherein the contact between the heads and the seal rings and the contact between the seal rings and the head block prevent the ink discharged from the discharge surfaces from entering into the upper portions of the heads, as similar to the previous example of FIG. 23A.

Next, second ink seal members arranged between the recording heads and between the recovery system and the heads will be described, while explaining the recovery operation of the recovery system according to the illustrated embodiment.

Conveniently, the recovery operation will be described by dividing it into the following three operations: (a) capping operation, (b) preliminary (idle) discharge operation and (c) ink exhausting operation.

Figure 24:
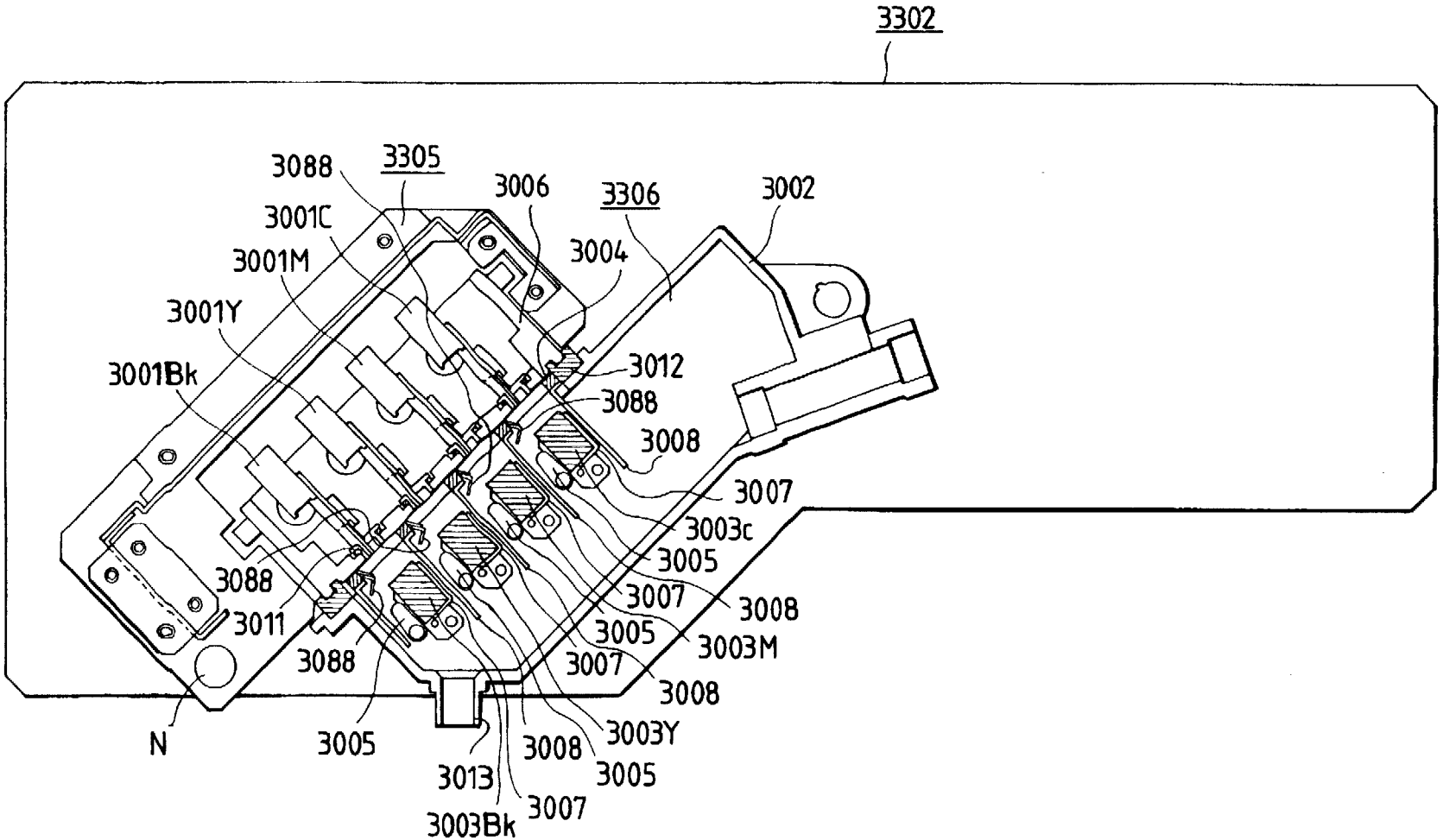
FIG. 24 is a sectional view in a capping condition for explaining second and third seal members.

First of all, the capping operation (a) will be explained. FIG. 24 is a schematic view showing a condition that the recording heads are capped. In FIGS. 24, the recording heads 3001C, 3001M, 3001Y and 3001BK arranged side by side in the head block 3006 are engaged by the recovery cap portion 3306 acting as the discharge recovery means.

Ink seals 3004 constituting the second ink seal members, partition plates 3008 and ink absorbers 3003C, 3003M, 3003Y, 3003BK are disposed in the recovery container 3002, and the ink absorbers are normally spaced apart from the head discharge surfaces by a predetermined distance. A shown in FIG. 24, in the capping condition, the ink seals 3004 are disposed between the heads and on substantially the whole surfaces of the head block 3006 (i.e., on the surface opposing to the recording paper being passed therebelow, except the head discharge surfaces), and are made of sealing material such as neoprene sponge. It should be noted that the material of the ink seals does not deteriorate in the presence of the ink used with the recording apparatus.

Thereby, the discharge openings (and thereabout) of the recording heads 3001C, 3001M, 3001Y, 3001BK are encircled by the ink seals 3004, partition plates 3008 and ink absorbers 3003C, 3003M, 3003Y, 3003BK to maintain the discharge openings under an appropriate wet condition, thus preventing the drying of the head discharge openings. In this way, in the non-operative condition and stand-by condition of the recording heads, by capping the recording heads, the non-discharge of ink is prevented, the discharge openings are protected, and the adhesion of dirt and the like on the discharge openings is also prevented.

Figure 25:
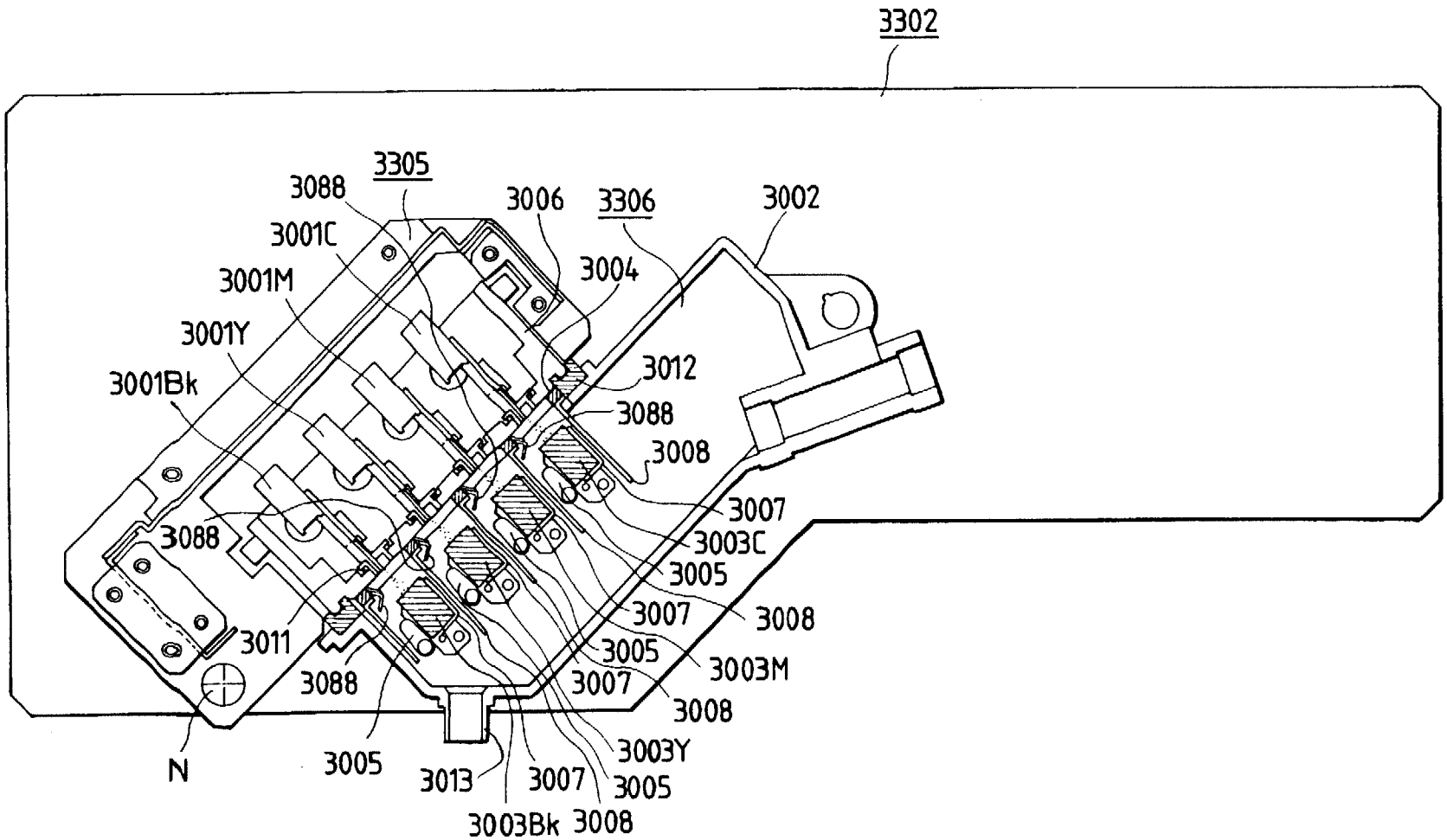
FIG. 25 is a sectional view showing an idle discharge condition for explaining the second and third seal members.
Figure 26A:
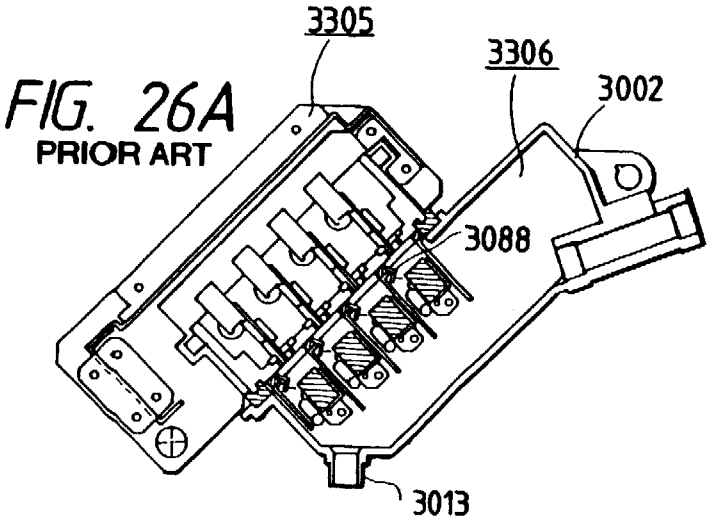
FIG. 26A PRIOR ART
FIGS. 26A to 26D are sectional views showing a sequence of an ink pressurizing circulation operation, for explaining the second and third seal members.
Figure 26B:
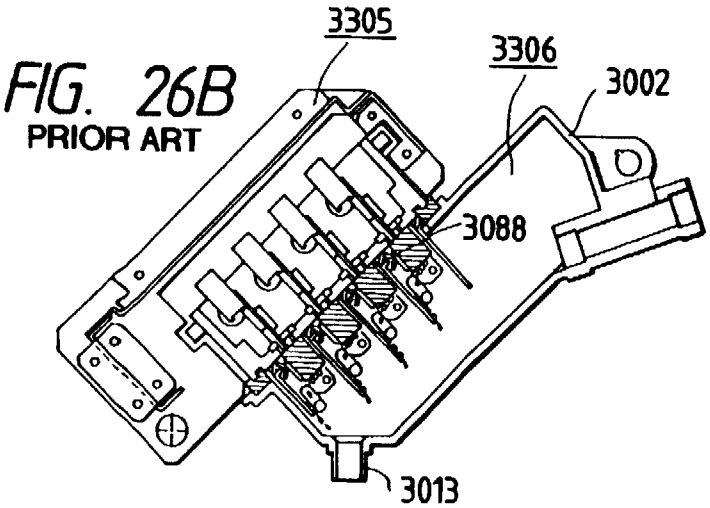
FIG. 26B PRIOR ART
Figure 26C:
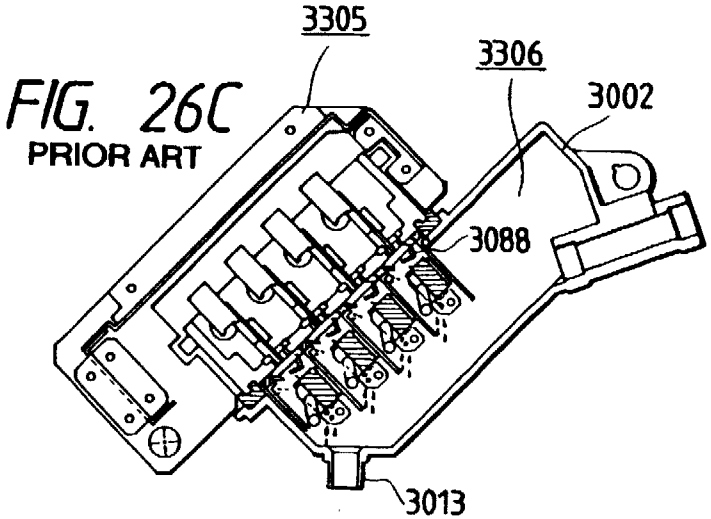
FIG. 26C PRIOR ART
Figure 26D:
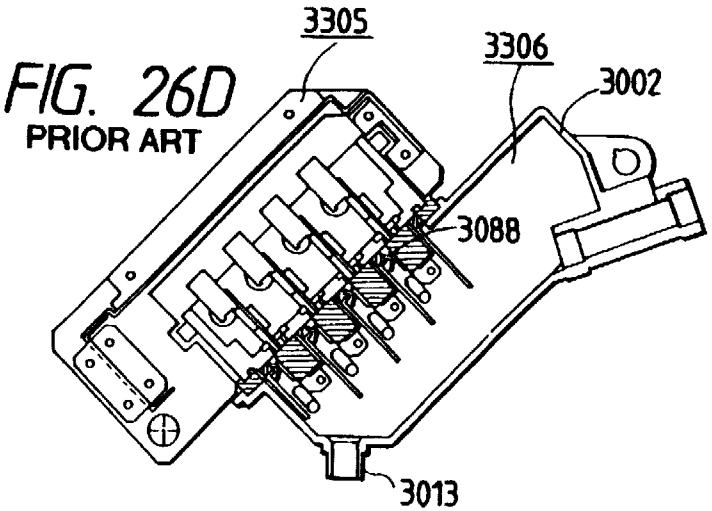
FIG. 26D PRIOR ART

Then, the preliminary (idle) discharge operation (b) will be explained. FIG. 25 is a schematic view showing the idle discharge condition. Similar to the above-mentioned capping operation, the ink absorbers 3003C, 3003M, 3003Y and 3003BK are spaced apart from the discharge surfaces of the recording heads. In this case, a desired number of ink discharging pulses are applied to all of the discharge energy generating means of all of the recording heads 3001C, 3001M, 3001Y and 3001BK. In this way, regarding all of the discharge openings, it is possible to prevent the non-discharge of ink due to the solidification of ink, and, the poor discharge of ink and the distortion of image due to changes in the viscosity of ink. Normally, the idle discharge operation is effected at the initiation of the recording operation or at predetermined time periods.

In this case, although there arises a problem that the individual color ink discharged from the discharge surface of the corresponding head may be scattered toward the adjacent recording heads, since the above-mentioned second seal members 3004 are sealingly engaged between the head block 3006 and the recovery system, it is possible to prevent the different color ink from scattering toward the adjacent recording heads, thus preventing the mixing of the different color inks which causes deterioration of the image quality.

Next, the ink exhausting operation (c) will be explained. FIGS. 26A to 26D are schematic views showing the operation of the recovery cap portion 3306 performing the ink pressurization and circulation operation in the ink supply system for the ink exhaustion. The operation in the recovery cap portion 3306 includes the following four cycles: (i) a normal capping cycle, (ii) an ink pressurization circulation cycle, (iii) an absorber squeezing and cleaning cycle, and (iv) an absorber abutting cycle. FIGS. 26A to 26D show these cycles (i) to (iv), respectively.

First of all, the capping cycle (i) corresponds to the above-mentioned capping operation (a) wherein the normal stand-by condition or non-operative condition is established. In this condition, when the ink pressurization circulation mode is selected, for example, by an operator or command from a host computer, the recovery cap portion is changed from this condition to the condition shown in FIG. 26B. In this new condition, the ink absorbers 3003C, 3003M, 3003Y and 3003BK being spaced apart from the head discharge surfaces are abutted against the corresponding recording head 3001C, 3001M, 3001Y and 3001BK, respectively Accordingly, in this condition, the ink absorbers are engaged by the corresponding discharge surfaces of the heads. In such engagement condition, by activating ink supply pumps (not shown), the pressure in the ink supplied to the recording heads 3001C, 3001M, 3001Y and 3001BK is increased. Consequently, the inks are circulated in the respective ink supply systems through the respective heads to remove the bubbles from the heads, and the pressurized inks are also exhausted from the respective discharge openings. Thus, any dirt and the like adhered to the discharge surfaces is removed together with the waste ink, thereby cleaning the discharge openings and thereabout. The waste ink discharged from the discharge openings is absorbed by the ink absorbers 3003C, 3003M, 3003Y, 3003BK abutted against the discharge surfaces without leaking to other portions, as mentioned above. When the ink amount absorbed in each ink absorber exceeds the maximum absorbing capacity of the ink absorber, the excess ink flows down from the ink absorber by its own weight onto the bottom of the recovery container 3002, and is then directed to the waste ink tank (not shown) through the waste ink opening 3013 via a waste ink hose (not shown). Preferably, the ink pressurization circulation time, i.e., the ink supply pump activation time is normally in the order of 0.5 second~several seconds, on consideration of the effective removal of the solidified ink and the bubbles.

Next, the absorber squeezing and cleaning cycle (iii) will be explained.

When the ink pressurization circulation cycle (ii) is finished, the ink absorbers abutted against the head discharge surfaces are again separated from the corresponding recording heads. In such a disengaged condition, the ink saturating the ink absorbers is squeezed from the ink absorbers by means of the squeezing members 3005. The squeezed ink is, by its own weight, transferred to the absorber guides 3007 and hence to the partition plates 3008, and then flows down from the partition plates onto the bottom of the recovery container 3002, and is then directed to the waste ink tank (not shown) through the waste ink opening 13 via the waste ink hose. At the same time when the ink absorbers are separated from the corresponding head discharge surfaces, the ink absorbers are squeezed, and discharge surface sweeping blades 3088 are activated to remove the discharged ink, dirt, adhered foreign matters and the like remaining on the head discharge surfaces.

Although the swept ink and the like are dropped on the ink absorbers, since at the same time the above-mentioned squeezing operation is effected, such dropped ink and the like are also squeezed from the ink absorbers to drop onto the bottom of the recovery container 3002 and are then directed to the waste ink tank. That is to say, at the same time that the ink absorbers are separated from the discharge surfaces of the heads, the residual matters remaining on the ink discharge surfaces are removed by the sweeping blades 3088 and the removed residual matters are squeezed together with the excessive ink in the ink absorbers.

The above-mentioned operation is the absorber squeezing and cleaning operation (iii). By squeezing or deforming the ink absorbers 3003, the ink absorbing ability of the ink absorbers is restored, thus preparing the next ink absorption. Each ink absorber 3003C–3003BK3 is preferably made of polyvinyl formal (PVF) which is high by water-absorbent material, and it is desirable to use material which can endure repeated usage. In the illustrated embodiment, the ink absorber is made of "Bell Eater" (registered trade mark) manufactured by KANEBOH Company in Japan. The ink absorbers from which the absorbed ink is squeezed are then abutted against the corresponding discharge surfaces of the heads again. This condition is the absorber abutting condition (iv). In the condition (ii), since the ink absorbers are substantially saturated with ink, the residual ink cannot be completely absorbed in the ink absorbers. However, in this condition (iv), since the ink absorbing ability is restored by squeezing the absorbers, the residual ink is completely absorbed by the cleaned ink absorbers abutted against the head discharge surfaces, thus completely cleaning the heads.

When the ink is discharged in the series of operations (i)–(iv) there arises a problem that the ink penetrates into the adjacent heads or is mixed with the inks in the adjacent heads as in the case of the above-mentioned idle discharge operation (b), since the ink seals 3004 (second seal members) are provided, the ink discharged from each recording head can be prevented from penetrating into the adjacent heads and being mixed with the inks in the adjacent heads, thus preventing the deterioration of the image quality.

After a series of these operations (i)–(iv) have been completed, the recovery system is returned to the capping condition (i), i.e., the stand-by condition again, thus maintaining the cleaned heads. Normally, the ink pressurization circulation operation is effected at the activation of the power source or after the long time waiting condition.

As mentioned above, by performing the recovery operation including the capping operation (a), idle discharge operation (b) and ink pressurize circulation operation (c), it is possible to prevent (recover) the distortion of the recorded image due to the poor ink discharge during the recording operation.

Next, a third seal member disposed between the head supporting member and the recovery system will be explained. In FIGS. 20, 24 and 26, a seal rubber 3012 acting as a third seal member is disposed at the outside of the above-mentioned second seal members arranged on the recovery container 3002. As shown in FIG. 25, the seal rubber 3012 has a U-shaped cross-section, whereas, the peripheral portion of the head block 3006 has a convex ridge complementary to the concave recess of the seal rubber. When the capping condition is established, the convex ridge of the head block is sealingly fitted into the concave recess of the seal rubber. With this arrangement, the discharge openings (and thereabout) of the recording heads 3001C, 3001M, 3001Y, 3001BK are maintained in the wet condition by the above-mentioned seal members 3004 and are further effectively maintained in the wet condition by the outer seal rubber 3012, thus preventing the drying of the head discharge surfaces, and the penetration of the dirt and the like more effectively.

That is to say, by providing the seal members in the minute clearances between the plural recording heads and in the clearances between the head holding member and the heads to prevent the communication between the upper portions of the heads and the atmosphere, the above-mentioned drawbacks occurred during the recording operation can be eliminated. Further, it is possible to improve the wet condition during the waiting position of the recording heads and the prevention of the drying of the heads. It was found that, when the above-mentioned clearances (between the heads and between the head holding member and the heads) is less than 5 mm, preferably less than 3 mm, the above advantages are further increased.

As mentioned above, by providing the first seal members disposed between the recording heads and the head supporting member for preventing the penetration of ink, the second seal members disposed around the recording heads between the heads and the recovery system for preventing the drying of the heads and the intermixing of the inks, and the third seal member disposed at the outside of the second seal members for preventing the drying of the heads, the discharge openings (and thereabout) of the recording heads can always be maintained in the sealed condition providing the proper wet condition during the capping position, i.e., during the non-operative or stand-by position of the heads, thus preventing the non-discharge of ink leading to the failure of the recording heads and at the same time preventing the ink adhered to the head discharge surfaces from penetrating into the electric circuits arranged in the upper portions of the heads, thereby preventing the malfunction a poor operation of the heads.

Further, with this arrangement, it is possible to completely seal the ink in the assembling and disassembling of the printer portion with respect to the ink jet recording apparatus.

As mentioned above, in the ink jet recording apparatus having the lengthened heads of multi-orifice type, by providing the first ink seal members disposed between the recording heads and the head supporting member for supporting the heads, the second ink seal members disposed between the heads and the recovery system, and the third seal member disposed between the head supporting member and the recovery system, it is possible to easily prevent the drying of the head discharge surfaces (and thereabout), the intermixing of the different color inks and the penetration of the inks into the electric circuits, thus avoiding the non-discharge of ink from the heads, the malfunction of the heads and the like.

Further, not only the contamination in the apparatus and the poor recording operation can be prevented, but also the drying of the heads can effectively and positively be avoided by providing the seal members. It was found that, when such seal members are adopted to the embodiment shown in FIG. 4, the same excellent advantages were obtained.

Next, further embodiments of the present invention will be explained with reference to the accompanying drawings. The elements having the same functions as those in various embodiments will be designated by the same reference numerals.

Figure 27:
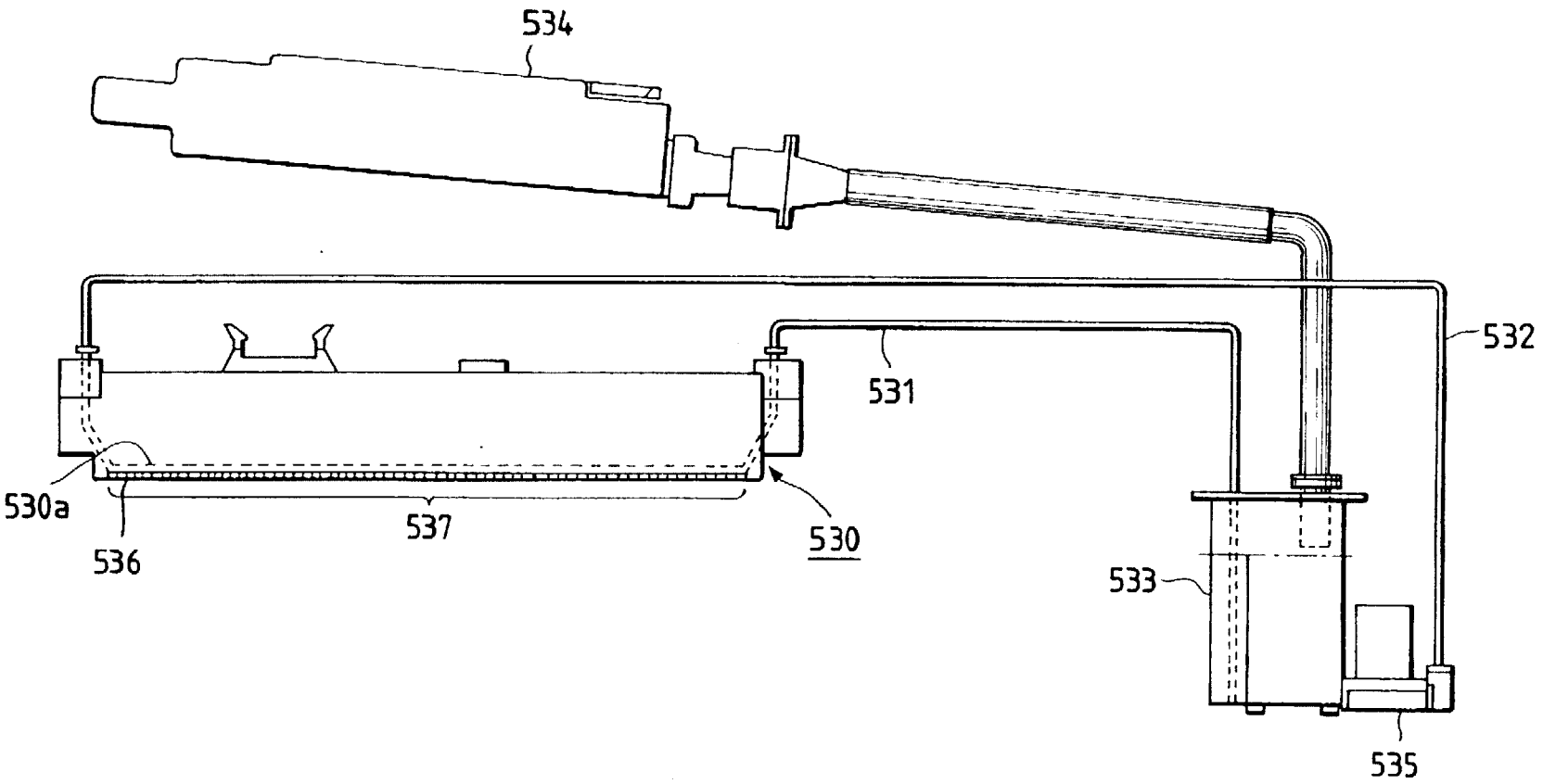
FIG. 27 is an elevational view showing an ink supply system and a head recovery system of an ink jet recording apparatus according to a further embodiment of the present invention.

In FIG. 27, the reference numeral 530 denotes a recording head of full-line type also—referred to as a "recording head" hereinafter); 530*a* denotes a common liquid chamber defined in the recording head 530, and 537 denotes a plurality of ink discharge openings arranged on an ink discharge surface 536. In the illustrated embodiment, the discharge openings 537 are disposed in correspondence with the whole recordable width of the recording medium (not shown) to be treated, and, by selectively energizing the heat generating elements disposed in the liquid passages (not shown) communicating with the corresponding discharge openings 537 the ink is discharged from the associated discharge openings, so that the recording can be effected without the scanning movement of the recording head itself. The reference numeral 533 denotes an ink supply tank for reserving the ink to be supplied to the recording head 530; and 534 denotes an ink cartridge for replenishing the ink to the supply tank 533. This ink cartridge serves to supply the ink from the ink supply tank 533 to the common liquid chamber 530*a* of the recording head 530 via a supply tube (first ink path) 531, and, when replenishment of the ink is required, the ink is fed to the ink supply tank 533 from the ink cartridge 534 by the use of the "chicken feed" principle. The reference numeral 535 denotes a recovery pump used with the recovery operation effected for recovering the discharging ability of the recording head 530, which recovery pump 535 is communicated with the recording head 530 via a circulating tube (second ink path) 532. The length of the supply tube 531 is half the length of the circulating tube 532, and an inner diameter of the supply tube 531 is the same as that of the circulating tube 532. With this arrangement, the friction loss water head the supply tube 531 will be half of that of the circulating tube 532.

In the recording head 530 and its ink supply system and recovery system so constructed, during the recording operation, the ink is fully replenished, by its own weight, from the ink supply tank 531 to the common liquid chamber 530*a* and is then directed from the common liquid chamber 530*a* to the ink discharge openings 537 via liquid passages (not shown). Further, in the recovery operation effected for removing the bubbles remaining in the common liquid chamber 530*a* and in the ink supply system and for cooling the recording head 530, the recovery pump 535 is activated to send the ink to the common liquid chamber 530*a* through the circulating tube 532 and return the ink from the common liquid chamber 530*a* to the ink supply tank 533 via the supply tube 531, thus circulating the ink. Furthermore, in the initial filling of the ink to the liquid passages and the like, the ink is forcibly sent to the common liquid chamber 530*a* through the circulating tube 532, thus discharging the ink together with the bubbles from the ink discharge openings 537.

In the illustrated embodiment, since the friction loss water head of the supply tube 531 is half that of the circulating tube 532, during the recording operation, the ink in the ink supply tank 533 is apt to be directed to the recording head 530 via the supply tube 531. As a result, the amount of the ink directed to the recording head 530 via the supply tube 531 can adequately replenish an amount of ink discharged from the recording head 530, thus avoiding the insufficient supply of ink.

Figure 28:
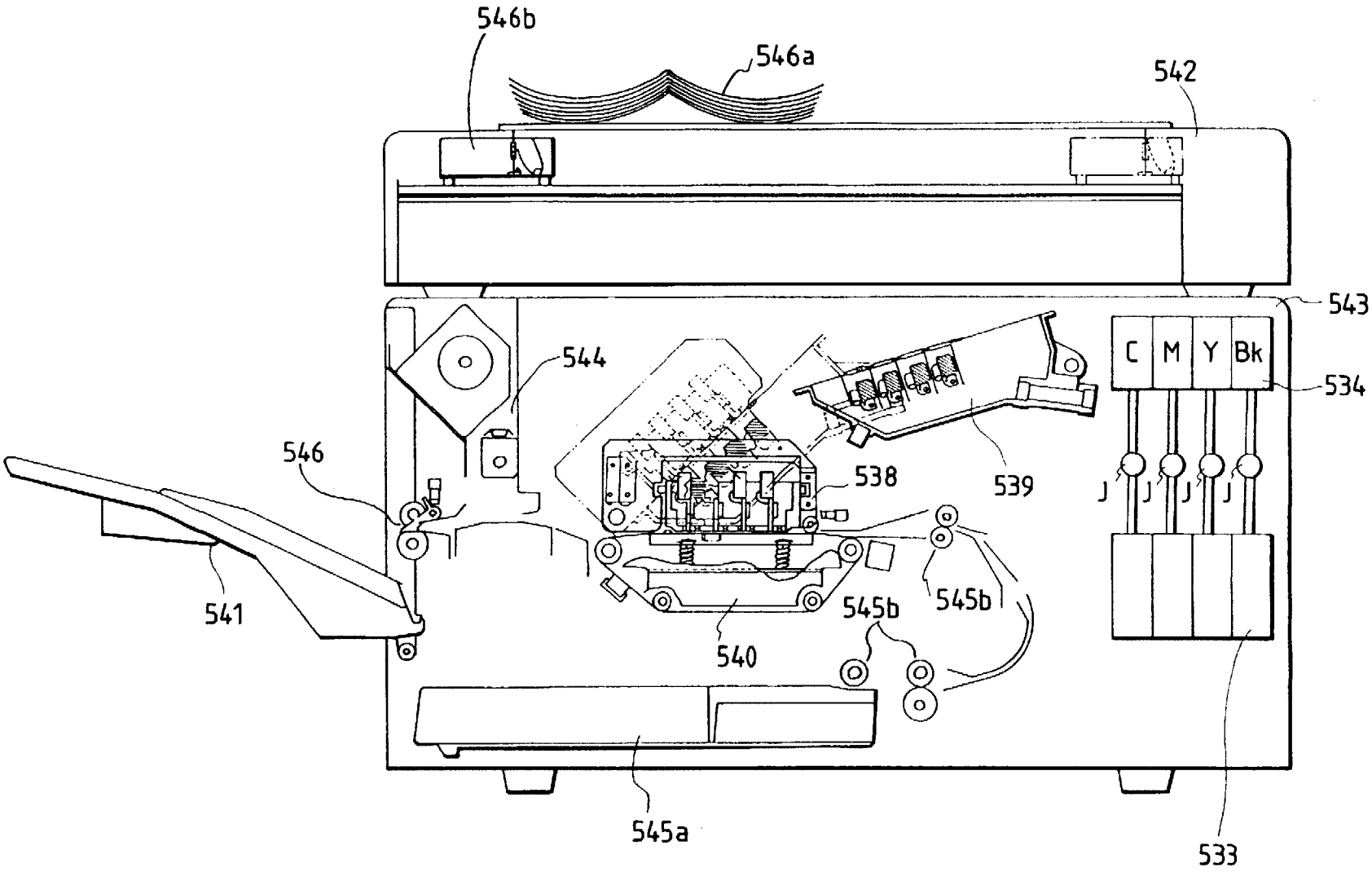
FIG. 28 is a schematic sectional view of the ink jet recording apparatus of FIG. 27.

Next, the ink jet recording apparatus including the above-mentioned ink supply system and recovery system will be explained with reference to FIG. 28.

The reference numeral 542 denotes a scanner portion for reading information on an original 546*a* to be copied and for converting the information into an electric signal which is sent to a recording head portion 538 of a printer portion 543 as a drive signal. The recording paper (recording medium) contained in a sheet supply cassette 545*a* is supplied one by one to a belt conveying portion 540 by means of a conveying means 540*a* at need. As the recording paper is passing through the belt conveying portion 540, the image is recorded on the recording paper by means of the recording head portion 538, and, thereafter, the recording paper is sent to an ejector tray 541 through a fixing and ejecting portion 544. A recovery cap portion 539 serves to maintain a condition that the recording head portion 538 can always perform the recording operation. On the other hand, four ink cartridges 534 containing cyan color ink, magenta color ink, yellow color ink and black color ink, respectively, are provided, from which the respective color inks are supplied to the recording head portion 538 through corresponding ink supply tanks 533. Incidentally, the reference numeral 546*b* denotes a reading means.

Figure 29:
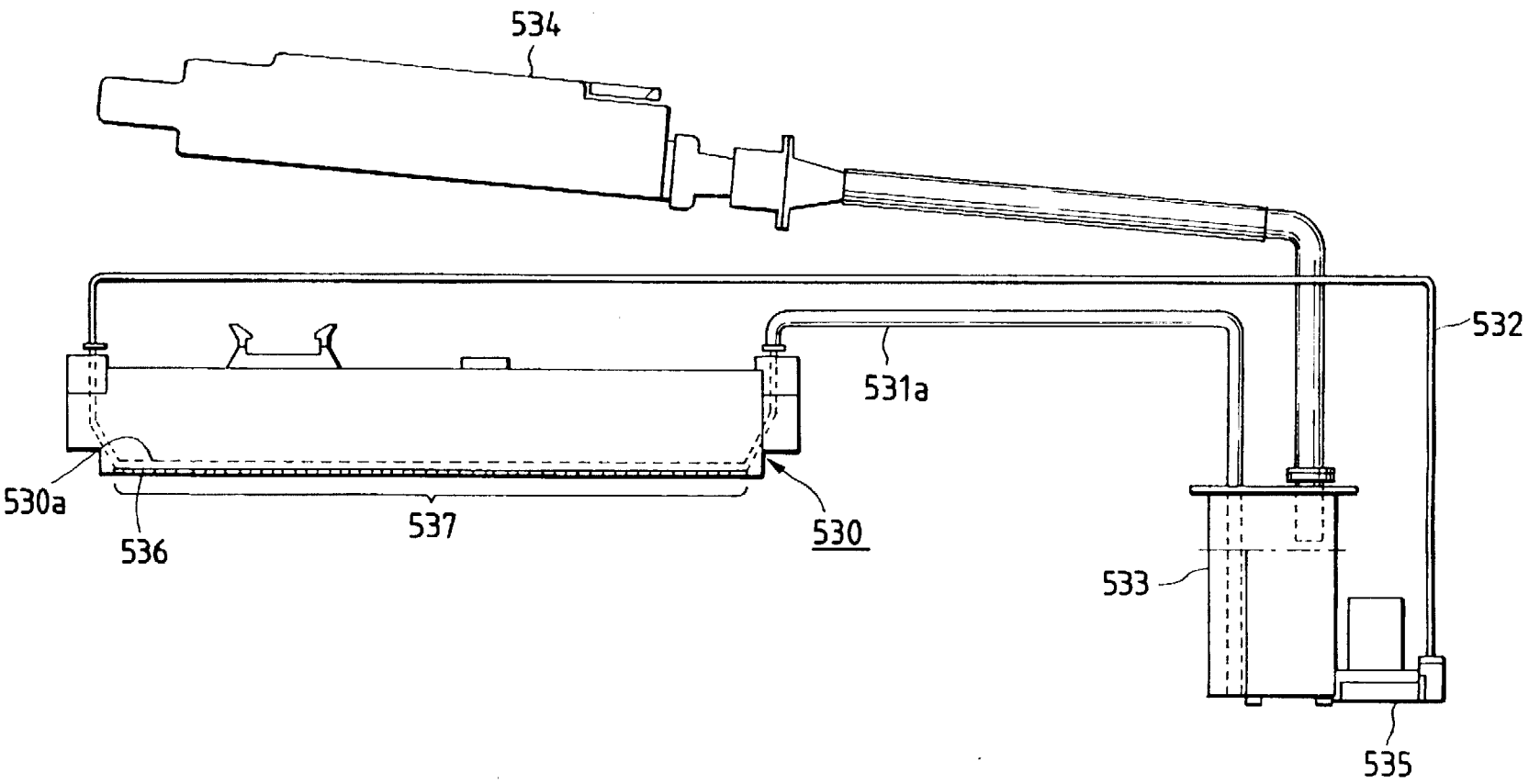
FIG. 29 is an elevational view showing an ink supply system and a head recovery system according to another embodiment.

In the illustrated embodiment, as shown in FIG. 29, the inner diameter of the supply tube 531*a* is about twice that of the circulating tube 532; other constructions are the same as that of the previous embodiment.

In the illustrated embodiment, since the friction loss water head of the supply tube 531*a* becomes about ¼ of that of the circulating tube 532, during the recording operation, the amount of ink directed from the ink supply tank 533 to the recording head 530 through the supply tube 531*a* can adequately replace the ink amount discharged from the recording head 530, thus preventing the insufficient supply of ink.

As mentioned above, while an ink jet recording apparatus having four ink supply tanks was explained, the present invention is not limited to this, but may be applied to an ink jet recording apparatus having only one ink supply tank.

Now, the friction loss water head (pressure loss head) h of the tube is generally represented by the following equation:

$$h=\lambda(l/d)\times(V^2/2g) \quad (1)$$

Where, λ is the friction coefficient of the tube, l is a length of the tube, d is an inner diameter of the tube, V is a flow rate (speed) of the liquid (ink), and g is the gravitational acceleration.

In the aforementioned embodiment, by setting the length of the first ink path to be shorter than the length of the second ink path or by setting the inner diameter of the first ink path to be greater than that of the second ink path, the friction loss water head of the first ink path is so selected as to be smaller than that of the second ink path, on the basis of the above equation (1). Thus, during the recording operation, the ink in each ink supply tank is apt to be introduced into the corresponding recording head through the first ink path, whereby the amount of the introduced ink can adequately replace the ink amount discharged from the recording head. Accordingly, even if the recording heads of full-line type consuming a large amount of ink are used, an insufficient ink supply can be avoided.

It was found that, when such an ink supply system is adopted to the embodiment shown in FIG. 4, the same excellent advantages are obtained.

In this way, during the recording operation, since the amount of ink introduced into each recording head through the first ink path can adequately replace the ink amount discharged from the recording head, even when recording heads of full-line type consuming a large amount of ink are used, it is possible to prevent the insufficient supply of ink, thus avoiding the reduction in the ink discharge response and/or the ink discharge stability.

Next, a still further embodiment of the present invention will be explained with reference to the accompanying drawings.

Figure 30:
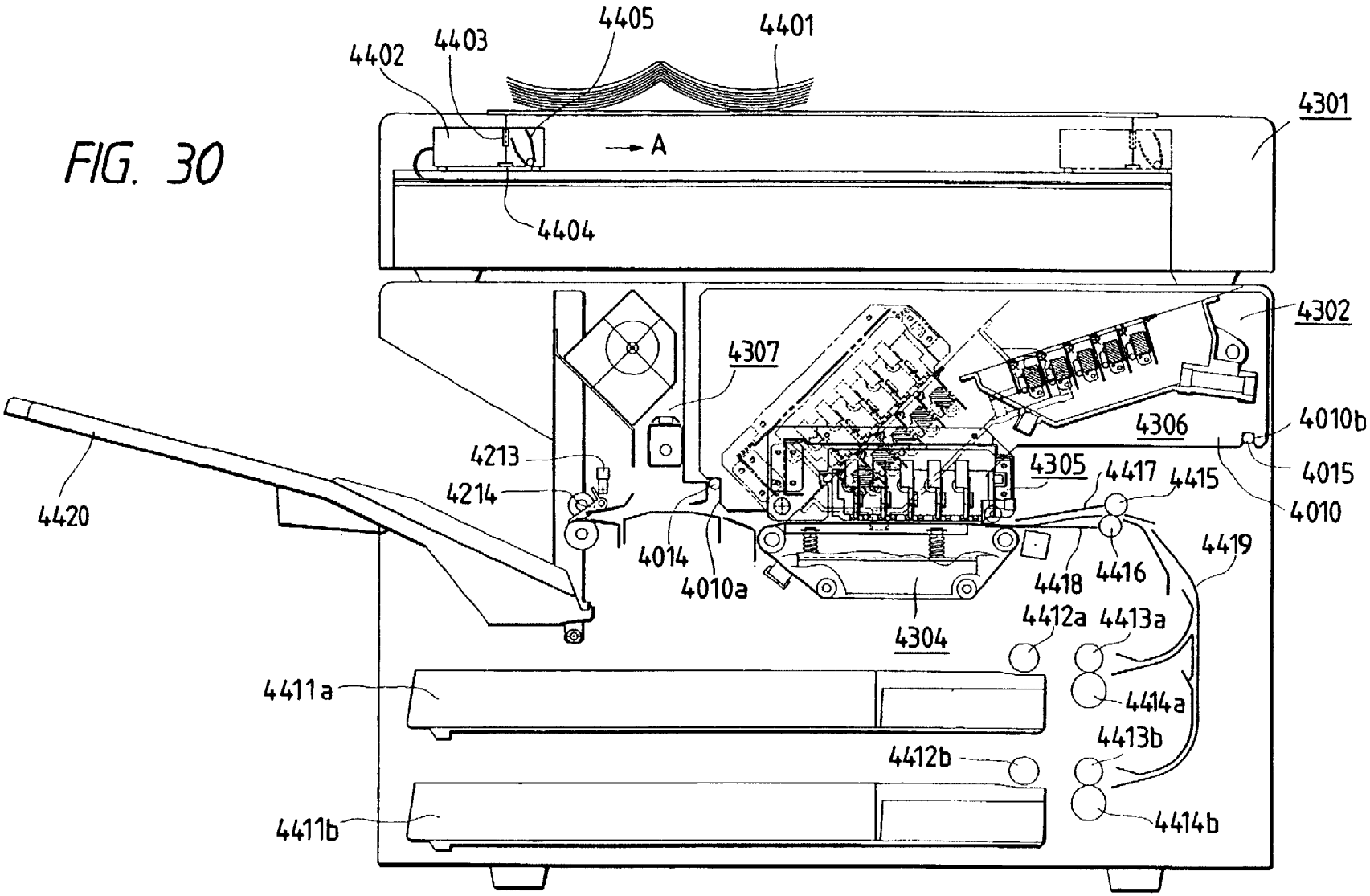
FIG. 30 is a schematic sectional view of an ink jet recording apparatus according to a still further embodiment of the present invention.

FIG. 30 is a sectional view of an ink jet recording apparatus according to the still further embodiment of the present invention. First of all, the summary of the ink jet recording apparatus according to the illustrated embodiment will be described with reference to FIG. 30. In FIG. 30, the reference numeral 4301 denotes a scanner portion for reading information on an original and for converting the information into an electric signal. A signal based on the electric signal converted in the scanner portion is sent to a recording head portion 4305 of a printer portion 4302 as a drive signal. The recording paper (recording medium) contained in a sheet supply portion 4411*a,b* is supplied one by one to a belt conveying portion 4304 as needed. As the recording paper passes through the belt conveying portion 4304, the image is recorded on the recording paper by means of the recording head portion 4305, and, thereafter, the recording paper is sent to an ejector tray 4420 through a fixing and ejecting portion 4307. A recovery cap portion 4306 serves to maintain a condition that the recording head portion 4305 can always perform the recording operation.

Figure 31A:
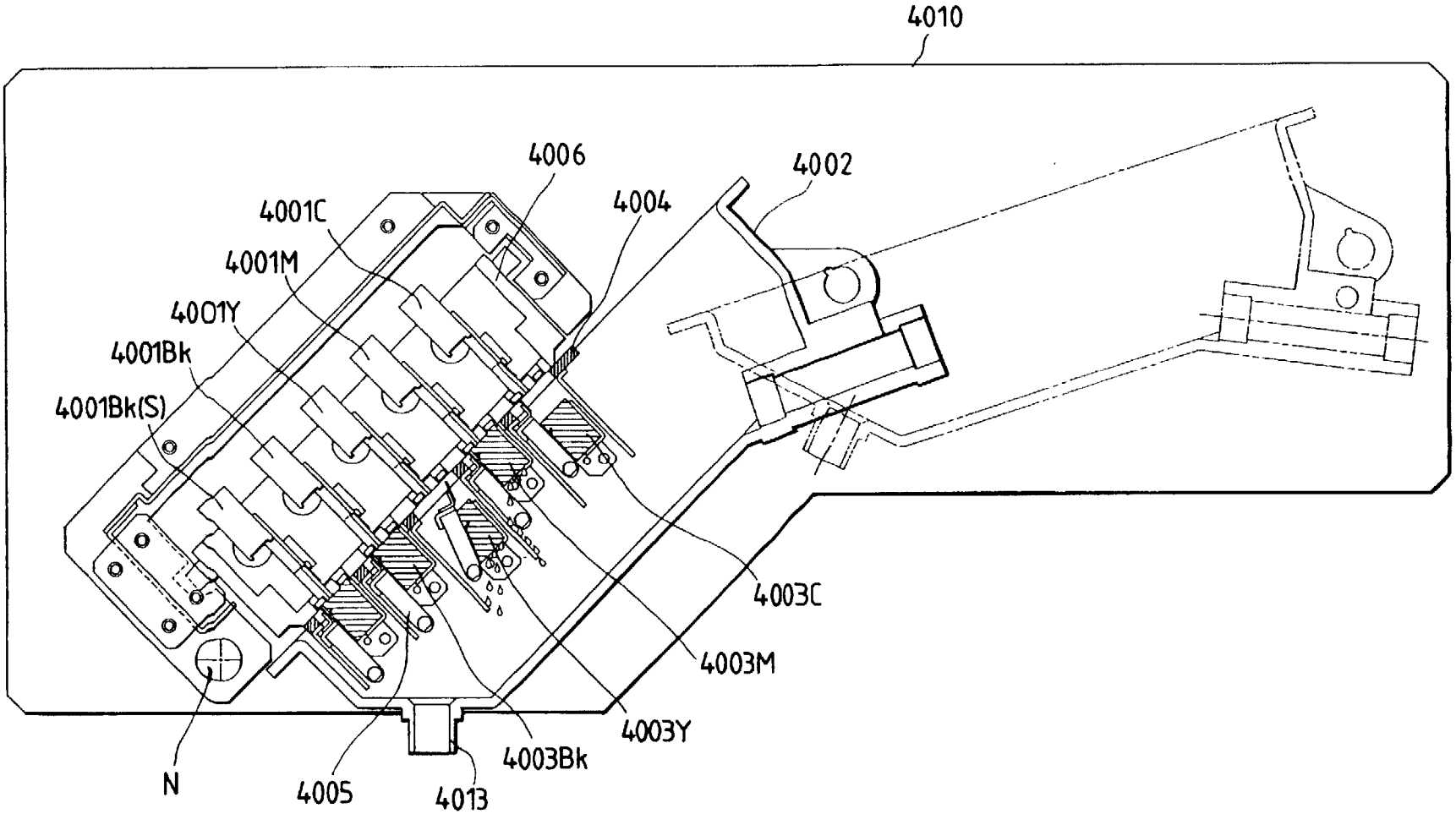
FIGS. 31A and 31B are sectional views of a head recovery system shown in FIG. 30.
Figure 31B:
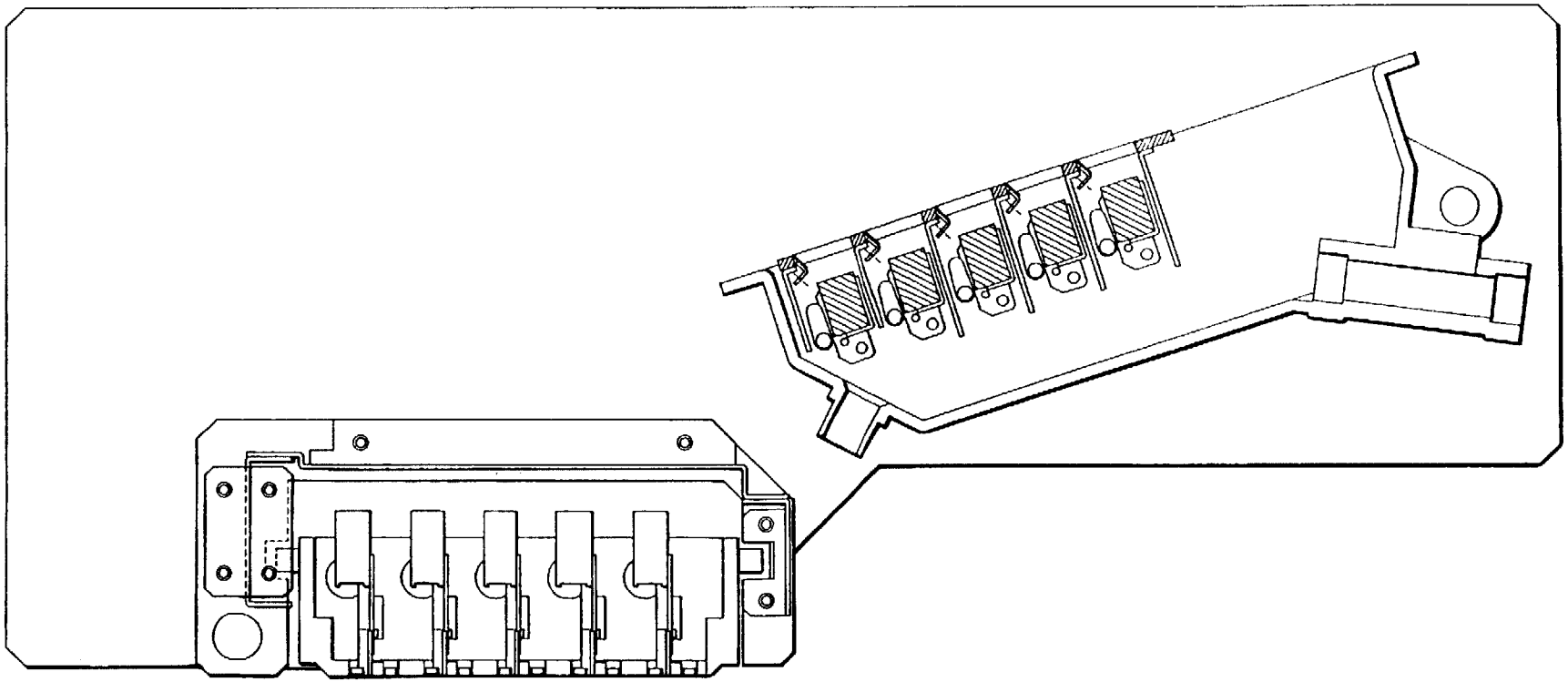

FIGS. 31A and 31B schematically show, in section, a main part of the printer portion of the ink jet recording apparatus according to this embodiment.

Now, the condition of the recording heads in the recovery operation will be described with reference to FIG. 31A.

The reference numerals 4001C, 4001M, 4001Y, 4001BK and 4001BK(s) denote ink jet recording heads to which cyan color ink, magenta color ink, yellow color ink, black color ink and black color ink are supplied, respectively. The recording heads are fixedly attached to a head block 4006 with high accuracy, so that the desired parallelism of each head and the desired distance between the heads can be ensured with the satisfactory accuracy.

In the vicinity of the discharge openings of the recording heads 4001C, 4001M, 4001Y, 4001BK, 4001BK(s), ink absorbers 4003C, 4003M, 4003Y, 4003BK, 4003BK(s) for absorbing the ink are disposed in correspondence to the associated discharge openings of the heads. The ink absorbers 4003C, 4003M, 4003Y, 4003BK and 4003BK(s) are supported by corresponding guides 4007 so that they can be moved toward and away from the discharge surfaces of the corresponding recording heads 4001C, 4001M, 4001Y, 4001BK and 4001BK(s).

In FIG. 31A, the ink absorbers 4003M, 4003BK and 4003BK(s) are shown to be engaged by the discharge surfaces of the corresponding recording heads 4001M, 4001BK and 4001BK(s); whereas, the ink absorbers 4003C and 4003Y are shown to be disengaged from the discharge surfaces of the corresponding recording heads 4001C and 4001Y. Partition plates 4008 are arranged between the adjacent ink absorbers. Further, ink seals 4004 are disposed between the partition plates 4008 and the head block 4006 to prevent the intermixing of the different color inks. In the vicinity of the ink absorbers, there are disposed corresponding ink squeezing members 4005 which can be driven by corresponding levers (not shown) to squeeze the ink absorbed in the ink absorbers 4003C, 4003M, 4003Y 4003BK and 4003BK(s). FIG. 31A shows a condition that the ink is squeezed from the ink absorber 4003Y relating to the recording head 4001Y regarding the yellow color by the corresponding squeezing member 4005.

The head block 4006 to which the recording heads 4001C, 4001M, 4001Y, 4001BK, 4001BK(s) are fixed is removably inserted into a block stay 4009 through a rail 4015. Further, the block stay 4009 can be rotated around an axis N together with the head block 4006 and the recording heads.

The recovery container 4002 can be shifted by a shifting mechanism (not shown) from the recovery operation condition shown in FIG. 31A to the retracted position shown by the two-dot and chain line. A waste ink opening 4013 is formed in the bottom of the recovery container 4002. The ink discharged from the recording heads 4001C, 4001M, 4001Y, 4001BK, 4001BK(s) and absorbed by the ink absorbers 4003C, 4003M, 4003Y, 4003BK, 4003BK(s) and then squeezed from the ink absorbers is exhausted from the recovery container 4002 through the waste ink opening 4013 and is then directed to a waste ink tank (not shown) via a waste ink hose (not shown).

FIG. 31B is a schematic sectional view showing a condition that the recording heads are under during the recording operation (during the recording). After the recovery container 4002 has been shifted from the position of FIG. 31A to the retracted position (shown by the two-dot and chain line in FIG. 31A), the recording heads are rotated to a horizontal position. In this condition, the ink is discharged from the corresponding recording head in response to the image (recording) signal, thereby forming the image on the recording paper (recording medium) being conveyed while being spaced apart from the discharge surfaces of the recording heads by a predetermined distance.

Figure 32A:
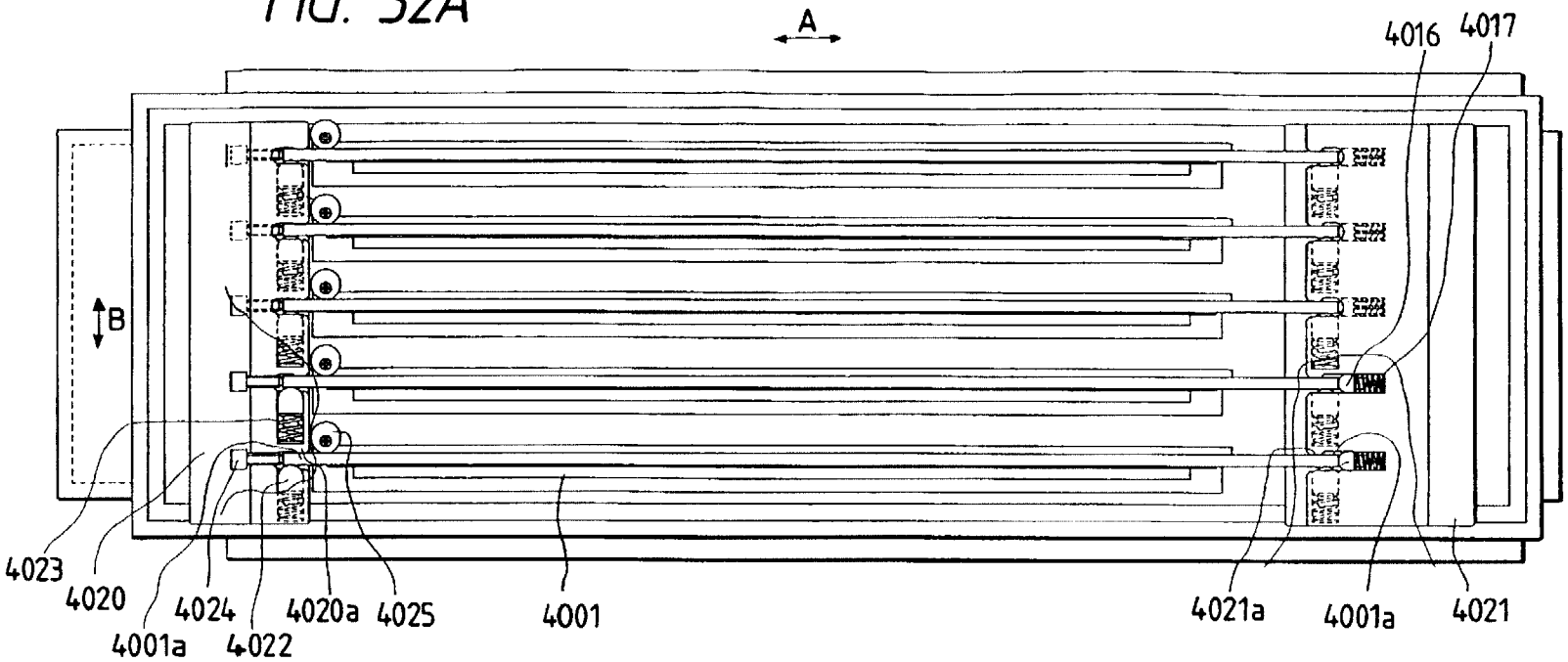
FIGS. 32A and 32B are a schematic plan view and an elevational sectional view for explaining a mechanism for positioning and fixing the recording head.
Figure 32B:
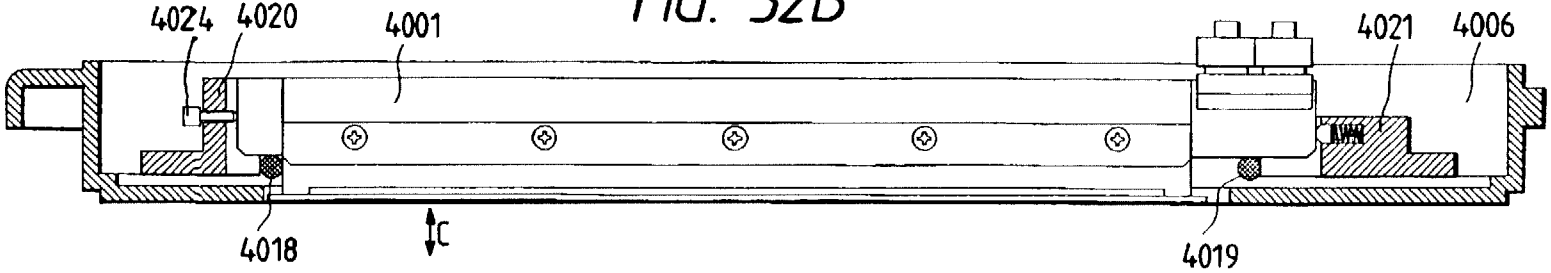

FIG. 32A and 32B are schematic explanatory views for explaining a mechanism for positioning and fixing the recording heads, where FIG. 32A is a schematic plan view and FIG. 32B is a schematic elevational sectional view.

In FIG. 32A, the reference numerals 4020, 4021 denote head fixing members. By inserting abutment portions 4001*a* formed on both ends of each head 4001 into corresponding abutment recesses formed in the fixing members 4020, 4021, respectively, the position of each head in directions shown by the arrows A and B in FIG. 32A is determined; whereas, the position of each head in an up-and-down direction (direction shown by the arrow C in FIG. 32B) is determined by positioning shafts 4018 and 4019. Each head inserted into the head fixing members 4020, 4021 is positioned and fixed in place by urging the head end portions against abutment portions 4020*a* and 4021*a* of the fixing members 4020, 4021 by means of urging pins 4022 biased by corresponding springs 4023. Adjustment screws 4024 are used to adjust the positions of the corresponding heads in the direction A in FIG. 32A, i.e., a direction perpendicular to the recording paper feeding direction (referred to as "left margin" hereinafter). The reference numeral 4025 denotes eccentric rollers for adjusting the corresponding heads in an inclined direction. In FIG. 32A, by displacing the abutment portion 4001*a* of the head by an eccentric amount obtained by rotating the eccentric roller 4025, the position of the head can be adjusted in the direction B, whereby each head can be adjusted independently from others.

With this arrangement, it is easy to adjust the attachment positions of the heads. Therefore, it is possible to easily correct any discrepancy is the images recorded with the respective colors, thus permitting image recording of higher quality.

Figure 33:
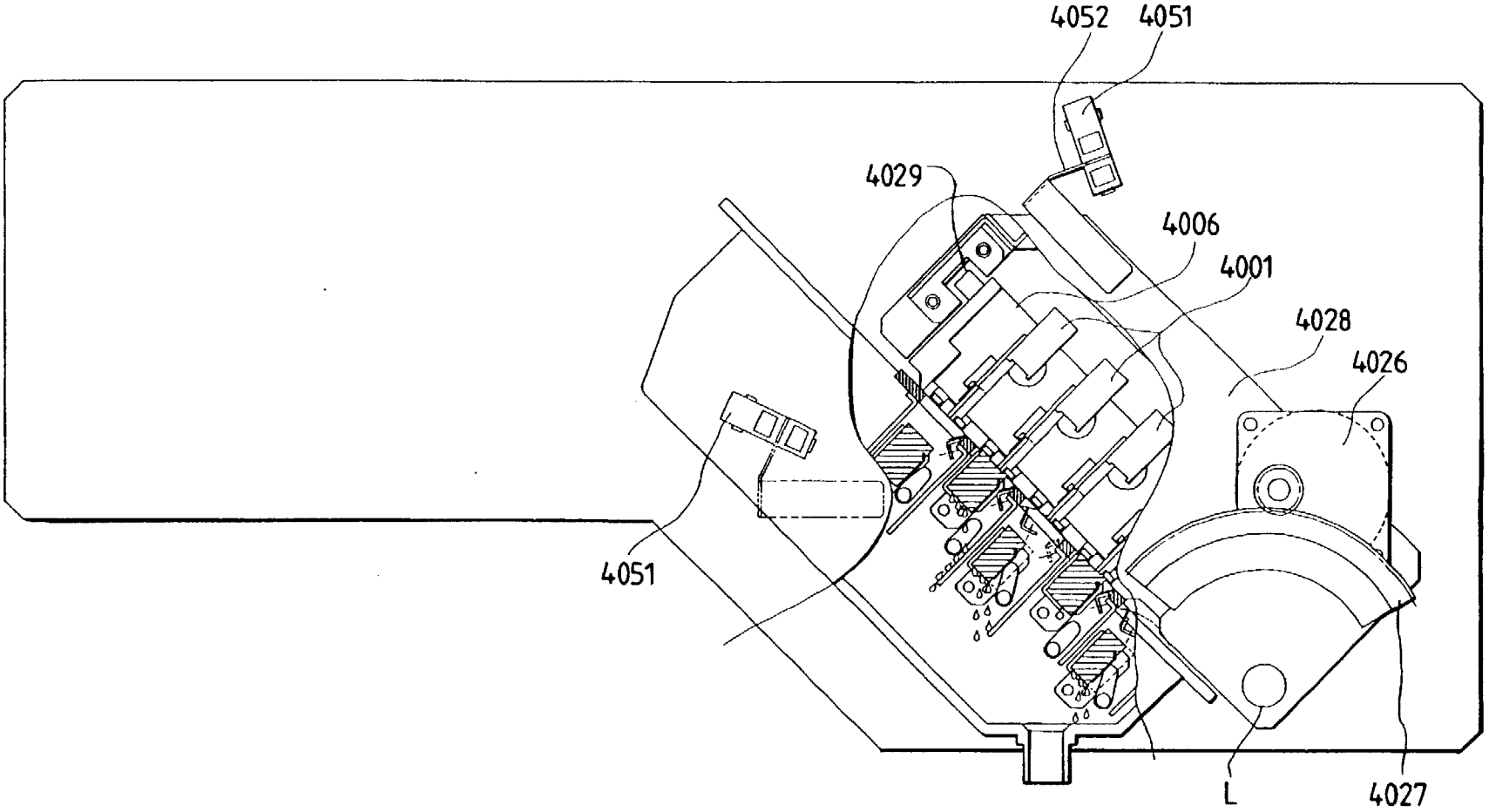
FIGS. 33 is a schematic view for explaining a driving mechanism for the recording head.

Next, a mechanism for shifting the head portion will be explained with reference to FIG. 33 showing a schematic sectional view of the printer portion. Incidentally, FIG. 33 is a view from the opposite side with respect to FIGS. 32A and 32B.

A driving force obtained from a head unit driving motor 4026 is transmitted to a head frame 4028 through a gear 4027. The head frame 4028 can be rotated in a direction shown by the arrow in FIG. 33 around an axis L. The head frame 4028 is provided with a rail 4029 for mounting and dismounting the head block, by which the head block 4006 on which the heads 4001 are positioned and fixed can be removed or exchanged together with the recording heads 4001.

Figure 41D:
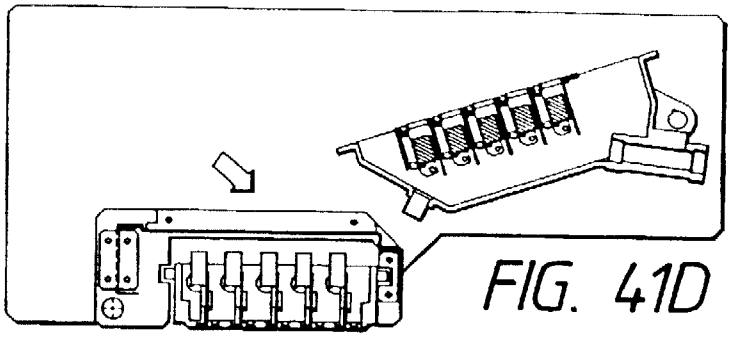
FIGS. 41A to 41F are sectional views showing a sequence of operation of the head recovery system of FIG. 12 from a stand-by condition to a print permitting condition.

The mounting (insertion) and dismounting of the head block 4006 is effected at a position where the head frame 4028 is overlapped with a notch (not shown) formed in the front side plate of the unit. The head frame 4028 can be stopped at the following four positions: (i) recovery position, (ii) recording position, (iii) retracted position and (iv) head unit mounting and dismounting position. FIGS. 41A and 33B show the recovery position (i). As will be described later referring to FIGS. 41B and 41E, the retracted position (iii) is a position where the head portion 4305 is retracted when the recovery container 4002 is shifted, and the recording position (ii) corresponds to a head down position which will be described later referring to FIG. 41D.

In the illustrated embodiment, it is so designed that the retracted position (iii) is identical with the head unit mounting and dismounting position (iv). These positions are correctly detected by the fact that a light-shield plate 4052 (FIG. 33) formed on the head frame 4028 shields or blocks detecting portions of sensors 4051 disposed in correspondence to these positions.

Figure 34A:
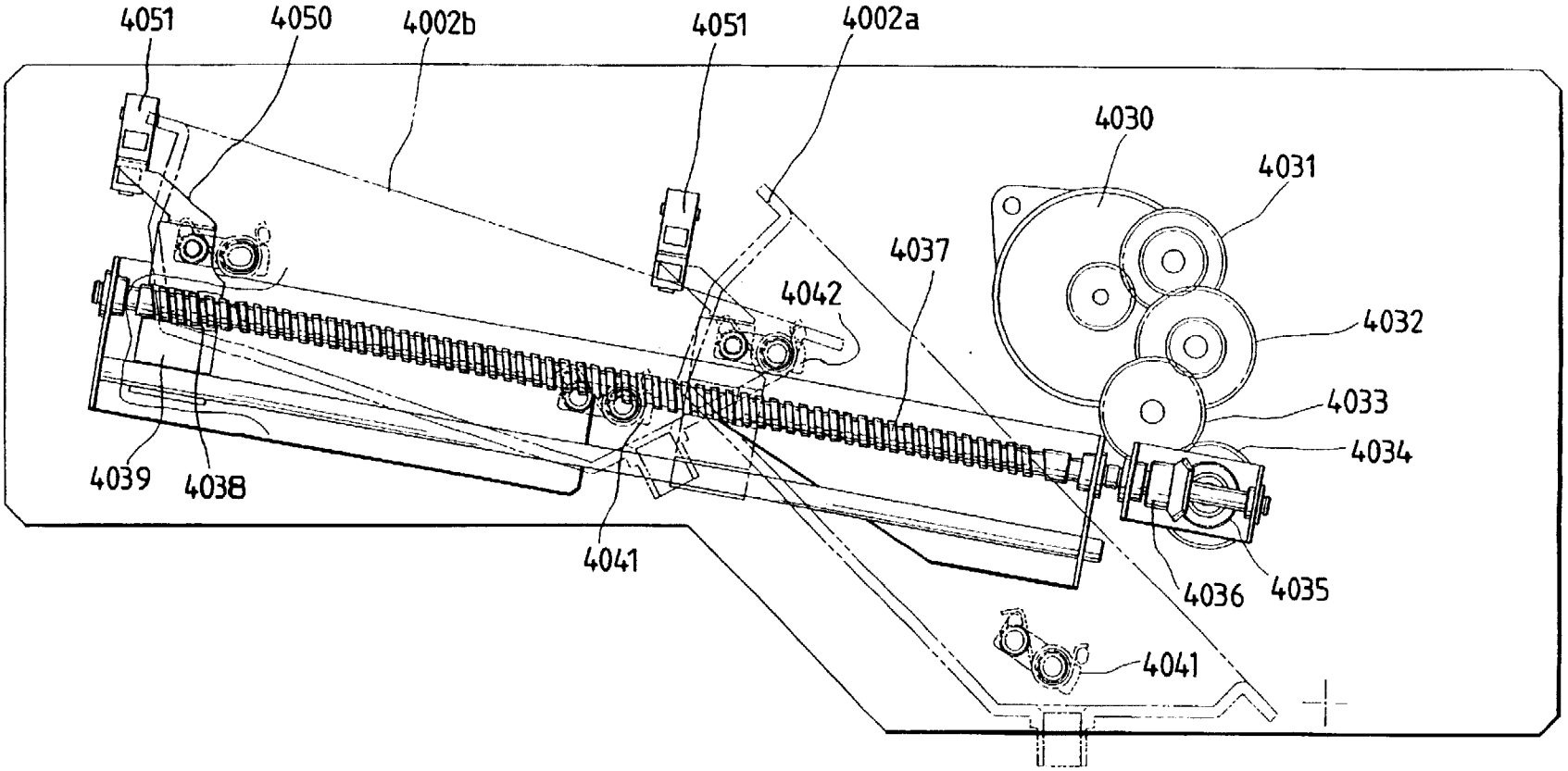
FIGS. 34A, 34B and 34C are schematic views for explaining a driving mechanism for the head recovery system.
Figure 34B:
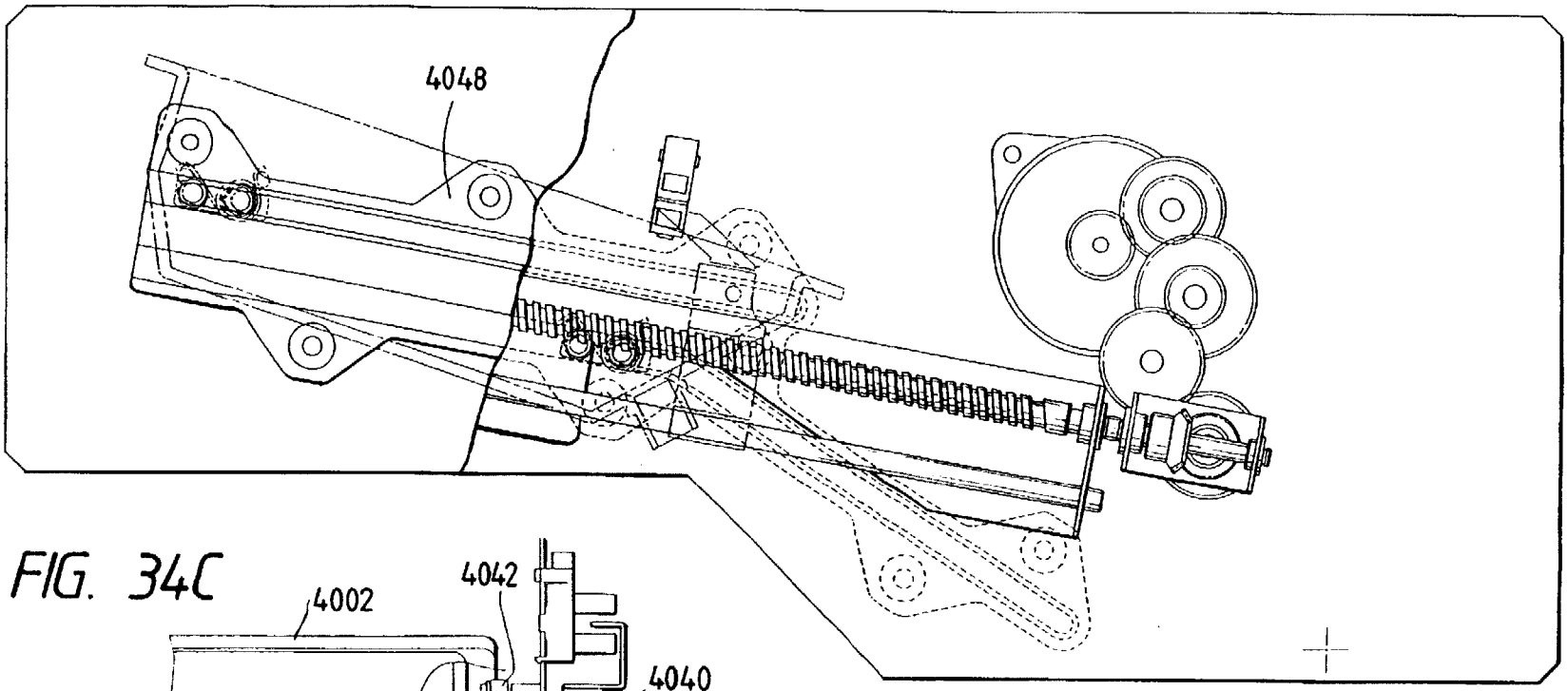
Figure 34C:
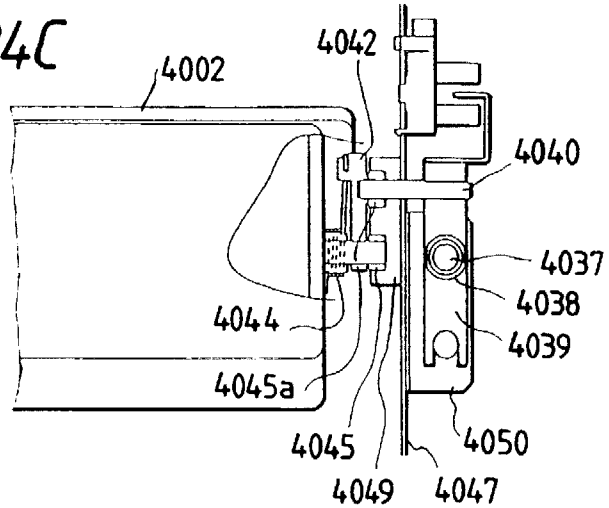

FIGS. 34A and 34B are schematic side views for explaining a driving mechanism for the head recovery system, looked at from the same side as FIG. 33. FIG. 34C is a schematic enlarged view of the left part of the recovery system driving mechanism shown in FIG. 34A, looked at from the back side.

In FIGS. 34A to 34C, a driving force from a recovery system driving motor 4030 is transmitted to a driving screw 4037 through a gear train 4031–4036. The driving screw 4037 serves to convert the driving force transmitted from the motor 4030 into a linear motion to shift a screw nut 4038 engaged by the screw, thereby shifting the recovery container 4002 from the recovery position or capping position to the retracted position. A nut holder 4039 engaged by the screw nut 4038 is connected to the recovery container 4002 by means of a connecting pin 4040 so that the recovery container 4002 can be reciprocally shifted at the activation of the motor 4030. Further, the recovery container 4002 is provided at its front and rear sides with two arm portions 4041, 4042, respectively (ones at the other side are not shown) which are rotatably supported with respect to the recovery container 4002. The arm portion 4042 has rollers 4045 (one at the other side is not shown) rotatably supported with respect to the arm portion. On the other hand, in opposed relation to the arm portion 4042 of the recovery container 4002, rollers 4045*a* are disposed on unit side plates 4047 (both ones at the other side are not shown). Incidentally, regarding the arm portion 4041, similar rollers 4045, 4045*a* are arranged. Further, on both sides of the recovery container 4002, there are arranged rails 4048, 4049 each having grooves by which the rollers are engaged during the reciprocal movement of the recovery container 4002.

Torsion coil springs 4044 provided on the arm portions 4041, 4042 serve to bias the rollers into the grooves of the rails. The rotation force of the motor 4030 is transmitted to the arm portions 4041, 4042 via the gear train 4031–4036, screw 4037, nut 4038, nut holder 4039 and connecting pin 4040 and is converted into the reciprocal movement of the recovery container 4002. In this cases since the rollers 4045, 4045*a* rotatably mounted on the arm portions 40417 4042 are biased into the grooves of the rails 4048, 4049 by means of the coil springs 4044, these rollers can be shifted in and along the grooves without play.

Therefore, the recovery container 4002 can be shifted along a desired path or trace on the basis of the shapes of the rails 4048, 4049.

In this way, since the plural rollers for shifting the container 4002 are associated with each arm portion, the load from the container 4002 is dispersed, thus permitting the smooth movement of the recovery container 4002. Further, since the arm portions and the rollers are provided on both sides of the container 4002, the driving force can be transmitted smoothly and effectively from the motor to the container by means of only one screw. The recovery container 4002 can be stopped at the recovery position 4002*a* and the retracted position 4002*b*, and these positions are correctly detected by the fact that a shield plate 4050 attached to the nut holder 4039 blocks detecting portions of sensors (photo-interrupters) 4051 disposed in correspondence to these stop positions.

Figure 35A:
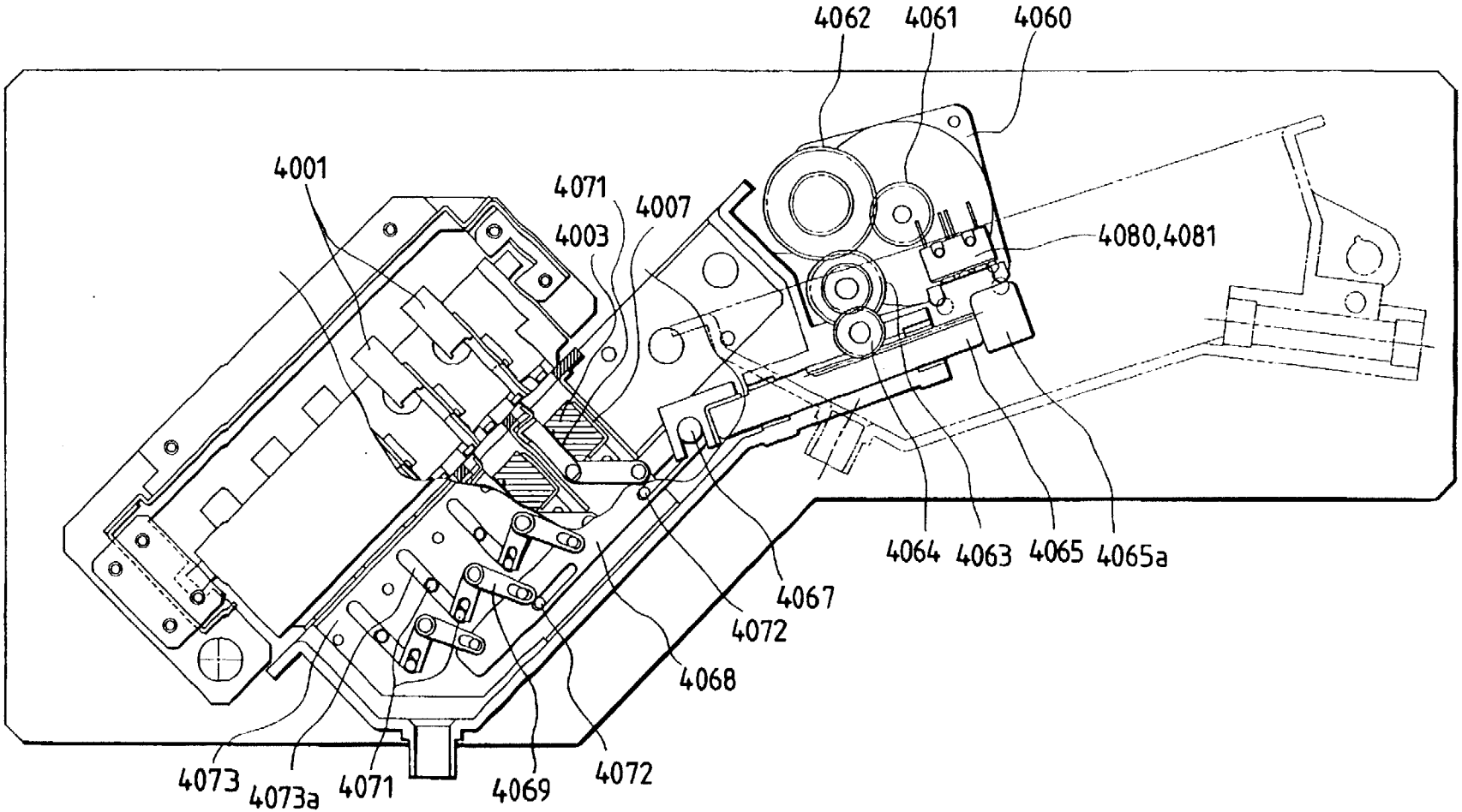
FIGS. 35A and 35B are schematic views for explaining a driving mechanism for driving a cap of the head recovery system.
Figure 35B:
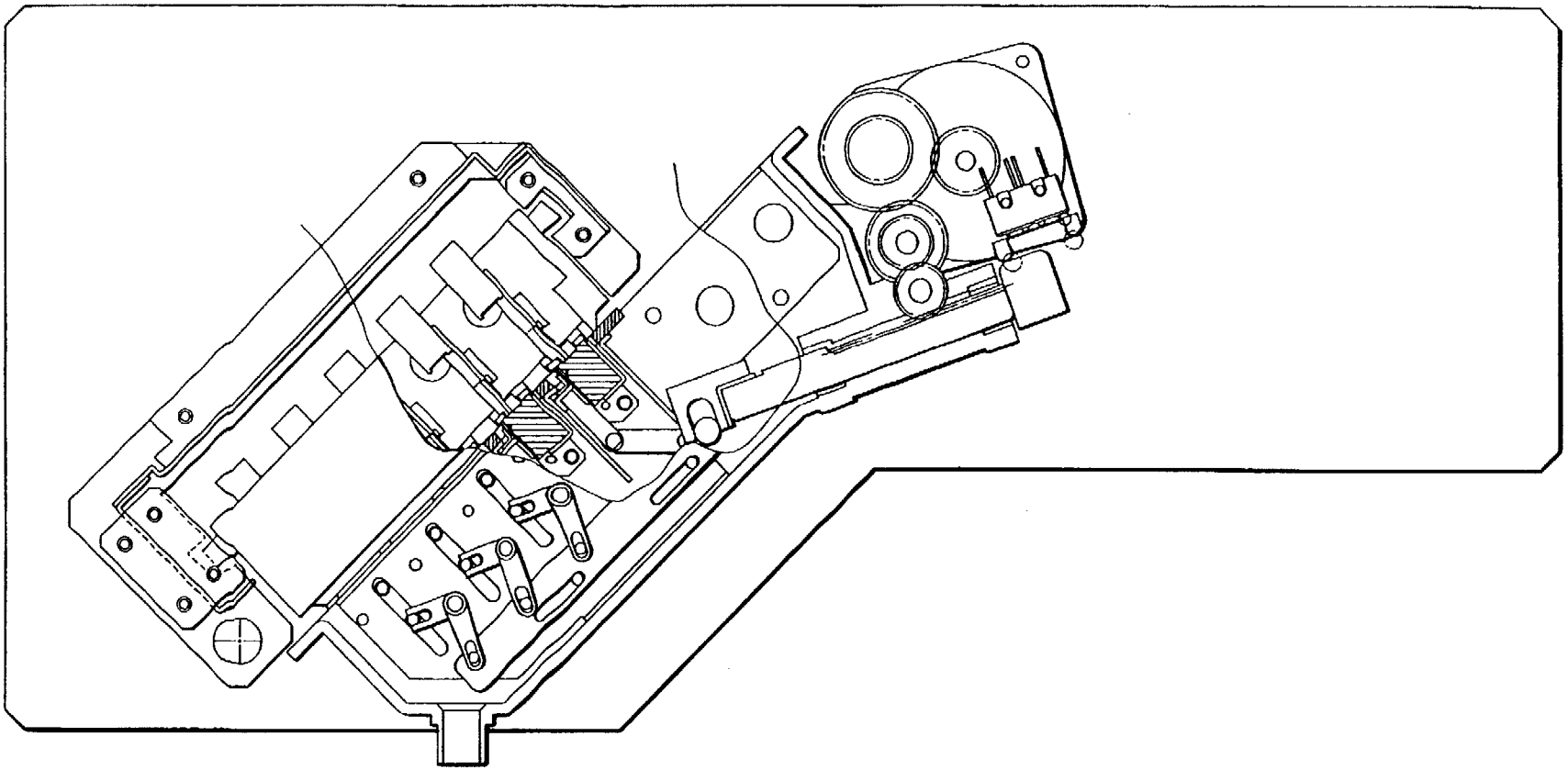

Next, the recovery operation mechanism for performing the capping operation, idle discharge operation, ink pressurization circulation operation and the like by using the cap will be explained. FIGS. 35A and 35B are schematic side views for explaining the cap driving portion of the recovery system according to the present invention, where FIG. 35A shows a condition that the ink absorbers are disengaged from the discharge surfaces of the recording heads and FIG. 35B shows a condition that the ink absorbers are engaged by the head discharge surfaces.

A driving force from a cap driving motor 4060 is transmitted to a rack shaft 4065 via a gear train 4061–4064 and hence to a cap driving slide arm 4068 via members 4066, 4067. The slide arm 4068 can be shifted along slide pins 4072.

The reciprocal motion of the slide arm 4068 is converted into the up-and-down movement of the absorber guides 4007 through rocker arms 4069 for lifting and lowering the cap. Each ink absorber guided by the corresponding absorber guide 4007 is sandwiched by absorber stoppers 4071, and the slide pins 4071' provided at front and rear end portions can be shifted in an up-and-down direction along guide portions 4073*a* formed in side plates 4073 of the cap. With this arrangement, the driving force from the motor 4060 is transmitted as a driving force for causing engagement and disengagement of the ink absorbers 4003 with respect to the discharge surfaces of the heads 4001. Further, such engagement and disengagement are ascertained by detecting a position of a detection member 4065*a* attached to the rack shaft 4065 by means of microswitches 4080, 4081 arranged on the recovery container 4002.

Figure 36:
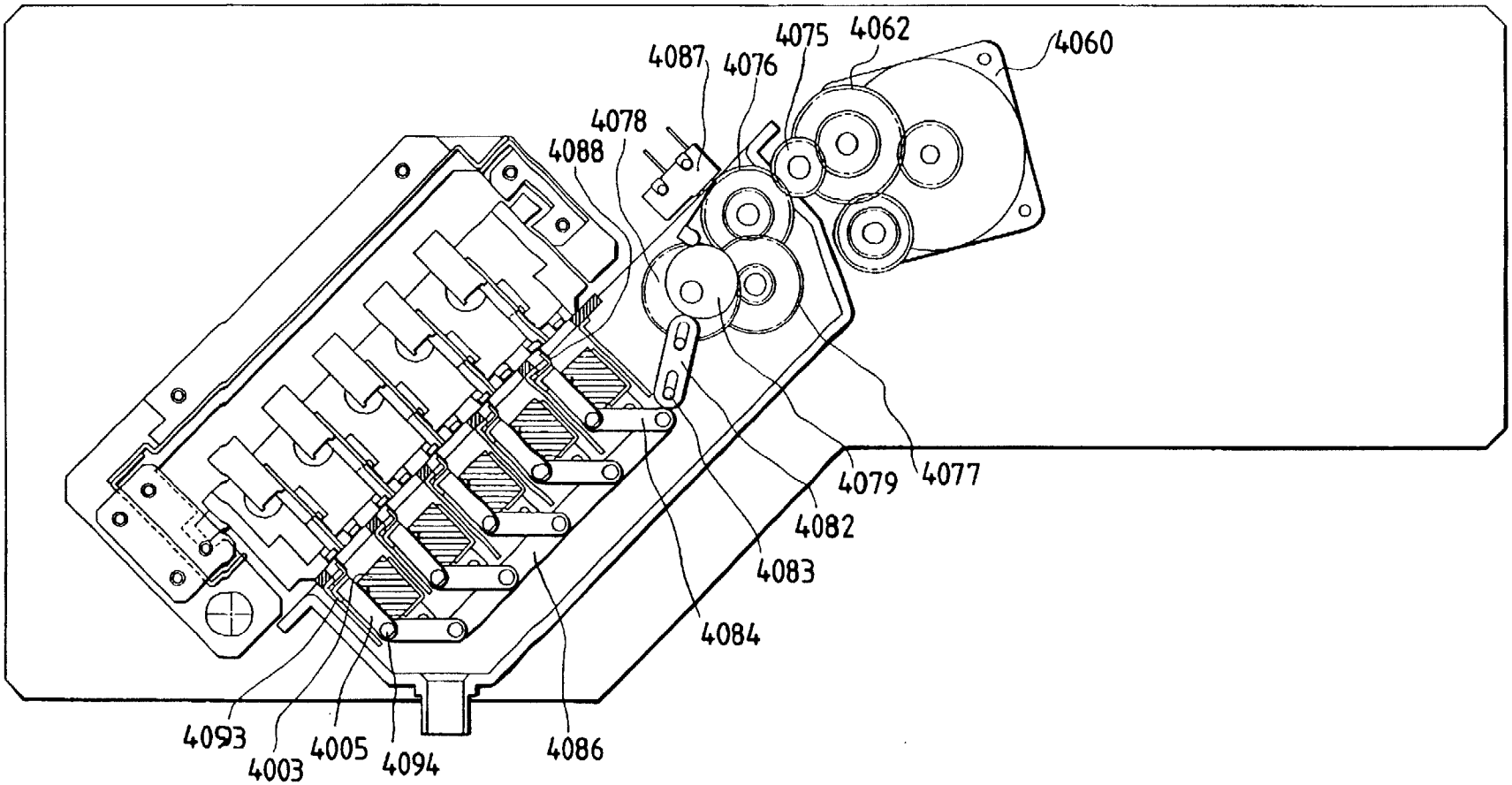
FIGS. 36 and 37 are partial sectional views showing an ink absorber squeezing drive mechanism of the head recovery system.
Figure 37:
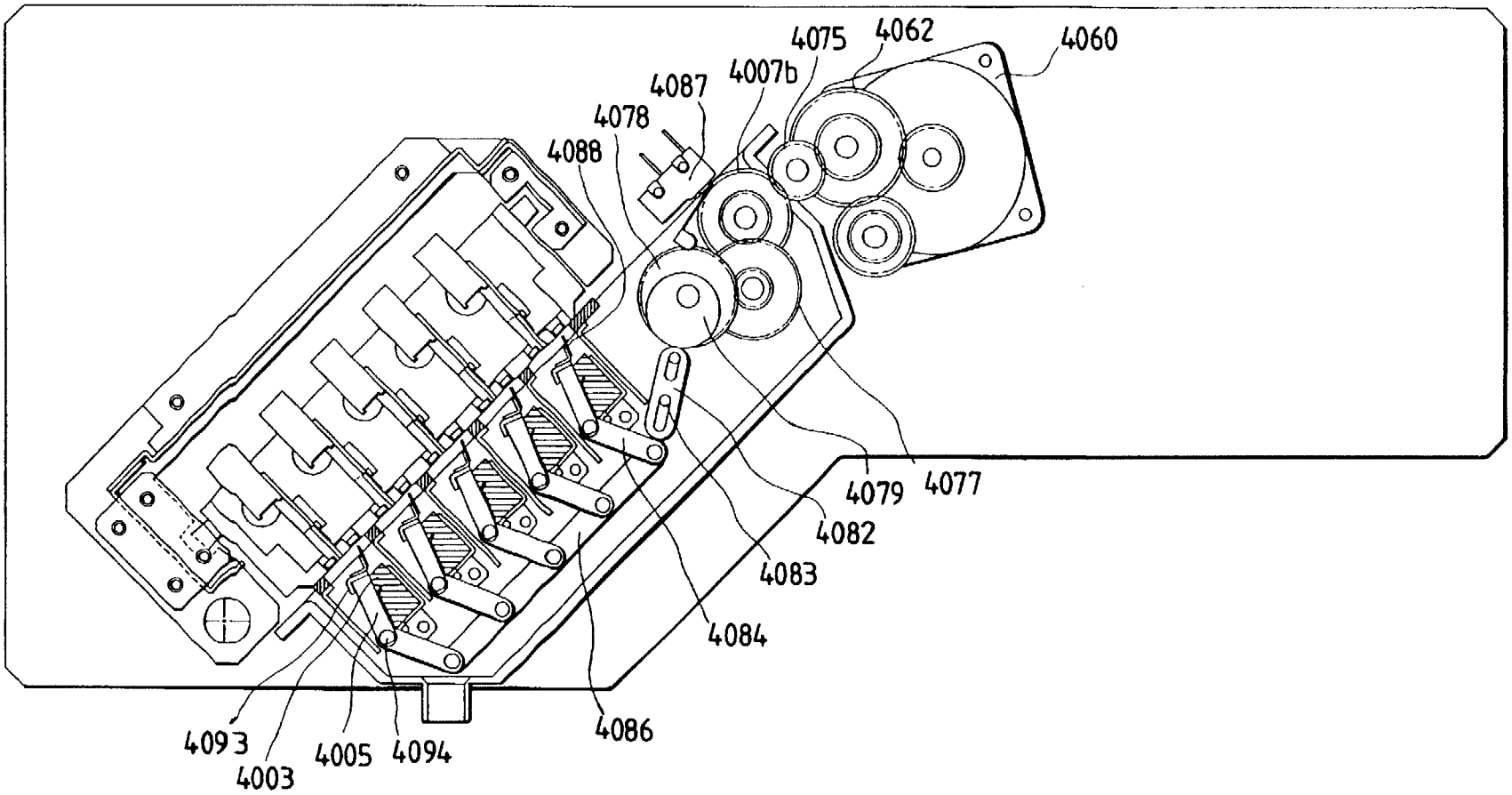

Next, an ink absorber squeezing mechanism and a mechanism for sweeping the head discharge surfaces will be explained. FIGS. 36 and 37 are detailed side views showing the ink absorber squeezing mechanism and the discharge surface sweeping mechanism, where FIG. 36 shows a waiting condition of such mechanisms and FIG. 37 shows a condition that the sweeping and squeezing operation are being effected. The reference numeral 4060 denotes a sweeping and squeezing drive motor. In this embodiment, the aforementioned cap driving motor is also utilized as the sweeping and squeezing drive motor. Further, in the illustrated embodiment, cleaning blades 4088 are used for sweeping the head discharge surfaces. The driving force from the motor 4060 is switched from the cap driving force transmitting path by means of a solenoid clutch (not shown). The activation of the ink squeezing mechanism and the activation of the blades are effected at the same timing. The driving force transmitted through the solenoid clutch is transmitted to a squeezing and sweeping drive cam 4079 via a gear train 4075–4078. The rotational movement of the cam 4079 is converted into the reciprocating motion of a slide arm 4082.

The slide arm 4082 can be reciprocally shifted along slide pins 4083 formed on the side plate of the cap, whereby the movement of the slide arm is transmitted to the ink absorber squeezing members 4005 and blade supports 4093, via levers 4084, thus squeezing the ink absorbed in the ink absorbers and at the same time sweeping the head discharge surfaces by means of the blades 4088. The ink squeezed from the absorbers and swept from the head discharge surfaces flows to the bottom of the recovery container 4002 and then is collected.

FIG. 37 shows a condition that the cleaning blades sweep the head discharge surfaces and at the same time the squeezing members squeeze the ink absorbers. Further, by transmitting the driving force from the motor to all of the blades and squeezing members simultaneously through a connecting bar 4086 and the levers 4084, all of the ink absorbers can be squeezed simultaneously and all of the head's discharge surfaces can be swept simultaneously.

The cleaning blades 4088 attached to the blade supports 4093 integrally formed on the squeezing members 4005 are pivoted around pivot axes defined by corresponding shafts 4094 in synchronism with the movement of the squeezing members. Of course, the positions of the pivot axes are selected so that the ink droplets, solidified ink, dirt and the like adhered to the head discharge surfaces can be effectively and efficiently swept and removed, and the squeezing members 4005 can effectively squeeze the ink absorbers 4003 when the latter is disengaged from the head discharge surfaces. Further, the cleaning blades 4088 used in the illustrated embodiment may be ones normally used for cleaning a drum in a copying machine and the like utilizing the normal electrophotographic process, and may be made of urethane rubber, for example. It should be noted that the dimensions such as the protruded amount, free length and thickness of each cleaning blade are varied in accordance with the requirements of the respective apparatuses.

In the apparatus according to this embodiment, as mentioned above, the cap driving mechanism and the blade driving mechanism are activated by the same single motor 4060, and the activation of the former (cap driving mechanism) and the activation of the latter (blade driving mechanism) are switched-over by the ON/OFF of two solenoid clutches (not shown). The activation of the squeezing mechanism is detected by detecting the rotation of the cam 4079 by means of a microswitch 4087 associated with the cam 4079. That is to say, this detection is effected by detecting the movement of the squeezing members 4005 and the blades 4088 shifted in synchronism with the rotation of the cam. More particularly, when the cam is rotated by one revolution (i.e., when the microswitch is turned ON once), the squeezing movement of the squeezing members 4005 and the sweeping movement of the blades are effected once, respectively. The activation of the blades is also detected by the microswitch 4087, in the same manner as the detection of the activation of the squeezing mechanism. Such detection is based on the fact that, when the cam is rotated by one revolution (i.e., when the microswitch is turned ON once), the blades 4088 perform one reciprocal movement and at the same time the squeezing members 4005 are activated once (i.e., changes from the condition shown in FIG. 36 to the condition shown in FIG. 37 and then returns to the condition shown in FIG. 36 again).

Such continuous or sequential operations will be explained.

First of all, when the ink pressurization circulation mode is selected, the solenoid clutch (not shown) is turned ON, with the result that the driving force from the motor 4060 is transmitted to the rack shaft 4065 via the gear train 4061–4064, thereby disengaging the ink absorbers 4003 from the head discharge surfaces through the aforementioned transmitting path. The disengagement of the ink absorbers is ascertained by the microswitch 4081. When the disengagement of the ink absorbers from the head discharge surfaces is ascertained by the microswitch 4081, the solenoid clutch is turned OFF, thereby stopping the cap movement. At the same time, the other solenoid clutch is turned ON, with the result that the driving force from the motor 4060 is transmitted to the cam 4079 via the gear train 4075–4078, thus activating the squeezing members 4005 and the cleaning blades 4088 simultaneously. The activation of the blades and the squeezing members is detected by the microswitch 4087 associated with the cam 4079. When such activation is detected (normally, one cycle movement corresponds to one revolution of the cam), the other solenoid clutch is turned OFF, thereby stopping the squeezing members and the blades. At the same time, the cap is driven to abut the ink absorbers 4003 against the head discharge surfaces. The detection of the engagement of the ink absorbers with the head discharge surfaces is ascertained by the microswitch 4080. When the engagement of the ink absorbers is detected, the former solenoid clutch and the motor 4060 are turned OFF, thus keeping the engagement condition of the ink absorbers against the head discharge surfaces. Thereafter, by disengaging the ink absorbers from the head discharge surfaces again, the stand-by or capping condition is restored.

Next, the recovery operation of the recovery system will be fully explained.

Conveniently, the recovery operation will be described by dividing it into the following three operations: (a) capping operation, (b) preliminary (idle) discharge operation and (c) ink exhausting operation.

Figure 38:
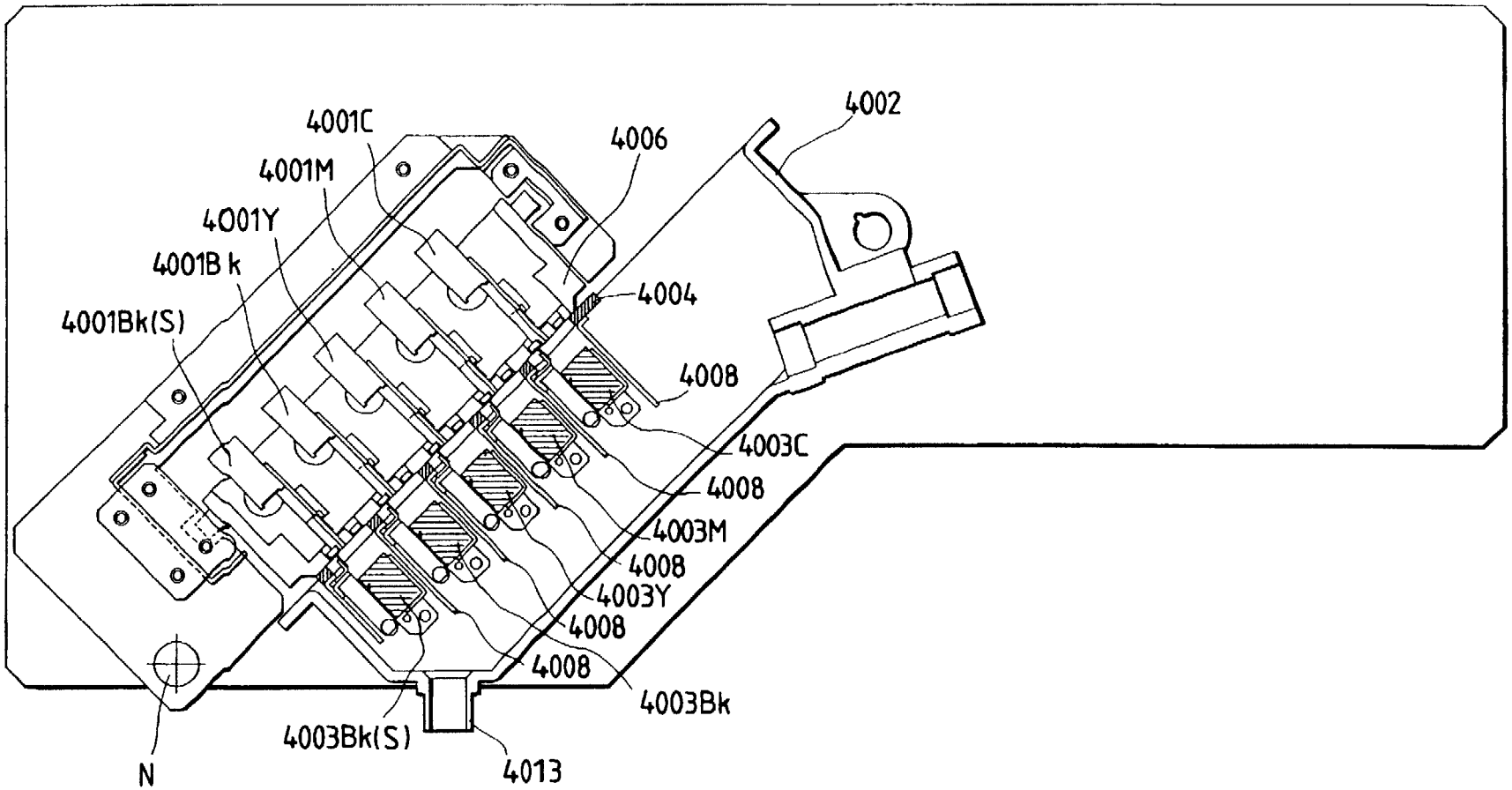
FIG. 38 is a sectional view showing a recording head capping condition.

First of all, the capping operation (a) will be explained. FIG. 38 is a schematic view showing a condition that the recording heads are capped. In FIG. 38, the recording heads 4001C, 4001M, 4001Y, 4001BK and 4001BK(s) arranged side by side in the head block 4006 are engaged by the recovery cap portion 4306 acting as the discharge recovery means. Ink seals 4004, partition plates 4008 and ink absorbers 4003C, 4003M, 4003Y, 4003BK and 4003BK(s) are disposed in the recovery container 4002, and the ink absorbers are normally spaced apart from the head discharge surfaces by a predetermined distance. Thereby, the discharge openings (and thereabout) of the recording heads 4001C, 4001M, 4001Y, 4001BK, 4001BK(s) are encircled by the ink seals 4004, partition plates 4008 and ink absorbers 4003C, 4003M, 4003Y, 4003BK, 4003BK(s) to maintain the discharge openings under an appropriate wet condition, thus preventing the drying of the head discharge openings. In this way, in the non-operative condition and stand-by condition of the recording heads, by capping the recording heads, the non-discharge of ink is prevented, the discharge openings are protected, and the adhesion of dirt and the like on the discharge openings is also prevented.

Figure 39:
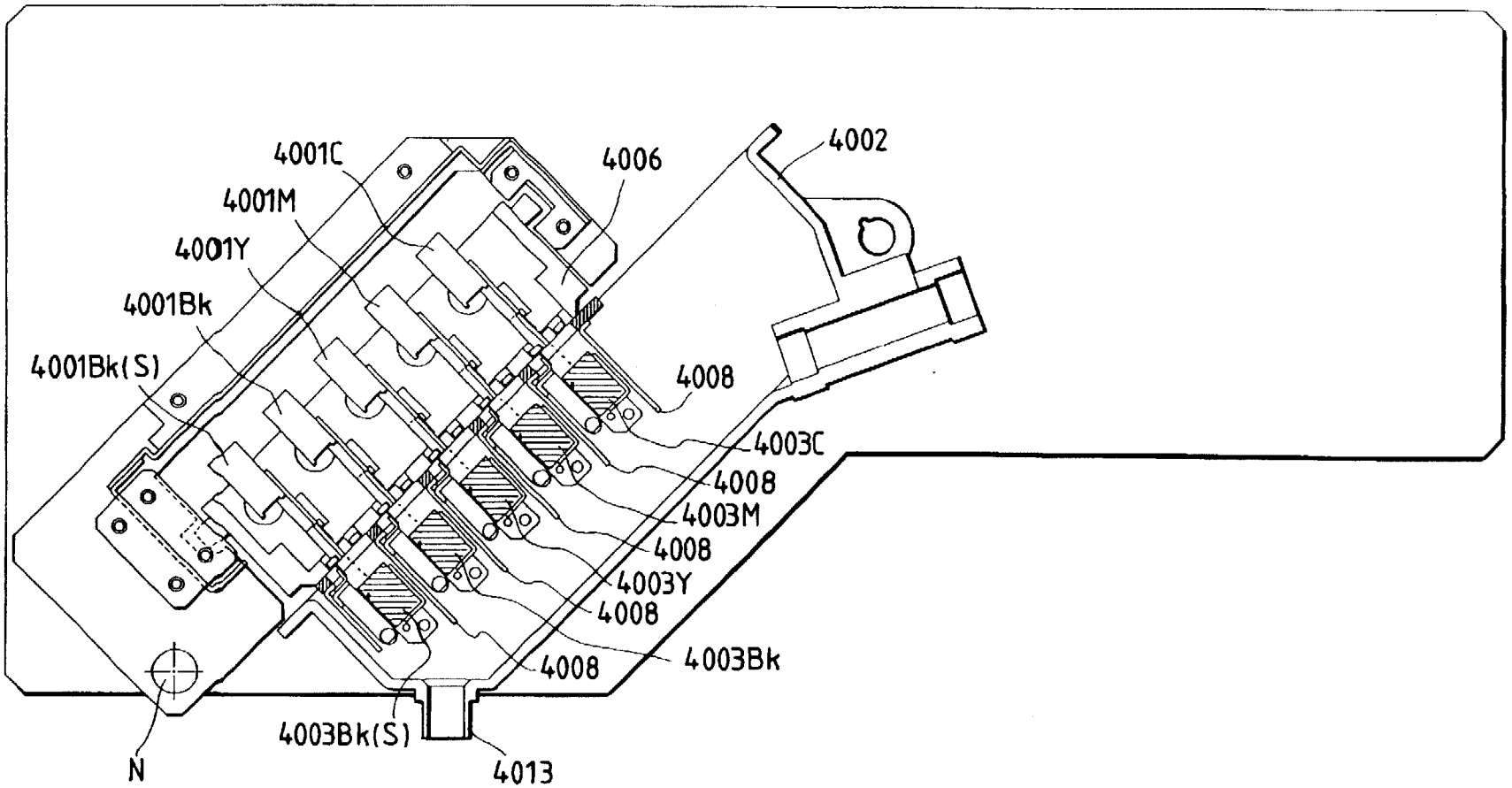
FIG. 39 is a sectional view showing an idle discharge condition of the recording head.
Figure 40C:
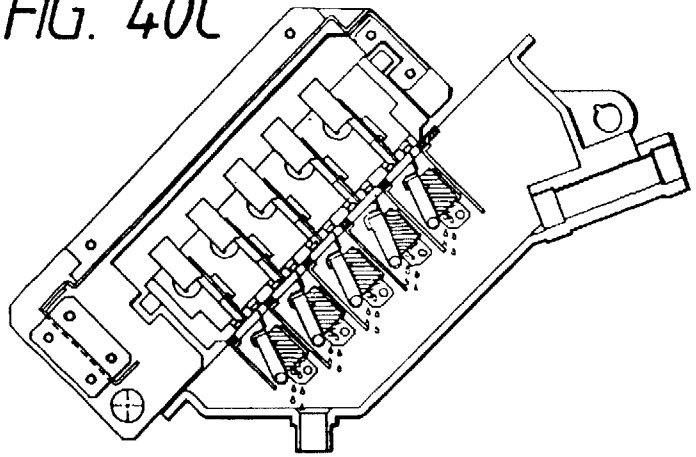
FIGS. 40A to 40D are sectional views showing a sequence of an ink pressurizing circulation operation.
Figure 40D:
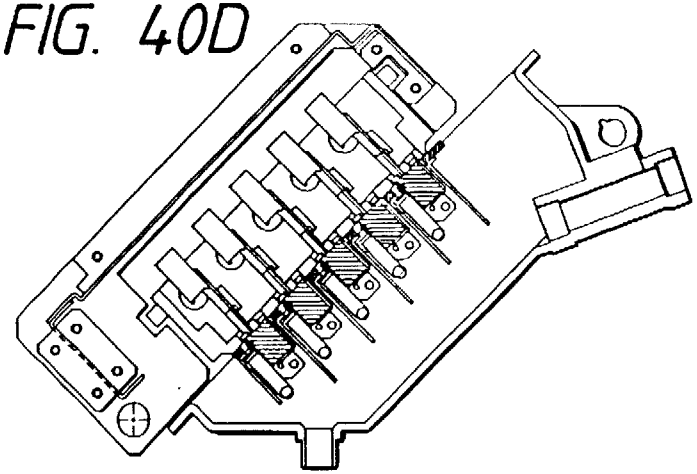
Figure 40A:
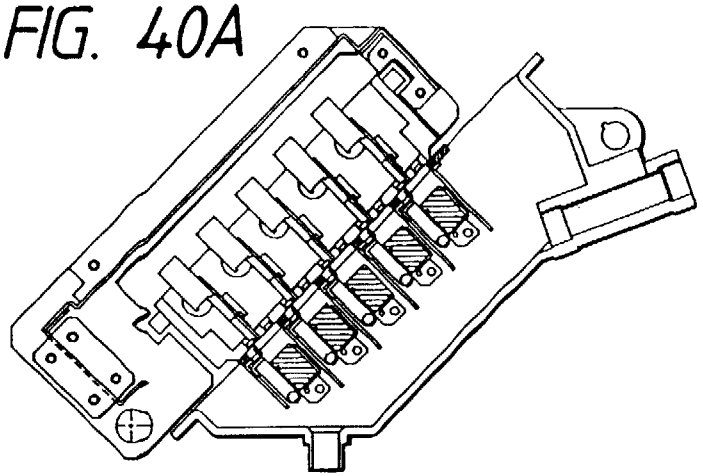
Figure 40B:
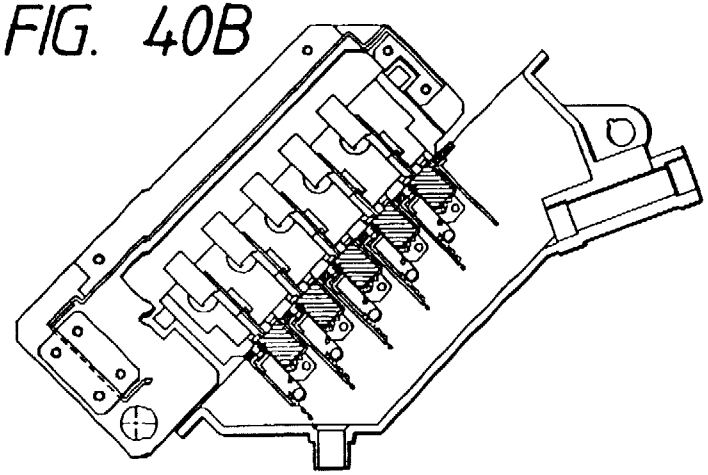

Then, the preliminary (idle) discharge operation (b) will be explained. FIG. 39 is a schematic view showing the idle discharge condition. Similar to the above-mentioned capping operation, the ink absorbers 4003C, 4003M, 4003Y, 4003BK and 4003BK(s) are spaced apart from the discharge surfaces of the recording heads. In this case, a desired number of ink discharging pulses are applied to all of the discharge energy generating means of all of the recording heads 4001C, 4001M, 4001Y, 4001BK and 4001BK(s). In this way, regarding all of the discharge openings, it is possible to prevent the non-discharge of ink due to the solidification of ink, and, the poor discharge of ink and the distortion of image due to changes in the viscosity of the ink. Normally, the idle discharge operation is effected at the initiation of the recording operation or at predetermined time periods.

Next, the ink exhausting operation (c) will be explained. FIGS. 40A to 40D are schematic views showing the operation of the recovery cap portion 4306 performing the ink pressurization and circulation operation in the ink supply system for the ink exhaustion.

The operation in the recovery cap portion 4306 includes the following four cycles: (i) a normal capping cycle, (ii) an ink pressurize circulation cycle, (iii) an absorber squeezing and cleaning cycle, and (iv) an absorber abutting cycle. FIGS. 40A to 40D show these cycles (i) to (iv), respectively.

First of all, the capping cycle (i) corresponds to the above-mentioned capping operation (a) wherein the normal stand-by condition or non-operative condition is established. In this condition, when the ink pressurize circulation mode is selected, for example, by an operator or command from a host computer, the recovery cap portion is changed from this condition to the condition shown in FIG. 40B. In this new condition, the ink absorbers 4003C, 4003M, 4003Y, 4003BK and 4003BK(s) being spaced apart from the head discharge surfaces are abutted against the corresponding recording head 4001C, 4001M, 4001Y, 4001BK and 4001BK(s), respectively. Accordingly, in this condition, the ink absorbers are engaged by the corresponding discharge surfaces of the heads. In such engagement condition, by activating ink supply pumps (not shown), the pressure in the ink supplied to the recording heads 4001C, 4001M, 4001Y, 4001BK and 4001BK(s) is increased. Consequently, the inks are circulated in the respective ink supply systems through the respective heads to remove the bubbles from the heads, and the pressurized inks are also exhausted from the respective discharge openings.

Thus, the dirt and the like adhered to the discharge surfaces is also removed together with the waste ink, thereby cleaning the discharge openings and thereabout. The waste ink discharged from the discharge openings is absorbed by the ink absorbers 4003C, 4003M, 4003Y, 4003BK, 4003BK (s) abutted against the discharge surfaces without leaking to other portions, as mentioned above. When the ink amount absorbed in each ink absorber exceeds the maximum absorbing capacity of the ink absorber, the excessive ink flows down from the ink absorber by its own weight onto the bottom of the recovery container 4002, and is then directed to the waste ink tank (not shown) through the waste ink opening 4013 via a waste ink hose 4012. Preferably, the ink pressurize circulation time, i.e., the ink supply pump activation time is normally in the order of 0.5 second to several seconds, in consideration of the effective removal of the solidified ink and the bubbles.

Next, the absorber squeezing and cleaning cycle (iii) will be explained.

When the ink pressurization circulation cycle (ii) is finished, the ink absorbers abutted against the head discharge surfaces are again separated from the corresponding recording heads. In such disengagement condition, the ink saturating the ink absorbers 4003 is squeezed from the ink absorbers by means of the squeezing members 4005. The squeezed ink is, by its own weight, transferred to the absorber guides 4007 and hence to the partition plates 4008, and then flows down from the partition plates onto the bottom of the recovery container 4002, and is then directed to the waste ink tank (not shown) through the waste ink opening 4013 via the waste ink hose 4012. At the same time when the ink absorbers 4003 are separated from the corresponding head discharge surfaces, the ink absorbers are squeezed, and discharge surface sweeping blades 4088 are activated to remove the discharged ink, dirt, adhered foreign matters and the like remaining on the head discharge surfaces. Although the swept ink and the like are dropped on the ink absorbers 4003, since at the same time the above-mentioned squeezing operation is effected, such dropped ink and the like are also squeezed from the ink absorbers to flow onto the bottom of the recovery container 4002 and are then directed to the waste ink tank. That is to say, at the same time when the ink absorbers 4003 are separated from the discharge surfaces of the heads, the residual matters remaining on the ink discharge surfaces are removed by the sweeping blades 4088 and the removed residual matters are squeezed together with the excessive ink in the ink absorbers.

The above-mentioned operation is the absorber squeezing and cleaning operation (iii). By squeezing or deforming the ink absorbers 4003 by means of the squeezing members 4005, the ink absorbing ability of the ink absorbers is restored, thus preparing for further ink absorption. Each ink absorber 4003 is preferably made of polyvinyl formal (PVF) which is high by water-absorbent material, and it is desirable to use material which can endure for the repeated usage. In the illustrated embodiment, the ink absorber is made of "Bell Eater" (registered trade mark) manufactured by KANEBOH Company in Japan. The ink absorbers from which the absorbed ink is squeezed are then abutted against the corresponding discharge surfaces of the heads again. This condition is the absorber abutting condition (iv). In the condition (ii), since the ink absorbers are substantially saturated with ink, the residual ink cannot be completely absorbed in the ink absorbers. However, in this condition (iv), since the ink absorbing ability is restored by squeezing the absorbers, the residual ink is completely absorbed by the cleaned ink absorbers abutted against the head discharge surfaces, thus completely cleaning the heads.

After a series of these operations (i)–(iv) have been completed, the recovery system is returned to the capping condition (i), i.e., the stand-by condition again, thus maintaining the cleaned heads. Normally, the ink pressurize circulation operation is effected at the activation of the power source or after passage of a long time.

As mentioned above, by performing the recovery operation including the capping operation (a), idle discharge operation (b) and ink pressurize circulation operation (c), it is possible to prevent (recover) the distortion of the recorded image due to the poor ink discharge during the recording operation.

Next, the recording operation will be explained. FIGS. 41A to 41F show a sequence transferring from the stand-by condition of the recovery system to the record permitting condition.

First of all, the capping condition shown in FIG. 41A corresponds to the capping condition (a) as mentioned above, which is the normal stand-by condition or non-operative condition. In this condition, when the recording mode (copy ON) is selected, the above-mentioned idle discharge operation is effected.

Figure 41E:
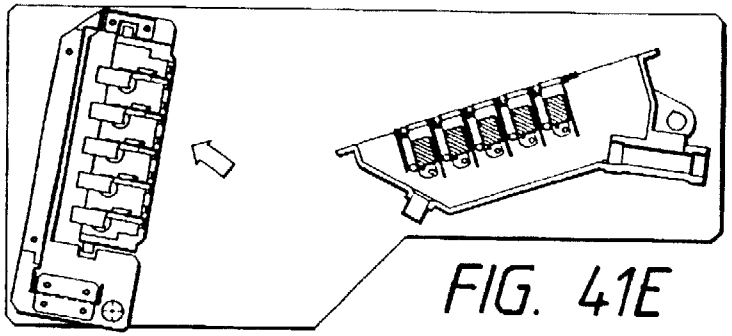
Figure 41F:
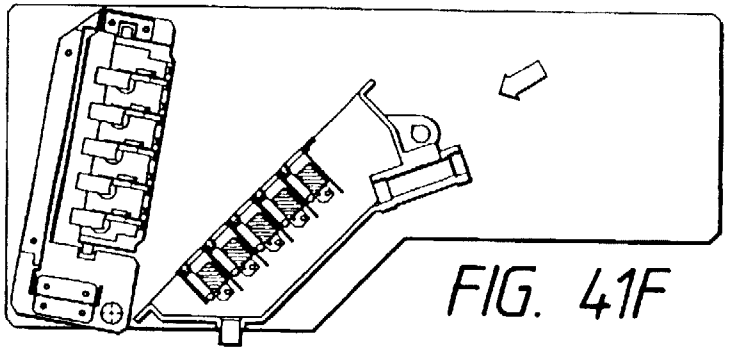
Figure 41A:
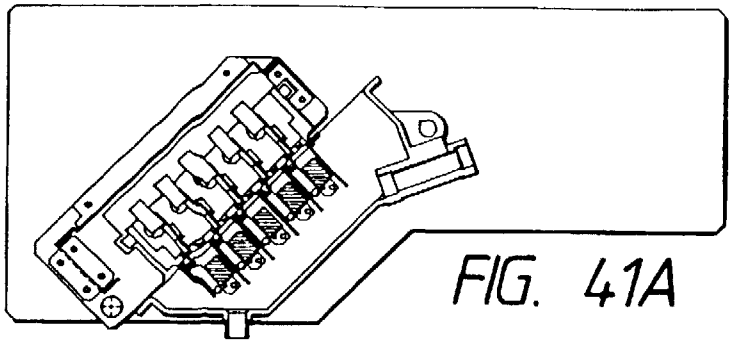
Figure 41B:
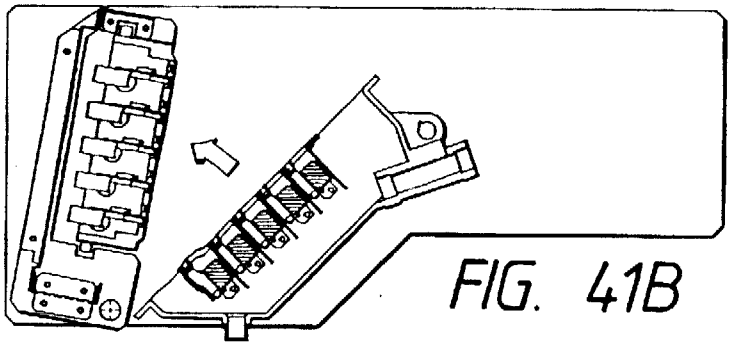
Figure 41C:
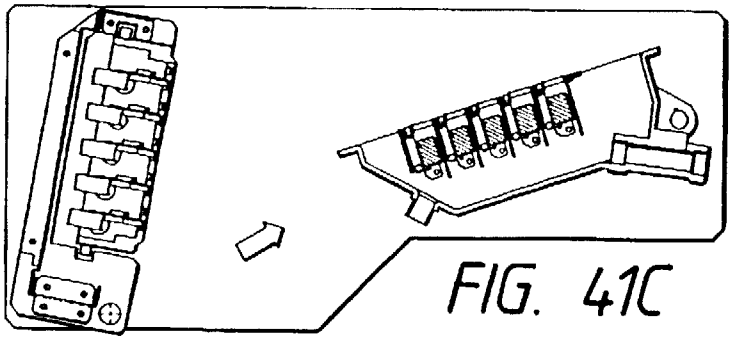

Subsequently, the recording apparatus is changed to a head up condition as shown in FIG. 41B, i.e., a condition that the recording head portion 4305 is retracted upward. In this condition, the recovery container 4002 of the recovery cap portion 4306 is retracted to the right (FIG. 41B). This condition corresponds to a unit open condition shown in FIG. 41C. Through this condition, then, a head down as shown in FIG. 41D is effected. Consequently, as shown in FIG. 41D, the recording heads are under the record permitting condition (position) and the recovery container 4002 is shifted to the retracted position. In this condition, the recording paper is shifted from the right (FIG. 41) while being spaced apart from the head discharge surfaces by the predetermined distance; whereas, the image signals are inputted to the recording heads 4001C, 4001M, 4001Y, 4001BK and 4001BK(s) to discharge the ink, thereby forming the image on the recording paper.

When the recording of the image on the recording paper is finished (i.e., the discharge of the ink from the recording heads is finished), as shown in FIG. 41E, the head up operation of the recording heads is effected again, and then, as shown in FIG. 41F, the recovery container 4002 is shifted toward the heads, thus restoring the capping condition shown in FIG. 41A for preparing the next recording operation (stand-by condition).

By repeating the above-mentioned series of operations shown in FIGS. 41A to 41F, the normal copying operation is effected. Further, the above-mentioned ink circulation operation (c) is effected at a predetermined timing of the capping operation (i.e., the stand-by condition), for example, with the activation of the power source or after predetermined time periods, thus preventing the reduction of the ink flows and obtaining the good image.

Figure 42:
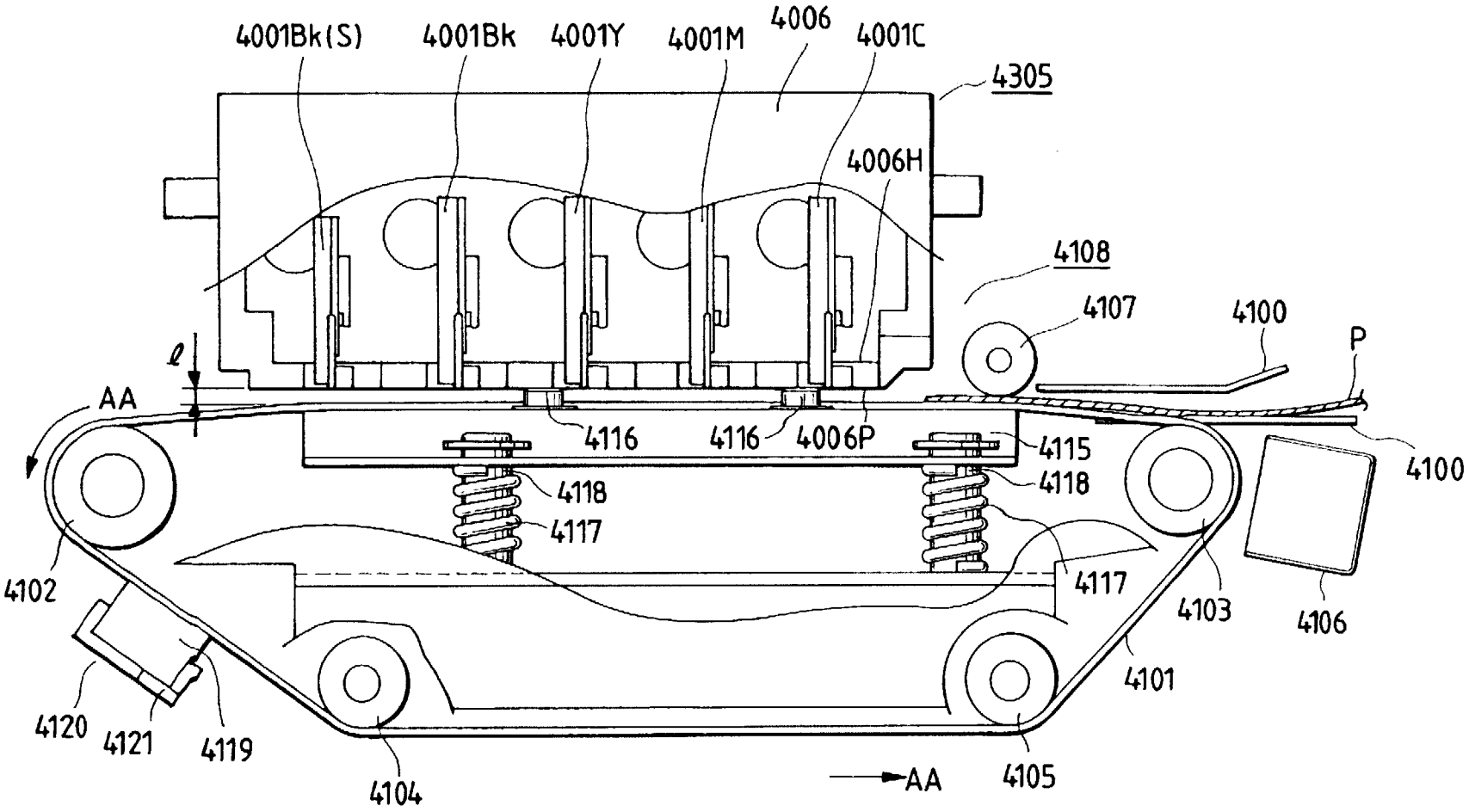
FIG. 42 is a sectional view of a belt conveyor mechanism of the apparatus of FIG. 30.

FIG. 42 shows a schematic elevational view of a conveying means (belt conveying portion) for the recording medium (recording paper). The recording paper P outcoming from the registry rollers (4115, 4116 in FIG. 30) reaches a conveying belt 4101 along guide plates 4117, 4118. The conveying belt 4101 has two layers. An outer layer (directed toward the recording paper) is an insulation layer (preferably, having the volume resistance of $10^{12}$ Ω·cm or more) and an inner layer is a conductive layer (preferably, having the volume resistance of $10^{8}$ Ω·cm or less). The conveying belt 4101 is wrapped around a driving roller 4102, a driven roller 4103, and tension rollers 4104, 4105, and is tensioned by a tension force of 2–5 Kg, for example. The conveying belt 4101 is shifted in a direction shown by the arrow AA by means of a motor (not shown) which is connected to the driving roller 4102 and which applies the driving force to the latter.

The recording paper is rested on the conveying belt 4101 immediately ahead of an electro-conductive roller 4107. The surface of the conveying belt 4101 is charged to a few hundreds-a few thousands volts by means of a charger 4106. When the recording paper rested on the conveying belt 4101 reaches the electro-conductive roller 4107, since the recording paper closely contacts the conveying belt 4101 because of electrostatic attraction force, the recording paper is shifted together with the conveying belt 4101 while being closely adhered to the latter.

In this condition, the recording paper reaches a recording area where it opposes the recording head portion 4305. The recording head portion 4305 includes the head block 4006 and the recording heads 4001C, 4001M, 4001Y, 4001BK, 4001BK(s), and a platen 4115 is arranged in confronting relation to the recording heads 4001C, 4001M, 4001Y, 4001BK, 4001BK(s) with the interposition of the conveying belt 4101. Further, the platen 4115 has pins 4116 and is biased toward the recording head portion 4305 by means of springs 4117 and guide pins 4118 to be supported by the recording head portion through the pins 4116. In the recording area, it is desirable that a distance between the recording heads 4001C, 4001M, 4001Y, 4001BK, 4001BK(s) and a recording surface of the recording paper is maintained to a desired set value of about 100 μm to obtain the high quality image.

To this end, the flatness of the surface of the platen 4115 contacting the conveying belt 4101 is selected to have a value of a few tenth μm so that the conveying belt 4101 which is supported by the platen 4115 provides a substantially flat face in the recording area. Further, the recording heads 4001C, 4001M, 4001Y, 4001BK, 4001BK(s) are positioned and fixed by the head block 4006 in such a manner that the flatness of a surface defined by all of the head discharge surfaces has a value of a few tenth μm. When the platen 4115 is biased upwardly by the springs 4117 guided along the guide pins 4118, the upper ends of the pins 4116 abut against the head block 4006, thereby creating a clearance 1 for passage of the recording paper. With this arrangement, when the recording paper is conveyed, since the recording paper is adhered to the conveying belt 4101 by the electrostatic attraction force, the distance between the recording face of the recording paper and the head's discharge surfaces is maintained within the set value accurately.

While the recording paper is passing the recording area, the image is recorded on the recording paper by means of the recording heads 4001C, 4001M, 4001Y, 4001BK, 4001BK (s) in response to the image information. In this case, if the variation in the speed of the conveying belt 4101 is great, the recording positions on the recording paper regarding the respective recording heads are varied, thus causing the discrepancy of colors in the color image. To avoid this, the thickness of the conveying belt 4101, the outer diameter of the driving roller 4102 and the rotation of the driving motor are each set within a desired range, so that variation in the speed of the conveying belt 4101 is suppressed so as not to cause serious problems.

The recording paper on which the image has been recorded at the recording area reaches the driving roller 4102 with being adhered to the conveying belt 4101, and thereafter, is separated from the conveying belt 4101 by a curvature of the latter created by the driving roller 4102. Then, the surface of the conveying belt 4101 is cleaned by a cleaner 4120 having ink absorbers 4119. The ink absorbers 4119 are made of porous continuous foam material such as polyvinylformal resin, and the ink absorbed in the ink absorbers is squeezed from the latter and is discharged through an opening 4121 to the outside and then is collected.

Incidentally, in the illustrated embodiment, while an example that the conveying belt 4101 comprises two layers, i.e., outer insulation layer and the inner electroconductive layer was explained, the conveying belt 4101 may include only one layer having the desired volume resistance or may include a plurality of insulation and electroconductive layers.

Next, a sequence of the image recording after the activation of the power source will be explained with reference to flow charts shown in FIGS. 43 to 50 and FIG. 53.

First of all, when the power source of the ink jet recording apparatus is activated, the apparatus carries out a series of operations such as (i) capping operation, (ii) ink pressurization circulation operation, (iii) absorber squeezing operation and (iv) absorber abutting operation (sub-routine: ink pressurize circulation operation in FIG. 46), and then returns to the capping condition (i) again. By performing the series of operations (step S1 in FIG. 44), it is possible to prevent the non-discharge of ink due to solidification of the ink and/or the bubbles based on the increase in the viscosity of ink (the increase in the viscosity is due to the drying of ink, i.e., the vaporization of the solvent in the ink) during the long non-operative condition of the apparatus before the activation of the power source.

The series of the operations starting from the capping operation (i) followed by the ink pressurization circulation operation (ii), ink absorber squeezing operation (iii) and the absorber abutting operation (iv) and returning to the capping operation (i) again are called as "ink pressurization circulation operation" hereinafter. Not that the ink pressurization circulation operation is carried out only at the activation of the power source, but it can be carried out at other times. For example, under high temperature and high humidity conditions or when the apparatus is kept in the non-operative condition for a long time after the activation of the power source, in consideration of a problem regarding the occurrence of the bubbles and the solidification of ink, the ink pressurization circulation operation is carried out after predetermined time periods (within the time during when the above problem does not arise; referred to as "cycle time" hereinafter) set by a timer means and the like.

Further, in the vicinity of the recording head portion 4305, there is arranged a humidity sensor (not shown), by a signal from which a variation control for determining the time (hours) between ink pressurization circulation operations and the and the interval (seconds) during which the ink pressurization circulation operation is continued is effected. That is to say, when the apparatus is used under the low humidity condition, the above-mentioned cycle time is shortened or the ink pressurization circulation operation time is increased. By changing both times, it was found that the effect is further enhanced.

Now, so long as the recording start signal is not inputted, the capping condition shown in FIG. 38 is maintained. When the recording start signal is inputted, as mentioned referring to FIG. 39, a given number of discharging pulses are applied to all of the energy generating means of all of the recording heads to discharge the ink from all of the discharge openings, thus performing the idle discharge operation to prevent the non-discharge of ink immediately before the recording operation. This is shown in step S2 in FIG. 44. The number of the pulses in this idle discharge operation is also controlled by the signal from the aforementioned humidity sensor, similar to the above-mentioned ink pressurization circulation operation. That is to say, under the low humidity condition, the number of pulses is increased. The ability to prevent the non-discharge of ink, provided by the ink pressurization circulation operation is greater than that provided by the idle discharge operation, and, accordingly, the time period when the non-discharge of ink due to the viscosity increase and the solidification of the ink cannot be prevented by the idle discharge operation will be one factor for determining the cycle time for the ink pressurization circulation operation.

Figure 47:
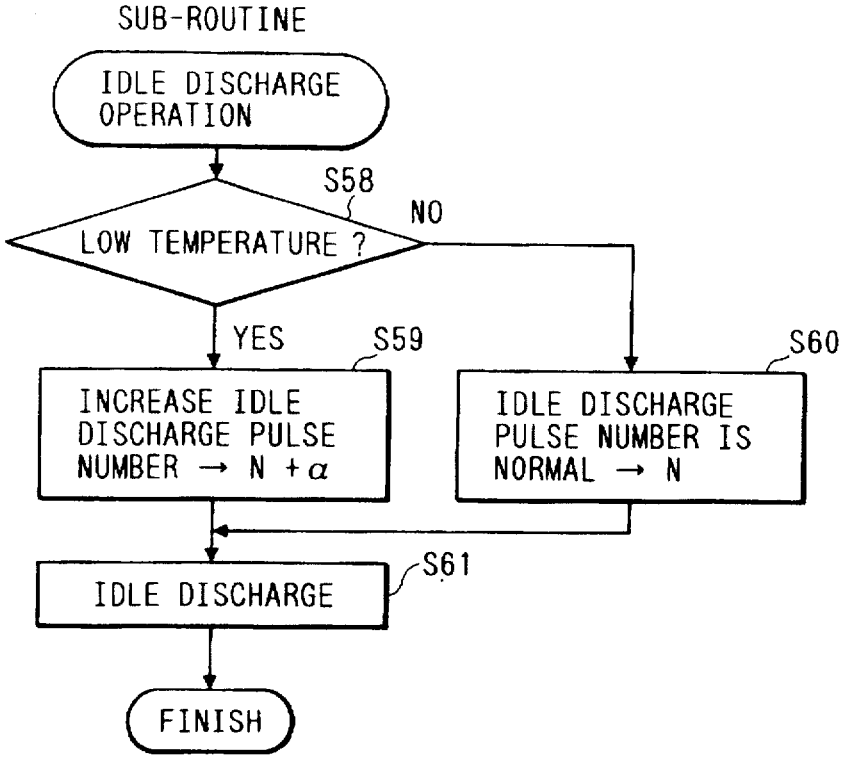

Therefore, in the non-operative condition, the discharge surfaces of the recording heads are capped by the capping means to shield the discharge surfaces from the atmosphere, thus preventing the solidification of ink due to the drying of the ink in some extent, so that the ink discharge ability of all of the discharge openings can be restored using the idle discharge operation. When the idle discharge operation shown by a flow chart of a sub-routine in FIG. 47 is finished, as shown in FIGS. 41A to 41D, the unit open operation is effected, with the result that the heads are retracted upwardly and then the recovery container 4002 is retracted rightwardly and upwardly.

Figure 48:
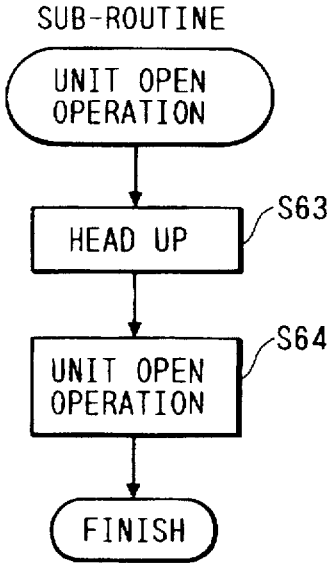

This operation is shown in FIG. 48 as a sub-routine of open unit operation.

Figure 44:
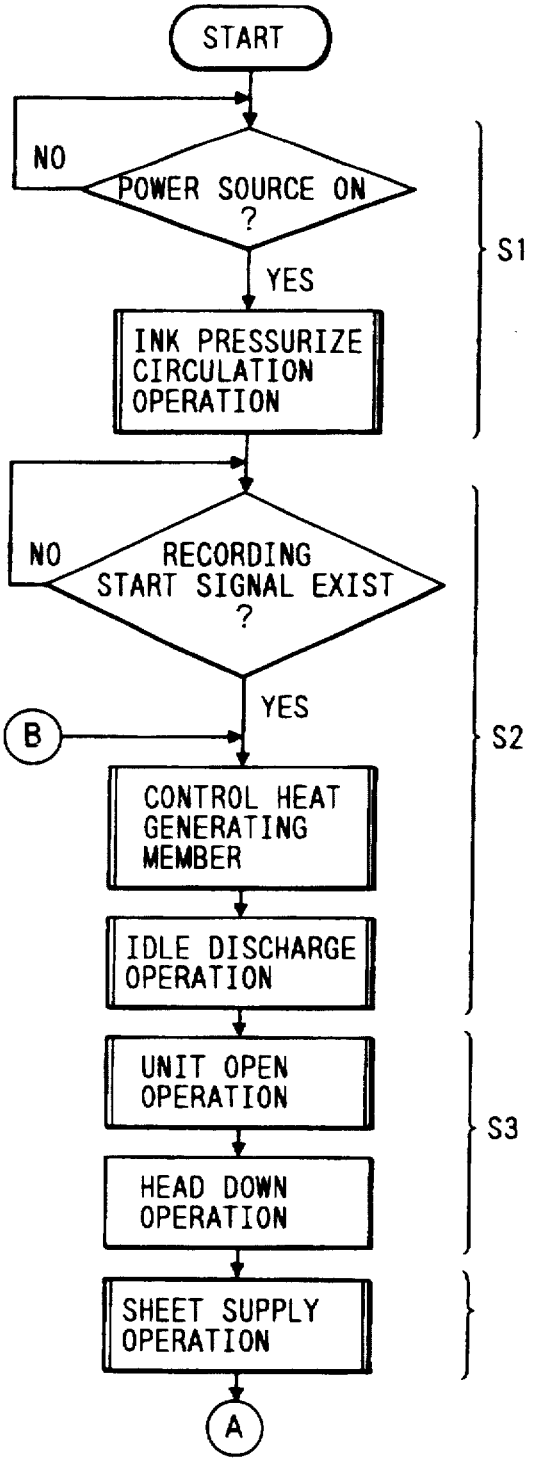
FIG. 44 PRIOR ART
FIGS. 44 and 45 are a flow charts showing a whole operation of the ink jet recording apparatus according to one of embodiments of the present invention.
Figure 45:
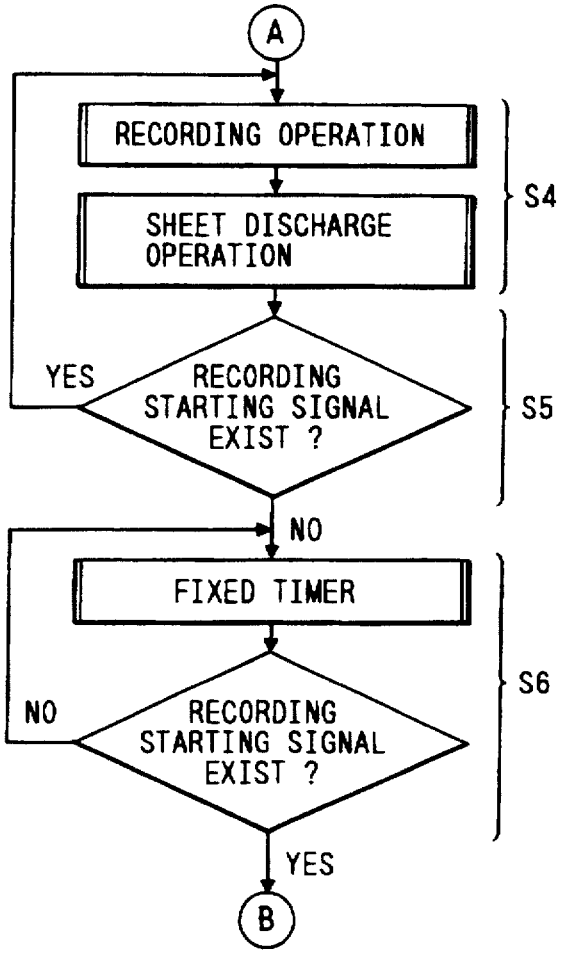
FIG. 45 PRIOR ART
Figure 46:
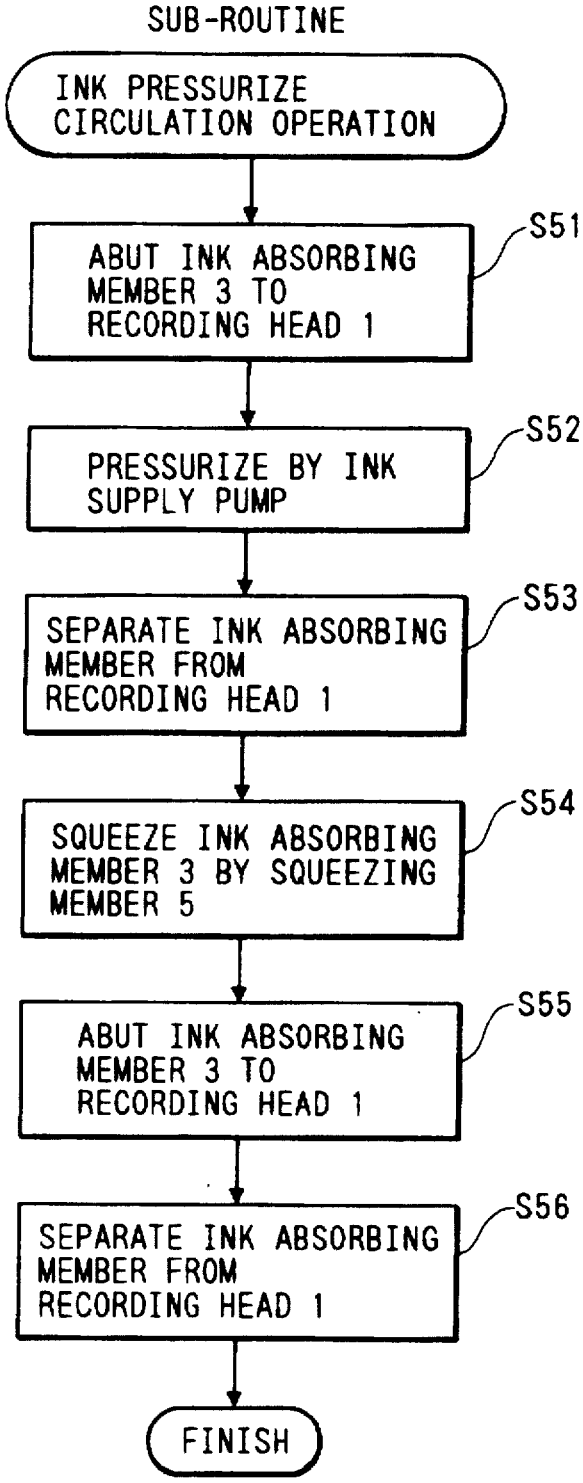
FIG. 46 PRIOR ART
FIGS. 46 to 50 are flow charts showing sub-routines for an ink pressurize circulation operation, idle discharge operation, unit open operation, sheet supply operation and recording operation, respectively.

Subsequently, the recording head portion 4305 is pivoted around the axis N so that the head discharge surfaces are directed downwardly to face the surface of the conveying belt 4101 (that is, the head down operation shown in a step S3 in FIG. 44 is carried out). The head portion 4305 is abutted against abutment portions (not shown) formed on the head block 4006 and against the pins 4116 disposed on the platen 4115 and then is stopped in a condition that it pushes the platen down slightly against the bias force of the springs 4117. This stop position is detected by the recording position detecting sensor. Further, a worm gear (not shown) is provided in a driving mechanism for pivoting the head portion 4305, whereby, on the basis of the feature of the lead angle of the worm gear, the head portion 4305 can be maintained in the stop position without being shifted upwardly due to the reaction force from the springs 4117. In this way, the heads are under the record permitting condition.

Then, the sheet supply operation is effected. In this case, as shown in a sub-routine of FIG. 49, there are two cases where the four color printing mode is selected and where the mono-color printing mode is selected. This selection is effected by depressing a manual button (not shown). First of all, when the four color printing mode is selected, as shown in the sub-routine flow chart of FIG. 49, the recording medium (recording paper) contained in a cassette 4411*a* is supplied by a pick-up roller 4412*a* and is sent to a nip portion between registry rollers 4115, 4116 (now stopped) through a conveying rollers 4413*a*, 4414*a* and guide portion 4419.

Figure 49:
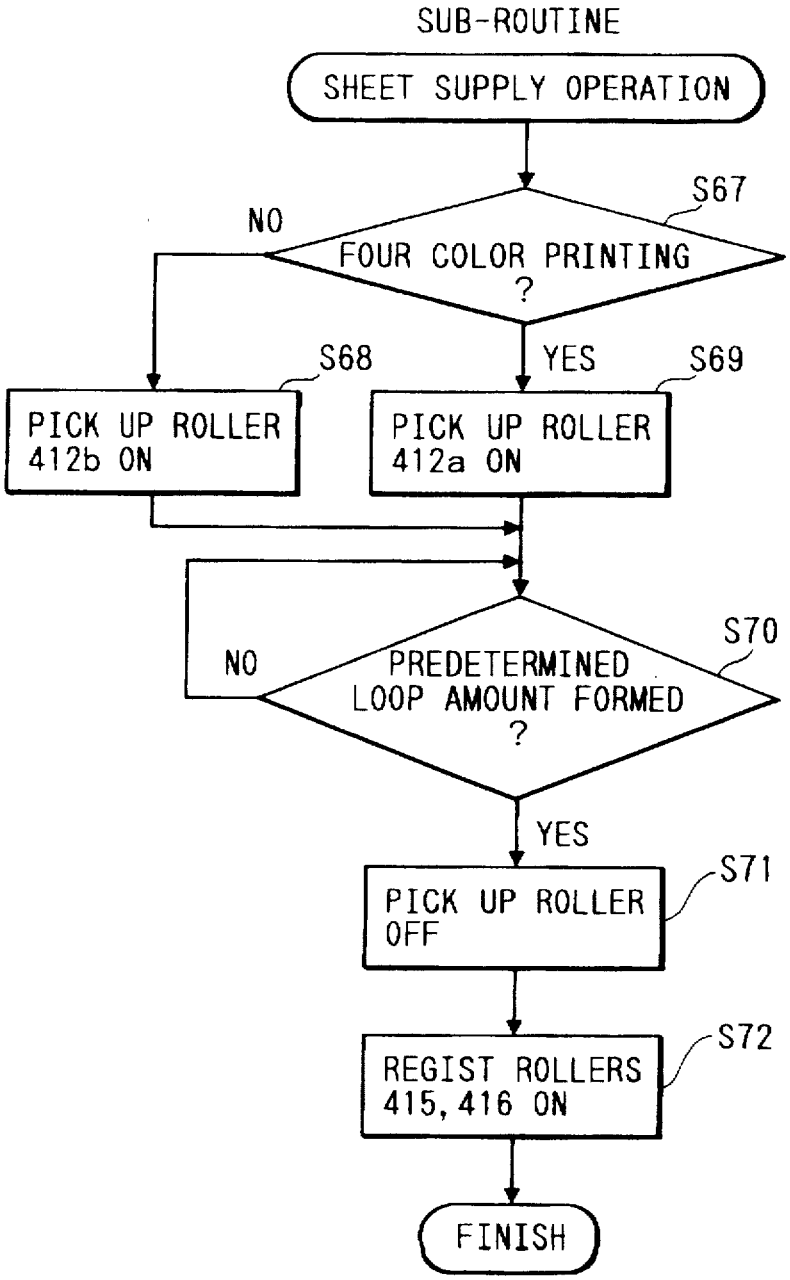
Figure 50:
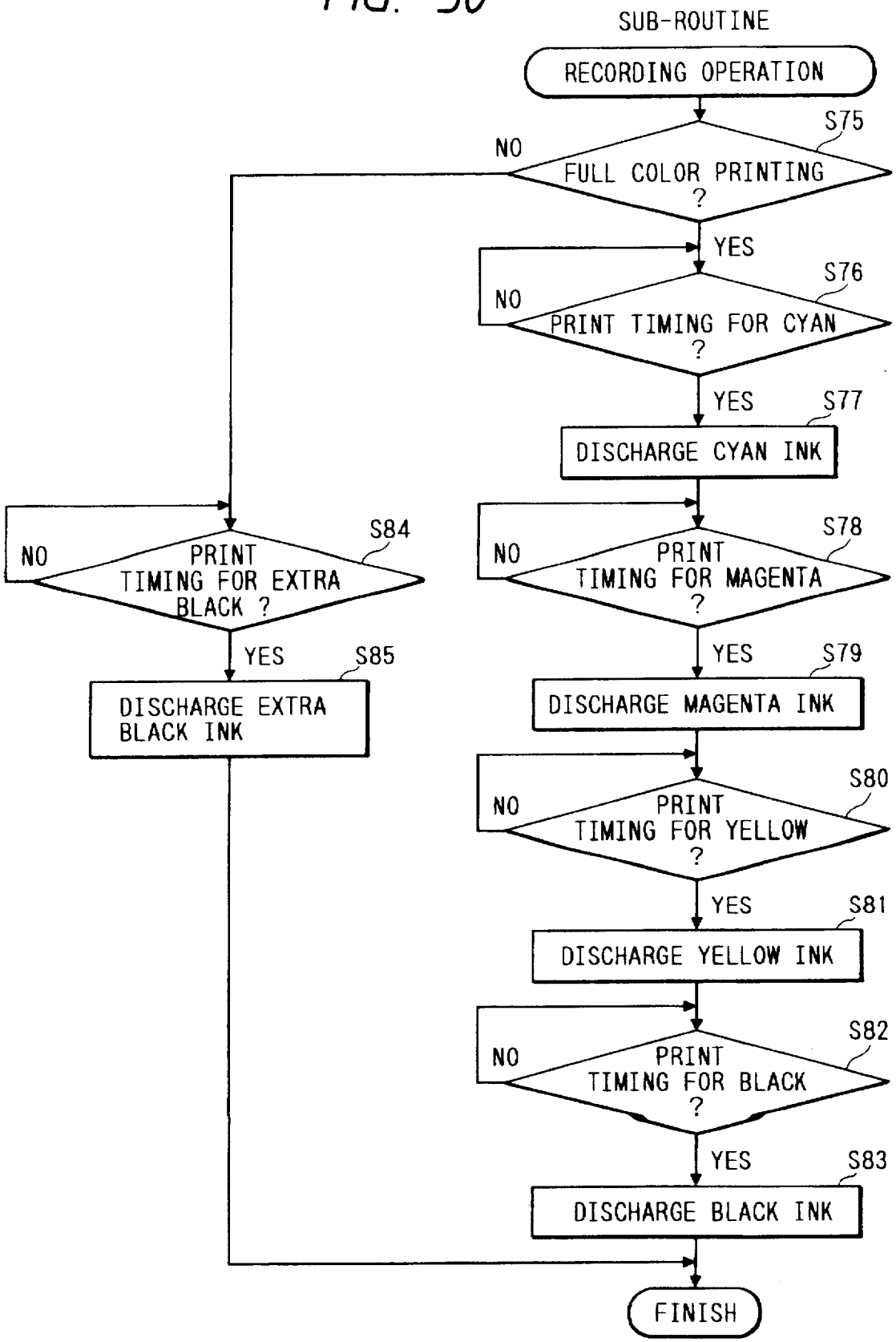

On the other hand, when the mono-color printing mode is selected, as shown in the sub-routine flow chart of FIG. 49, the recording medium (recording paper) contained in a cassette 4411*b* is supplied by a pick-up roller 4412*b* and is sent to a nip portion between the registry rollers 4115, 4116 (now stopped) through conveying rollers 4413*b*, 4414*b* and the guide portion 4419.

After the recording paper is abutted against the nip between the paired registry rollers 4115, 4116, it is still conveyed by the conveying rollers 4413, 4414 for a while, so that a loop is formed in the recording paper at the guide area 4119. This action is the registration normally performed in the electrophotographic copying machine and the like, for correcting the skew-feed of the recording paper and for performing the registration of a leading end of the recording paper.

Then, the registry rollers 4115, 4116 are rotated to feed the recording paper onto the conveying belt 4101 through guides 4417, 4418. In this case, on the basis of a signal for starting the rotation of the registry rollers 4115, 4116, a signal for starting the scanning of the original and the printing start signal for the recording heads 4001C, 4001M, 4001Y, 4001BK, 4001BK(s) are emitted. The recording paper conveyed on the conveying belt 4101 is gradually adhered to the surface of the conveying belt 4101 from the leading end of the paper by the electrostatic attraction force, and, as the recording paper is passed under the recording heads 4001C, 4001M, 4001Y, 4001BK, 4001BK(s), the printing or recording is effected regarding the recording paper by the aforementioned means, while keeping the proper gap between the recording paper and the recording heads. This recording operation is shown in a sub-routine flow chart of FIG. 50.

Thereafter, the recording paper is sent to the fixing and ejecting portion 4307. In this case, when the recording paper is transferred from the conveying belt 4101 to a guide 4213, the recording paper is naturally separated from the conveying belt by the resilience of the recording paper itself by selecting the small diameter of the driving roller 4102. The diameter of the driving roller 4102 is so selected that the shifting distance of the conveying belt 4101 given by one revolution of the driving roller equals to a distance between the discharge openings of the first recording head 4001C and those of the fifth recording head 4001BK(s). This selection is effected in consideration of the fact that, if the driving roller 4102 is somewhat eccentric, a discrepancy in the registration of the image will occur.

Ideally, the shifting distance of the conveying belt 4101 given by one revolution of the driving roller should correspond to a distance between the discharge openings of the two adjacent recording heads. However, since the minimum diameter of the driving roller 4102 is limited to some extent in consideration of mechanical strength, the shifting distance of the belt will inevitably become larger. Thus, since the quadruple distance is required between the five heads, the apparatus becomes larger. Therefore, the distance between first and fifth heads which are spaced furthest from each other (which distance includes the most factors for the discrepancy in the registration) is considered as the head distance for the full-color image. However, the head distance may correspond to the distance between the first and third heads, as well as the distance between the two adjacent heads, and, accordingly, is not limited to the aforementioned one. But, the above-mentioned diameter of the driving roller and the head distance should be under some consideration.

The above-mentioned cycle is the operation from the recording initiation to the recording completion and the ejection of the paper. When the set number of recording papers are all recorded, as mentioned referring to FIGS. 41E and 41F, the head up operation is effected, and then the unit close operation is effected, and at last, the capping condition is restored as shown in FIG. 32, thus finishing the sequential recording operation.

Figure 51:
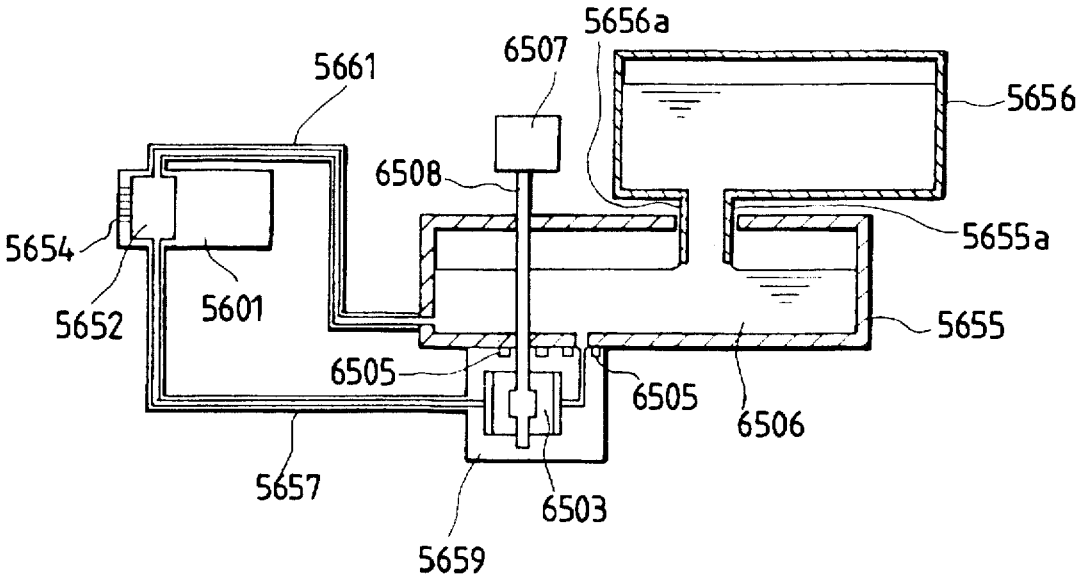
FIG. 51 is a schematic sectional view of an ink supply system.
Figure 52:
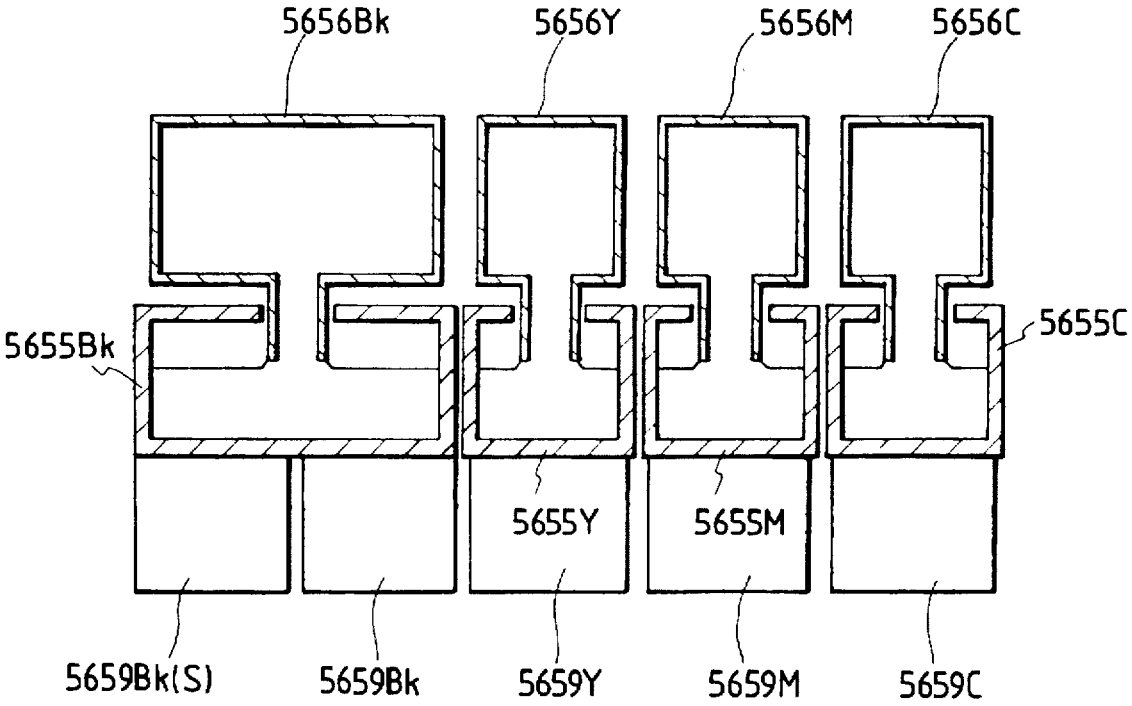
FIG. 52 is a schematic sectional view showing a main tank portion of the ink supply system.

FIGS. 51 and 52 show one example of an ink supply system. In this example, main tanks 5656C, 5656M, 5656Y, 5656BK are connected to corresponding recording liquid supply tanks 5655C, 5655M, 5655Y, 5655BK with remaining clearances therebetween. Now, the recording liquid supply tank 5655BK (for black ink) is larger than the other supply tanks 5655C, 5655M, 5655Y in consideration of the consumed amount of the black ink, whereby the frequencies with which the respective supply tanks will be replaced can be substantially standardized, thus simplifying the exchange of the supply tanks.

Recovery pumps 5659C, 5659M, 5659Y are connected to the recording liquid supply tanks 5655C, 5655M, 5655Y, respectively. And, two recovery pumps 5659BK and 5659BK(s) are connected to the recording liquid supply tank 5655BK, and these recovery pumps 5659BK and 5659BK(s) are connected to the recording heads 5601 (BK and BK(s)), respectively. With this arrangement, since only one detecting mechanism for detecting the absence of the black ink may be required, the apparatus will be simplified.

In FIG. 51, by rotating a gear 6503 in the recovery pump 5659 by means of an external motor 6507, the recording liquid 6506 is circulated. In this case, since pressure is generated, a packing 6505 is arranged between the recovery pump 5659 and the recording liquid supply tank 5655 to prevent the leakage of the recording liquid (ink).

Figure 54:
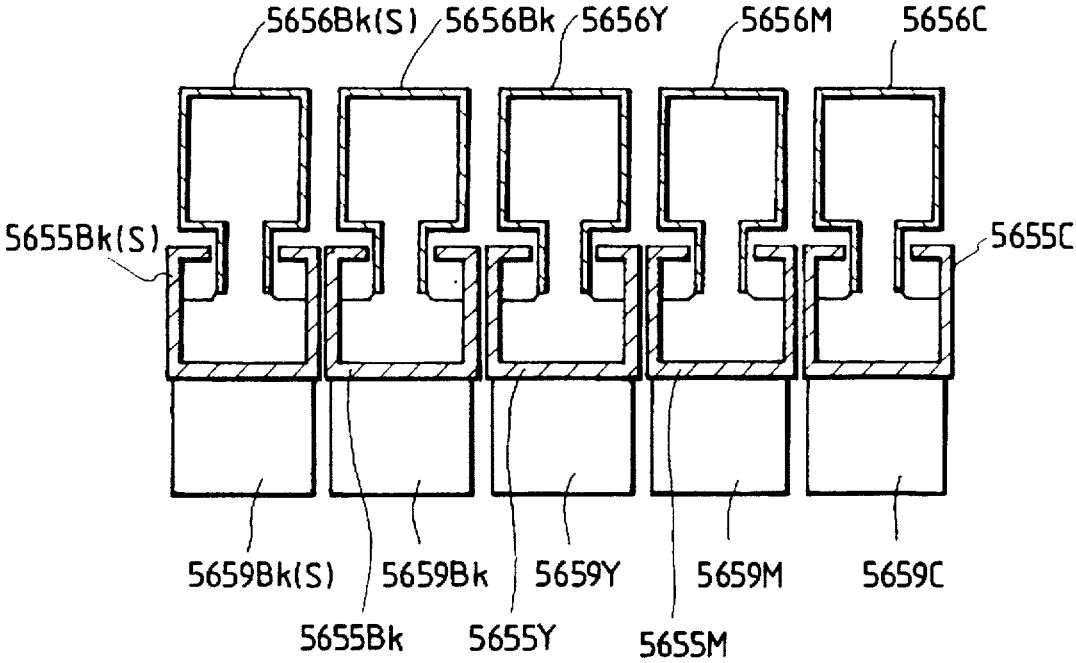
FIG. 54 is a sectional view of an ink supply system according to other embodiments.

FIG. 54 shows the other embodiment of the ink supply system. In this embodiment, the black ink used in the mono-color recording operation is supplied from a supply tank different from a supply tank for supplying the black ink for the full-color recording operation. As shown, main tanks 5656C, 5656M, 5656Y, 5656BK, 5656BK(s) are connected to corresponding recording liquid supply tanks 5655C, 5655M, 5655Y, 5655BK, 5655BK(s) with remaining clearances therebetween. Further, recovery pumps 5659C, 5659M, 5659Y, 5659BK, 5659BK(s) are connected to the recording liquid supply tanks 5655C, 5655M, 5655Y, 5655BK, 5655BK(s), respectively, and are also connected to the corresponding recording heads 5601, respectively.

Next, the heads and inks used with the above embodiments will be explained.

The mono-color recording head is so designed that the cross-sectional area of the discharge openings thereof is greater than those of the full-color recording heads. The reason is that the non-coated recording paper is normally used in the mono-color recording operation and the non-coated recording paper has a lower spreading rate than the coated recording paper. That is to say, if the same amount of ink is discharged on the recording papers (coated paper and non-coated paper), since the non-coated recording paper has a lower spreading rate, the density of the image formed on the non-coated paper will be lower than that of the image formed on the coated paper; accordingly, a larger amount of ink is required for the non-coated paper than the coated paper.

If the desired density of the image on the non-coated paper is not obtained by increasing the diameters or the cross sectional area of the discharge openings, then ink having a greater dye density may be used. That is to say, by increasing the amount of color dye included in the ink, it is possible to increase the image density.

Figure 53:
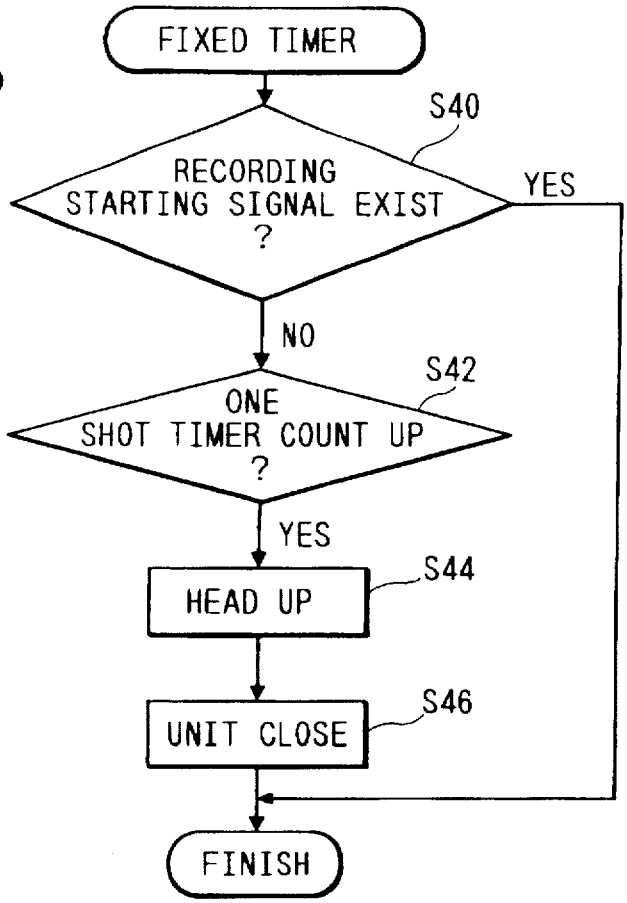
FIG. 53 is a flow chart showing a sub-routine for a fixed timer.

Next, a sequence for preventing the nondischarge of ink (step S6 in FIG. 45) will be explained with reference to flow charts representing the head control sequence shown in FIGS. 43 and 53.

As mentioned above, when the power source is activated, the ink pressurization circulation (recovery) operation is effected in consideration of the case where the recording apparatus is kept in the non-operative condition for a long time (step S10). Thereafter, the apparatus is maintained in the capping condition until the recording start signal is inputted; meanwhile, when a fixed timer means is activated, the circulation recovery operation is effected again (steps S12, S14). The fixed timer means serves to prevent the non-discharge of ink due to an increase in the viscosity of ink when the non-operative condition continues for a long time after the power source has been activated, and the set time of the timer varies in accordance with the feature of the ink and the operational circumferences, but in any case is on the order of hours.

Then, when the recording start signal is inputted, after the idle discharge operation is effected, the head down operation is performed and the recording operation is carried out (steps S16–S20). When the one-shot timer is activated during the recording operation (step S24), the head up operation is effected (step S26) and then the idle discharge operation is performed, and, thereafter, the head down operation is carried out again, thus continuing the recording operation. The one-shot timer is activated after a predetermined time period from the previous idle discharge operation controlled by the timer means, in order to prevent the non-discharge of ink regarding the non-operative discharge openings in consideration of the fact that all of the discharge openings are not always used during the recording operation. This is the operation that the slight non-discharge of ink is remedied by the idle discharge operation and is continued for a relatively short time on the order of a few minutes.

When the set number of recording papers are all treated in this way, the apparatus is maintained in the head down condition for a given time set by the one-shot timer and is waiting for the next recording start signal. Now, if the recording start signal is not inputted within the set time set by the one-shot timer, the head up operation is effected to close the unit, thus establishing the capping condition. On the other hand, when the recording start signal is inputted within the set time, the recording operation is re-started at that condition, thus carrying out the aforementioned recording sequence (shown in the flow chart of FIG. 53).

Figure 43:
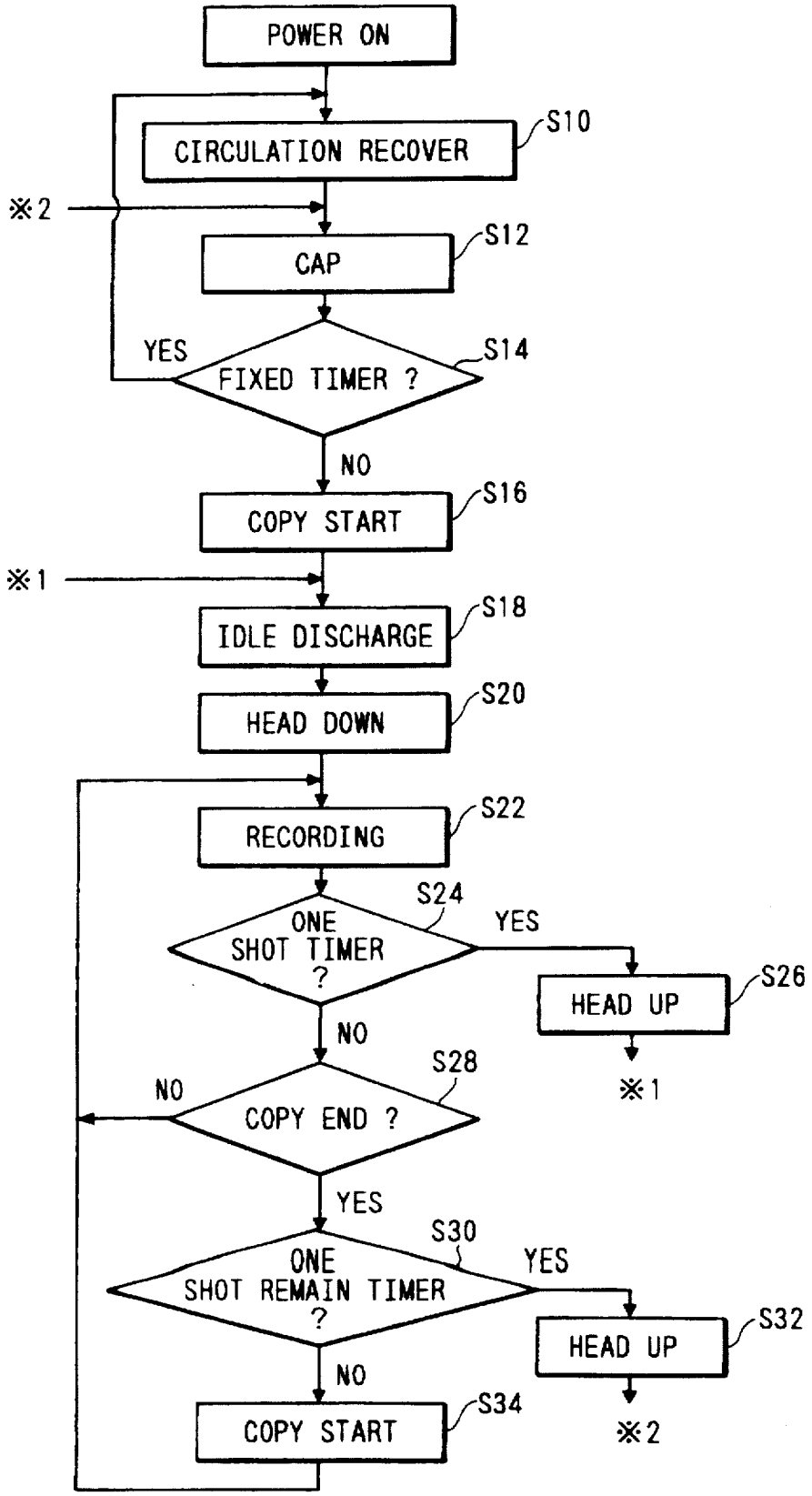
FIG. 43 PRIOR ART
FIG. 43 is a flow chart showing a sequence of the head control.

In place of the one-shot timer, a one-shot remain timer can be used (step S30) (FIG. 43). The one-shot remain timer provides a time obtained by subtracting the time between the previous idle discharge operation and the completion of the recording operation from the set time of the one-shot timer; however, during this time period, since the heads are maintained in the head down condition, and thus, are not capped (waiting condition), the time set by the one-shot remain timer is selected to be slightly smaller than the actual calculated time, in consideration of the easy drying of the ink.

As mentioned above, by providing the mono-color recording head (for extra black ink), as well as the four full-color recording heads, it is possible to record the image with high accuracy.

Further, by using the cheap non-coated recording paper (plain paper) in relation to the mono-color recording head, it is possible to obtain the mono-color image more cheaply.

In this way, since the second recording head for the mono-color recording mode is provided in addition to the provision of the first recording means for the multi-color recording mode (these means may comprise a single recording head or a plurality of recording heads), regardless of the activation rate of the mono-color recording head, the multi-color recording operation by means of the first recording means can be performed without any inconvenience. Further, it is possible to greatly improve the interruption of the recording due to the absence of the ink in the multi-color recording operation and to eliminate a poor recording, thus providing the reliable ink jet recording apparatus.

In addition, since it is possible to provide the mono-color recording head, as well as the plural color recording heads, by recording the mono-color image on the non-coated recording paper, economical advantages can be attained.

Further, even if the specific color ink in the first recording means is used up during the multi-color mode, since the recording operation can be continued by using the second recording head capable of providing this specific color ink without the interruption and/or the impossibility of the recording operation, an extremely excellent ink jet recording apparatus can be provided. In this case, the recording signal for the specific color ink to be inputted to the first recording means is switched so that the recording signal is inputted to the second recording head relating to the specific color ink, and the timing control is effected to correct between the recording timing of the first recording means relating to the specific color ink and the recording timing of the second recording head. Such switching and timing control are well known in the art and thus can be performed, for example, by providing an appropriate settable and switchable control means.

Further, in the aforementioned embodiments, the first recording means is disposed at an upstream side of the second recording head with respect to the recording medium (paper, coated paper, resin sheet or the like) feeding direction. With this arrangement, it is possible to provide the recording medium conveying condition for the high quality image formed by the first recording means with more preferable state, and to improve the fixing of ink largely discharged by the first recording means. On the other hand, when the second recording head is disposed at an upstream side of the first recording means, an advantage that the fixing time regarding the first recording means is greatly increased regardless of the features of various recording papers can be obtained.

Preferably, when the first recording means comprises a plurality of recording heads, the second recording head relating to the specific color ink is arranged adjacent to the recording head in the first recording means which relates to the specific color ink.

Of course, the second recording head relating to the specific color ink may be disposed between the recording heads of the first recording means.

In addition, since the mono-color recording head (for example, recording head of full-multi type for the extra black ink) is mounted on the color recording apparatus having the plural color recording heads (for example, four recording heads of four color full-multi type) and either one of these recording heads can be used as needed, by utilizing the plain paper (non-coated recording paper) in connection with the mono-color recording head, it is possible to obtain the cheaper copy.

It was found that, when such plural head arrangement is applied to the embodiment shown in FIG. 4, the same excellent effect can be obtained.

The present invention is particularly suited for use in an ink jet recording head and recording apparatus for discharging ink by utilizing the thermal energy. This is because, the high density of the picture element, and the high solution of the recording are possible.

The typical structure and the operational principles are disclosed in U.S. Pat. Nos. 4,723,129 and 4,740,796. The principles are applicable to a so-called on-demand type recording system and a continuous type recording system particularly however, it is suitable for the on-demand type because the principles are such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provide by the electrothermal transducer to produce film boiling on the heating portion of the recording head, whereby a bubble can be formed in the liquid (ink) corresponding to each of the driving signals. By the development and collapse of the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the above-mentioned patents. In addition, the present invention is applicable to the structure disclosed in Japanese Laid-Open Patent Application No. 59-123670 wherein a common slit is used as the ejection outlet for plural electrothermal transducers, and to the structure disclosed in Japanese Laid-Open Patent Application No. 59-138461 wherein an opening for absorbing a pressure wave of the thermal energy is formed corresponding to the ejecting portion. This is because, the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and a plural recording head combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressing or sucking means, preliminary heating means by the ejection electrothermal transducer or by a combination of the ejection electrothermal transducer and additional heating element and means for preliminary ejection not for the recording operation, which can stabilize the recording operation.

As regards the kinds of the mountable recording heads, it may be a single head corresponding to a single color ink, or may be plural heads corresponding to the plurality of ink materials having different recording color or density. The present invention is effectively applicable to an apparatus having at least one of a monochromatic mode mainly with black and a multi-color with different color ink materials and a full-color mode by the mixture of the colors which may be an integrally formed recording unit or a combination of plural recording heads.

Furthermore, in the foregoing embodiment, the ink has been liquid. It may be, however, an ink material solidified at room temperature or below and liquefied at room temperature. Since in the ink jet recording system, the ink is controlled within the temperature not less than 30° and not more than 70° to stabilize the viscosity of the ink to provide the stabilized ejection, in usual recording apparatus of this type, the ink is such that it is liquid within the temperature range when the recording signal is applied. In addition, the temperature rise due to the thermal energy is positively prevented by consuming it for the state change of the ink from the solid state to the liquid state, or the ink material is solidified when it is left is used to prevent the evaporation of the ink. In either of the cases, the application of the recording signal producing thermal energy, the ink may be liquefied, and the liquefied ink may be ejected. The ink may start to be solidified at the time when it reaches the recording material. The present invention is applicable to such an ink material as is liquefied by the application of the thermal energy. Such an ink material may be retained as a liquid or solid material on through holes or recesses formed in a porous sheet as disclosed in Japanese Laid-Open Patent Application No. 54-56847 and Japanese Laid-Open Patent Application No. 60-71260. The sheet faces to the electrothermal transducers. The most use for the ink materials described above is the film boiling system.

The ink jet recording apparatus may be used as an output terminal of an information processing apparatus such as computer or the like, a copying apparatus combined with an image reader or the like, or a facsimile machine having information sending and receiving functions.

According to the present invention, at least one side of the four sides of the orifice plates are not bonded with the front seal plate, and therefore, even if the front seal is influenced by the difference in the thermal expansions of various elements, the force applied to the orifice plate can be significantly reduced, and the deformation or the cracking the orifice plate of the top plate can be prevented.

Therefore, the cause of print quality degradation can be removed, and therefore, the ink jet recording head cartridge and an ink jet recording apparatus using the same can be provided which can produce high quality printing reliably under various conditions.

While the invention has been described with reference to the structures disclosed herein, it is not confined to the details set forth and this application is intended to cover such modifications or changes as may come within the purposes of the improvements or the scope of the following claims.

We claim:

1. An ink jet recording apparatus comprising:

head holding means for holding an ink jet head having a discharge opening at a lower portion thereof for discharging ink onto a recording surface of a recording medium opposed to said ink jet head;

conveying means for conveying the recording medium in a substantially horizontal direction beneath said ink jet head;

head shifting means for shifting said head holding means in a substantially vertical direction in a substantially linear movement to move said ink jet head toward and away from the recording medium;

head recovery means for recovering said ink jet head, said head recovery means being horizontally displaceable to an area between the recording medium and said head holding means when said head holding means is shifted vertically upwardly to move said ink jet head away from the recording medium, said head recovery means being provided with a waste ink opening for exhausting waste ink discharged from said ink let head to said head recovery means in a recovery operation; displacing means for horizontally displacing said recovery means in a substantially linear movement; and incline means for inclining said head recovery means so that a side thereof having the waste ink opening is located lower than an opposite side of said head recovery means when said head recovery means is retracted from said ink jet head by said displacing means.

2. An ink jet recording apparatus according to claim 1, wherein said displacing means shifts said head recovery means to a retracted position situated at an upstream side of a recording medium feeding direction in which the recording medium is conveyed by said conveying means.

3. An ink jet recording apparatus according to claim 1, wherein said displacing shifting means shifts said head recovery means to a retracted position situated at a downstream side relative to a recording medium feeding direction in which the recording medium is conveyed by said conveying means.

4. An ink jet recording apparatus according to claim 1, wherein said head shifting means and said displacing means are driven by a common driving motor.

5. An ink jet recording apparatus according to claim 1, wherein said head recovery means comprises:

an absorber member for absorbing waste ink exhausted from said ink jet head in the condition that said head recovery means is in confronting relation to said ink jet heads;

a container within which said absorber member is arranged and which has an upper end open to the atmosphere;

squeezing means for squeezing said absorber member substantially in a horizontal direction; and tilting means for tilting said container to collect and exhaust the waste ink squeezed from said absorber member by said squeezing means and gathered in said container.

6. An ink jet recording apparatus according to claim 5, wherein said head holding means further comprises:

head seal means for sealing between a plurality of ink jet heads, and a ink jet head holding means seal member for sealing between said plurality of ink jet heads and said head holding means, and wherein an engagement portion of said seal member for forming a sealed space with respect to discharge openings of said plurality of ink jet heads, by sealing an engagement portion between said head holding means and the container is provided on at least one of said head holding means and said container.

7. An ink jet recording apparatus according to claim 6, wherein the engagement between said head holding means and said container is effected by the cooperation of a projection formed on one of said head holding means and said engagement portion of said seal member and a corresponding recess formed in the other of said head holding means and said engagement portion seal member.

8. An ink jet recording apparatus according to claim 1, wherein said ink jet head further comprises:

ink discharge openings; and electrical/thermal converter elements for generating thermal energy which is utilized to cause film boiling in the ink and to thereby discharge the ink from said ink discharge openings.

9. An ink jet recording apparatus according to claim 1, wherein said ink jet head comprises a full-line head having a plurality of discharge openings arranged along a whole width of a recording area where the recording is effected on the recording medium.

10. An ink jet recording apparatus according to claim 1, wherein a plurality of ink jet heads discharges different color inks, respectively.

11. An ink jet recording apparatus according to claim 10, further comprising:

an additional ink jet head for discharging one color ink among said different color inks; and selection means for causing said ink jet recording apparatus to perform monochromatic or color recording by selectively using either said additional ink jet head or said plurality of ink jet heads, respectively.

12. An ink jet recording apparatus according to claim 11, wherein said plurality of ink jet heads discharge yellow color ink, magneta color ink, cyan color ink and black color ink, respectively, and said additional ink jet head discharges black color ink.

13. An ink jet recording apparatus according to claim 11, wherein, when the recording medium is a coated paper, the recording is effected by using said plurality of ink jet heads, otherwise the recording is effected by using said additional ink jet head.

14. An ink jet recording apparatus according to claim 11, wherein said plurality of ink jet heads are disposed at an upstream side of said additional ink jet head relative to a recording medium feeding direction in which the recording medium is conveyed by said conveying means.

15. An ink jet recording apparatus according to claim 1, further comprising:

a first ink supply path having a first inside diameter and a second ink supply path having a second inside diameter, each said ink supply path being provided for supplying the ink to said ink jet head, and wherein a friction loss water head of said first ink supply path differs from a friction loss water head of said second ink supply path.

16. An ink jet recording apparatus according to claim 15, wherein a direction of an ink flow in said first ink supply path during the recording operation is opposite to a direction of ink flow during the recovery operation.

17. An ink jet recording apparatus according to claim 15, wherein said first ink supply path is shorter than said second ink supply path and the friction loss water head of said first ink supply path is smaller than the friction loss water head of said second ink supply path.

18. An ink jet recording apparatus according to claim 15, wherein said first inner diameter is larger than said second diameter and the friction loss water head of said first ink supply path is smaller than the friction loss water head of said second ink supply path.

19. An ink jet recording apparatus comprising:

a head holding member for holding an ink jet head having a discharge opening at a lower portion thereof for discharging ink onto a recording surface of a recording medium opposed to said ink jet head;

a conveying mechanism for conveying the recording medium in a substantially horizontal direction beneath said ink jet head;

a head shifting mechanism for shifting said head holding member in a substantially vertical direction in a substantially linear movement to move said ink jet head toward and away from the recording medium;

a head recovery member for recovering said ink jet head, said head recovery member being horizontally displaceable to an area between the recording medium and said head holding member when said head holding member is shifted vertically upwardly to move said ink jet head away from the recording medium, said head recovery member being provided with a waste ink opening for exhausting waste ink discharged from said ink jet head to said head recovery mechanism in a recovery operation;

a displacing mechanism for horizontally displacing said head recovery member in a substantially linear movement; and an incline mechanism for inclining said head recovery member so that a side thereof having the waste ink opening is located below an opposite side of said head recovery member when said head recovery member is retracted from said ink jet head by said displacing mechanism.

20. A recovery method for an ink jet apparatus, comprising the steps of:

moving an ink jet head upwardly in a normal direction;

inserting a recovery member into a gap formed between a recording medium moving horizontally and the ink jet head, by moving the recovering member horizontally;

recovering the ink jet head by moving the ink jet head downward in the normal direction and performing a recovery operation toward the recovery member;

moving the ink jet head upward in the normal direction;

retracting the recovery member from the gap to an initial position, by moving the recovery member horizontally; and discharging waste ink collected in the recovery member.

* * * * *

UNITED STATES PATENT AND TRADEMARK OFFICE

CERTIFICATE OF CORRECTION

PATENT NO. : 5,757,399

DATED : May 26, 1998

INVENTOR(S) : YASUSHI MURAYAMA, ET AL.

It is certified that error appears in the above-identified patent and that said Letters Patent is hereby corrected as shown below:

On the title page, item

AT [56] REFERENCES CITED

U.S. PATENT DOCUMENTS

"Yashimura et al." should read --Yoshimura et al.--

[56] ABSTRACT

Line 17, "relation" should be deleted.

COLUMN 1

Line 54, "the remarkably" should read --have remarkably--.

COLUMN 2

Line 43, "utilize effectively" should read --effectively utilize--.

COLUMN 3

Line 3, "pipes 1221B," should read --pipes 1221Y,--; and
Line 32, "such" should read --such a--.

COLUMN 6

Line 14, "in" should be deleted; and
Line 30, "view" should read --views--.

COLUMN 7

Line 30, "FIGS. 33" should read --FIG. 33--;
Line 54, "a" should be deleted.
Line 56, "of" (first occurrence) should read --of the--; and
Line 58, "pressurize" should read --pressurizing--.

UNITED STATES PATENT AND TRADEMARK OFFICE

CERTIFICATE OF CORRECTION

PATENT NO. : 5,757,399

DATED : May 26, 1998

INVENTOR(S) : YASUSHI MURAYAMA, ET AL.

It is certified that error appears in the above-identified patent and that said Letters Patent is hereby corrected as shown below:

COLUMN 12

Line 43, "("left" should read --"left--; and
Line 67, "view" should read --views--.

COLUMN 13

Line 32, "retarded" should read --retracted--.

COLUMN 14

Line 51, "FIG. 110A" should read --10A--.

COLUMN 15

Line 27, "movement" should read --motion--.

COLUMN 16

Line 44, "(c)" should read --(a)--.

COLUMN 17

Line 51, "flow" should read --flows--.

COLUMN 18

Line 60, "absorbed," should read --absorbers-- and
"absorber" should read --absorbed--.

COLUMN 19

Line 60, "the" should be deleted.

UNITED STATES PATENT AND TRADEMARK OFFICE

CERTIFICATE OF CORRECTION

PATENT NO. : 5,757,399

DATED : May 26, 1998

INVENTOR(S) : YASUSHI MURAYAMA, ET AL.

It is certified that error appears in the above-identified patent and that said Letters Patent is hereby corrected as shown below:

COLUMN 22

Line 15, "hands" should read --heads--; and
Line 58, "adhesive." should read --with adhesive.--.

COLUMN 23

Line 45, "groove" should read --groove.--; and
Line 64, "FIGS. 24," should read --FIG. 24,--.

COLUMN 24

Line 5, "A" should read --As--.

COLUMN 25

Line 4, "respectively" should read --respectively--;
Line 26, "in" should read --on--;
Line 27, "on" should read --in--; and
Line 65, "high by" should read --highly--.

COLUMN 26

Line 12, "the" (first occurrence) should be deleted.

COLUMN 27

Line 15, "a" should read --or--; and
Line 47, "also-" should read --(also- --.

COLUMN 28

Line 9, "of" should be deleted; and
Line 50, "at need." should read --as needed--.

UNITED STATES PATENT AND TRADEMARK OFFICE

CERTIFICATE OF CORRECTION

PATENT NO. : 5,757,399

DATED : May 26, 1998

INVENTOR(S) : YASUSHI MURAYAMA, ET AL.

It is certified that error appears in the above-identified patent and that said Letters Patent is hereby corrected as shown below:

COLUMN 29

Line 16, "$h=\lambda(ld/d)x(V^2/2g)$" should read --$h=\lambda(\ell/d)x(V^2/2g)$--; and
Line 18, "1" should read --$\ell$--.

COLUMN 31

Line 36, "is" should read --in--.

COLUMN 32

Line 16, "a" (first occurrence) should be deleted;
Line 44, "cases" should read --case,--; and
Line 45, "40417" should read --4041,--.

COLUMN 33

Line 15, "movement" should read --motion--.

COLUMN 35

Line 65, "pressurize" should read --pressurization--.

COLUMN 36

Line 4, "pressurize" should read --pressurization--; and
Line 34, "pressurize" should read --pressurization--.

COLUMN 37

Line 7, "high by" should read --highly--;
Line 8, "for the" should be deleted--;
Line 24, "pressurize" should read --pressurization--; and
Line 29, "pressurize" should read --pressurization--.

UNITED STATES PATENT AND TRADEMARK OFFICE

CERTIFICATE OF CORRECTION

PATENT NO. : 5,757,399

DATED : May 26, 1998

INVENTOR(S) : YASUSHI MURAYAMA, ET AL.

It is certified that error appears in the above-identified patent and that said Letters Patent is hereby corrected as shown below:

COLUMN 38

Line 8, "flows" should read --flow--; and
Line 64, "l" should read --ℓ--.

COLUMN 39

Line 18, "with" should read --while--.

COLUMN 40

Line 5, "and the" (first occurrence) should be deleted and "interval" should read --time--; and
Line 54, "the," should read --the--.

COLUMN 41

Line 9, "a" should be deleted.

COLUMN 43

Line 10, "nondischarge" should read --non-discharge--.

COLUMN 44

Line 18, "a" should read --the--; and
Line 19, "the" should read --a--.

COLUMN 45

Line 23, "provide" should read --provided--.

UNITED STATES PATENT AND TRADEMARK OFFICE

CERTIFICATE OF CORRECTION

PATENT NO. : 5,757,399

DATED : May 26, 1998

INVENTOR(S) : YASUSHI MURAYAMA, ET AL.

It is certified that error appears in the above-identified patent and that said Letters Patent is hereby corrected as shown below:

COLUMN 46

Line 23, "30°" should read --30°C.--;
Line 24, "70°" should read --70°C.--;
Line 25, "in" should read --in a--;
Line 31, "is used" should read --unused--;
Line 42, "to" should be deleted;
Line 46, "as" should read --as a--; and
Line 55, "cracking" should read --cracking of--.

COLUMN 47

Line 21, "let" should read --jet--;
Line 22, "operation; displacing" should read --operation; ¶ displacing--;
Line 37, "shifting" should be deleted;
Line 50, "heads;" should read --head;--;
Line 64, "heads," should read --heads;--; and
Line 65, "a" should read --an--.

COLUMN 48

Line 1, "and" should be deleted; and
Line 5, "container" should read --container,--.

Signed and Sealed this

Sixth Day of July, 1999

*Attest:*

Q. TODD DICKINSON

*Attesting Officer*

*Acting Commissioner of Patents and Trademarks*